US010912688B2

(12) United States Patent
Cooper et al.

(10) Patent No.: US 10,912,688 B2
(45) Date of Patent: Feb. 9, 2021

(54) MOBILITY ENHANCEMENT WHEELCHAIR

(71) Applicants: University of Pittsburgh—Of The Commonwealth System of Higher Education, Pittsburgh, PA (US); The United States Government as represented by the Department of Veterans Affairs, Washington, DC (US)

(72) Inventors: Rory Alan Cooper, Gibsonia, PA (US); Hongwu Wang, Edmond, OK (US); Cheng-Shiu Chung, Pittsburgh, PA (US); Jorge Luis Candiotti, Mars, PA (US); Garrett G. Grindle, Pittsburgh, PA (US); Jonathan L. Pearlman, Pittsburgh, PA (US); Brandon Joseph Daveler, Pittsburgh, PA (US)

(73) Assignees: The United States Government As Represented By The Department of Veterans Affairs, Washington, DC (US); University of Pittsburgh—Of The Commonwealth System Of Higher Education, Pittsburgh, PA (US)

( * ) Notice: Subject to any disclaimer, the term of this patent is extended or adjusted under 35 U.S.C. 154(b) by 270 days.

(21) Appl. No.: 15/762,594

(22) PCT Filed: Sep. 23, 2016

(86) PCT No.: PCT/US2016/053287

§ 371 (c)(1),
(2) Date: Mar. 23, 2018

(87) PCT Pub. No.: WO2017/053689

PCT Pub. Date: Mar. 30, 2017

(65) Prior Publication Data

US 2020/0121526 A1 Apr. 23, 2020

Related U.S. Application Data

(60) Provisional application No. 62/232,550, filed on Sep. 25, 2015.

(51) Int. Cl.

| | |
|---|---|
| ***A61G 5/04*** | (2013.01) |
| ***A61G 5/10*** | (2006.01) |
| ***A61G 5/06*** | (2006.01) |

(52) U.S. Cl.
CPC ..... *A61G 5/043* (2013.01); *A61G 5/061* (2013.01); *A61G 5/1056* (2013.01); *A61G 5/1089* (2016.11)

(58) Field of Classification Search
CPC ..... A61G 5/043; A61G 5/1089; A61G 5/061; A61G 5/1056
See application file for complete search history.

(56) References Cited

U.S. PATENT DOCUMENTS 3,104,112 A 9/1963 Crail
3,169,596 A 2/1965 Wright
(Continued)

FOREIGN PATENT DOCUMENTS

WO WO2017053689 3/2017

OTHER PUBLICATIONS

J. Candiotti et al., "Kinematics and Stability Analysis of a Novel Power Wheelchair When Traversing Architectural Barriers," Topics in Spinal Cord Injury Rehabilitation, vol. 23, No. 2, pp. 110-119, 2017.

(Continued)

*Primary Examiner* — Ruth Ilan
*Assistant Examiner* — Conan D Duda
(74) *Attorney, Agent, or Firm* — Ballard Spahr LLP

(57) ABSTRACT

A wheelchair includes a frame, a seat attached to the frame, a first forward wheel on a first side of the frame and a second (Continued)

forward wheel on a second side of the frame, a first rearward wheel on the first side of the frame and a second rearward wheel on the second side of the frame, a first drive wheel on the first side of the frame positioned intermediate between the first forward wheel and the first rearward wheel and a second drive wheel on the second side of the frame positioned intermediate between the second forward wheel and the second rearward wheel, and actuators to independently control the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame.

19 Claims, 31 Drawing Sheets

(56) References Cited

U.S. PATENT DOCUMENTS

| | | | | |
|---|---|---|---|---|
| 3,196,970 | A | 7/1965 | Brenner | |
| 3,592,282 | A | 7/1971 | Soileau | |
| 4,310,167 | A | 1/1982 | McLaurin | |
| 4,569,409 | A | 2/1986 | Kluth | |
| 4,618,155 | A | 10/1986 | Jayne | |
| 5,123,495 | A | 6/1992 | Littlejohn | |
| 5,653,301 | A | 8/1997 | Andre | |
| 5,848,658 | A | 12/1998 | Pulver | |
| 5,964,473 | A | 10/1999 | Degonda | |
| 6,076,619 | A | 6/2000 | Hammer | |
| 6,129,165 | A | 10/2000 | Schaffner | |
| 6,250,409 | B1 | 6/2001 | Wells | |
| 6,443,250 | B1 | 9/2002 | Kamen | |
| 6,540,250 | B1 | 4/2003 | Peterson | |
| 7,219,755 | B2 | 5/2007 | Goertzen | |
| 7,374,002 | B2 | 5/2008 | Fought | |
| 7,597,163 | B2 | 10/2009 | Goertzen | |
| 7,726,689 | B2 | 6/2010 | Mulhern | |
| 2003/0205420 | A1* | 11/2003 | Mulhern | A61G 5/1089 180/65.1 |
| 2004/0094944 | A1 | 5/2004 | Goertzen | |
| 2004/0173983 | A1* | 9/2004 | Cheng | A61G 5/1078 280/124.1 |
| 2004/0262859 | A1* | 12/2004 | Turturiello | A61G 5/1089 280/5.515 |
| 2005/0151360 | A1* | 7/2005 | Bertrand | A61G 5/10 280/755 |
| 2007/0145711 | A1* | 6/2007 | Mulhern | A61G 5/045 280/304.1 |
| 2008/0053720 | A1* | 3/2008 | Chen | A61G 5/06 180/65.1 |
| 2008/0066974 | A1* | 3/2008 | Pearlman | A61G 5/043 180/22 |
| 2010/0004820 | A1* | 1/2010 | Bekoscke | B60G 17/005 701/38 |
| 2010/0084209 | A1* | 4/2010 | Bekoscke | A61G 5/1089 180/209 |
| 2013/0197732 | A1* | 8/2013 | Pearlman | A61G 5/00 701/22 |
| 2013/0207364 | A1* | 8/2013 | Bekoscke | A61G 5/10 280/124.104 |
| 2014/0379224 | A1* | 12/2014 | Hyde | B60N 2/002 701/49 |
| 2015/0196438 | A1* | 7/2015 | Mulhern | A61G 5/128 280/5.28 |
| 2015/0196441 | A1 | 7/2015 | Mulhern | |
| 2015/0209207 | A1 | 7/2015 | Cooper | |
| 2016/0367418 | A1* | 12/2016 | Stenstrom | A61G 5/1067 |
| 2017/0189250 | A1* | 7/2017 | Juhasz | A61G 5/043 |
| 2017/0367912 | A1* | 12/2017 | Chiang | A61G 5/1078 |
| 2018/0028380 | A1* | 2/2018 | Behrens | A61G 5/068 |
| 2018/0056985 | A1* | 3/2018 | Coulter | A61G 5/061 |
| 2018/0161221 | A1* | 6/2018 | Cheng | A61G 5/043 |
| 2018/0164829 | A1* | 6/2018 | Oshima | A61G 5/04 |
| 2018/0214325 | A1* | 8/2018 | Van de Wal | A61G 5/1078 |
| 2018/0360678 | A1* | 12/2018 | Cuson | A61G 5/06 |
| 2019/0046373 | A1* | 2/2019 | Coulter | A61G 5/063 |
| 2019/0192362 | A1* | 6/2019 | Mulhern | A61G 5/04 |
| 2019/0290514 | A1* | 9/2019 | Garland | A61G 5/045 |
| 2020/0121526 | A1* | 4/2020 | Cooper | A61G 5/043 |

OTHER PUBLICATIONS

J. Candiotti et al., "Design and evaluation of a seat orientation controller during uneven terrain driving," Medical engineering & physics, 2016.

J. C. Andrea Sundaram, Hongwu Wang, and Rory Cooper, "Development and Simulation of a Self-Leveling Algorithm for the Mobility Enhancement Robotic Wheelchair," presented at the Rehabilitation Engineering and Assistive Technology Society of North America, Arlington, Virginia, 2016.

J. Candiotti et al., "Usability evaluation of a novel robotic power wheelchair for indoor and outdoor navigation," in Archives of Physical Medicine and Rehabilitation, ed, (in Press).

H. W. Candiotti J, Ch Chung, M Shino, R Cooper "Design and development of a step climbing sequence for a novel electric powered wheelchair," presented at the Rehabilitation Engineers Society of North America Conference, Baltimore, Maryland 2012.

J. L. Candiotti, "Design, development, and usability evaluation of control algorithms for a mobility enhancement robotic wheelchair (mebot)," Doctoral dissertation, University of Pittsburgh, 2017.

O. Chuy, E. G. Collins, C. Ordonez, J. Candiotti, H. Wang, and R. Cooper, "Slip mitigation control for an Electric Powered Wheelchair," in Robotics and Automation (ICRA), 2014 IEEE International Conference on, 2014, pp. 333-338: IEEE.

R. Cooper et al., "Personal mobility and manipulation appliance—design, development, and initial testing," Proceedings of the IEEE, vol. 100, No. 8, pp. 2505-2511, 2012.

B. Daveler, B. Salatin, G. G. Grindle, J. Candiotti, H. Wang, and R. A. Cooper, "Participatory design and validation of mobility enhancement robotic wheelchair," J. Rehabil. Res. Dev, vol. 52, No. 6, pp. 739-750, 2015.

H. Wang et al., "Development of an advanced mobile base for personal mobility and manipulation appliance generation II robotic wheelchair," The journal of spinal cord medicine, vol. 36, No. 4, pp. 333-346, 2013.

* cited by examiner 10
20a
40a
42a
60a
62a
700

MOBILITY ENHANCEMENT WHEELCHAIR

CROSS-REFERENCE TO RELATED APPLICATION

This application is a national phase filing of PCT International Patent Application No. PCT/US2016/053287, filed Sep. 23, 2016, which claims benefit of U.S. Provisional Patent Application Ser. No. 62/232,550, filed Sep. 25, 2015, the disclosures of which are incorporated herein by reference.

STATEMENT OF GOVERNMENT SUPPORT

This invention was made with government support under Grant Nos. EEC0540865 and DGE1144584 awarded by the National Science Foundation and under U.S. Department of Veteran Affairs Grant Nos. B3142C and B6789C. The government has certain rights in the invention.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

The Electric Powered Wheelchair (EPW) is an essential mobility device for people who have limited or no upper and/or lower extremity movement such as those diagnosed with spinal cord injury, cerebral palsy, amyotrophic lateral sclerosis, or muscular dystrophy. Many users not only use their EPW indoors but also outdoors when going to work, a doctor's appointment, the grocery store, or a friend's house. Unfortunately, when EPW users venture into the outdoor environment they may encounter unfamiliar conditions or obstacles which may lead to them becoming stuck or tipping over their wheelchair, causing serious injury or death. Such conditions may include uneven terrain, steep slopes (running slopes), slippery surfaces, cross slopes, and architectural barriers such as curbs and steps.

The number of EPW users is expected to increase as a result of the aging baby boomer population and injured military personnel. With an estimate of 330,000 current EPW users, the need to increase wheelchair safety is becoming increasingly important. It has been reported that most common accidents are caused by the loss of traction, being immobilized, or the loss of stability. Many EPW users have experienced a tip or fall and associated injuries.

It is thus desirable to develop EPWs with features that increase the users' safety when encountering hazardous conditions or obstacles in an outdoor and/or indoor environment.

SUMMARY

In one aspect, a wheelchair includes a frame, a seat or seat system attached to the frame, a first forward wheel on a first side of the frame and a second forward wheel on a second side of the frame, a first rearward wheel on the first side of the frame and a second rearward wheel on the second side of the frame, a first drive wheel on the first side of the frame positioned intermediate between the first forward wheel and the first rearward wheel and a second drive wheel on the second side of the frame positioned intermediate between the second forward wheel and the second rearward wheel, a first forward wheel actuator in operative connection with the first forward wheel to control a vertical position of the first forward wheel relative to the frame, a second forward wheel actuator in operative connection with the second forward wheel to control a vertical position of the second forward wheel relative to the frame, a first rearward wheel actuator in operative connection with the first rearward wheel to control a vertical position of the first rearward wheel relative to the frame, a second rearward wheel actuator in operative connection with the second rearward wheel to control a vertical position of the second rearward wheel relative to the frame, a first drive wheel actuator in operative connection with the first drive wheel to control a vertical position of the first drive wheel relative to the frame and a second drive wheel actuator in operative connection with the second drive wheel to control a vertical position of the second drive wheel relative to the frame. Each of the first forward wheel actuator, the second forward wheel actuator, the first rearward wheel actuator, the second rearward wheel actuator, the first drive wheel actuator and the second drive wheel actuator is operable to independently control the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame.

The wheelchair may further include a first longitudinal drive wheel actuator in operative connection with the first drive wheel to independently control a longitudinal position of the first drive wheel relative to the frame and a second longitudinal drive wheel actuator in operative connection with the second drive wheel to independently control the longitudinal position of the second drive wheel relative to the frame. In a number of embodiments, the wheelchair further includes a control system in operative connection with the first forward actuator, the second forward actuator, the first rearward actuator, the second rearward actuator, the first drive wheel actuator, the second drive wheel actuator, the first longitudinal drive wheel actuator and the second longitudinal drive wheel actuator. The wheelchair may, for example, further include a sensor system in operative connection with the control system. In a number of embodiments, the sensor system includes a sensor to measure an orientation (relative to gravity) of the seat, and the control system is operable to control at least one of the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame independently to maintain the orientation of the seat (relative to gravity) in a desired range.

The control system may, for example, be operable to control a plurality of the vertical positions of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame independently to maintain the orientation of the seat in a desired range. The control system may, for example, be operable to maintain the orientation of the seat in the desired range when the wheelchair is traveling on at least one of a downslope, an upslope, a cross-slope or uneven terrain. In a number of embodiments, the control system is operable to maintain the orientation of the seat in the desired range when the wheelchair is ascending and descending a curb, step change or change in elevation of up to 8 inches in height. The orientation of the seat may, for example, be maintained when ascending or descending multiple step changes (or stairs).

In a number of embodiments, the control system is operable to effect a crawling motion of the wheelchair wherein the vertical position of the first drive wheel and the longitudinal position of the first drive wheel are changed and the vertical position of the second drive wheel and the longitudinal position of the first drive wheel are changed in a manner to pull the wheelchair along a path. The control system may, for example, be operable to actuate one or more of the first forward wheel actuator, the second forward wheel actuator, the first rearward wheel actuator, the second rearward wheel actuator, the first drive wheel actuator, and the second drive wheel actuator to change an orientation of the seat to perform lateral pressure relief. The control system may, for example, be operable to actuate one or more of the first forward wheel actuator, the second forward wheel actuator, the first rearward wheel actuator, the second rearward wheel actuator, the first drive wheel actuator, and the second drive wheel actuator to change a ground clearance of the wheelchair. In a number of embodiments, the control system is operable to control whole body vibration.

In a number of embodiments, the seat is fixed to the frame or immovably attached to the frame and changes in seat orientation relative to gravity are achieved via changing orientation of the frame relative to gravity. In other embodiments, the seat is movably connected to the frame and changes in seat orientation relative to gravity are achieved via at least one of changes in orientation of the seat relative to the frame and changes in orientation of the frame relative to gravity. The seat may, for example, be operatively connected to the frame via an actuator system to adjust at least one of anterior/posterior angle of tilt relative to gravity, a lateral angle of tilt relative to gravity and seat elevation relative to the frame.

In another aspect, a method includes providing a wheelchair including a frame, a seat attached to the frame, a first forward wheel on a first side of the frame and a second forward wheel on a second side of the frame, a first rearward wheel on the first side of the frame and a second rearward wheel on the second side of the frame, a first drive wheel on the first side of the frame positioned intermediate between the first forward wheel and the first rearward wheel and a second drive wheel on the second side of the frame positioned intermediate between the second forward wheel and the second rearward wheel, a first forward wheel actuator in operative connection with the first forward wheel to control a vertical position of the first forward wheel relative to the frame, a second forward wheel actuator in operative connection with the second forward wheel to control a vertical position of the second forward wheel relative to the frame, a first rearward wheel actuator in operative connection with the first rearward wheel to control a vertical position of the first rearward wheel relative to the frame, a second rearward wheel actuator in operative connection with the second rearward wheel to control a vertical position of the second rearward wheel relative to the frame, a first drive wheel actuator in operative connection with the first drive wheel to control a vertical position of the first drive wheel relative to the frame, and a second drive wheel actuator in operative connection with the second drive wheel to control a vertical position of the second drive wheel relative to the frame. The method further includes operating each of the first forward wheel actuator, the second forward wheel actuator, the first rearward wheel actuator, the second rearward wheel actuator, the first drive wheel actuator and the second drive wheel actuator independently to independently control the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame.

The method may, for example, further include operating a first longitudinal drive wheel actuator in operative connection with the first drive wheel to independently control a longitudinal position of the first drive wheel relative to the frame and operating a second longitudinal drive wheel actuator in operative connection with the second drive wheel to independently control the longitudinal position of the second drive wheel relative to the frame. In a number of embodiments, the method further includes providing a control system in operative connection with the first forward wheel actuator, the second forward wheel actuator, the first rearward wheel actuator, the second rearward wheel actuator, the first drive wheel actuator, the second drive wheel actuator, the first longitudinal drive wheel actuator and the second longitudinal drive wheel actuator. The method may, for example, further include providing a sensor system in operative connection with the control system. In a number of embodiments, the method further includes measuring an orientation (relative to gravity) of the seat via the sensor system and controlling via the control system at least one of the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame independently to maintain the orientation of the seat (relative to gravity) in a desired range. The method may, for example, further include using the control system to control a plurality of the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame independently to maintain the orientation of the seat in a desired range. The method may, for example, include maintaining the orientation of the seat in the desired range when the wheelchair is traveling on at least one of a downslope, an upslope, a cross-slope or uneven terrain. The method may, for example, include maintaining the orientation of the seat in the desired range when the wheelchair is ascending descending a curb, step change or elevation change of up to 8 inches in height.

In a number of embodiments, the method further includes operating the control system to effect a crawling motion of the wheelchair wherein the vertical position of the first drive wheel and the longitudinal position of the first drive wheel are changed and the vertical position of the second drive wheel and the longitudinal position of the second drive wheel are changed in a manner to pull the wheelchair along a path. The method may, for example, further include operating the control system to actuate one or more of the first forward wheel actuator, the second forward wheel actuator, the first rearward wheel actuator, the second rearward wheel actuator, the first drive wheel actuator, and the second drive wheel actuator to change an orientation of the seat to perform lateral pressure relief. The method may, for example, further include operating the control system to actuate one or more of the first forward wheel actuator, the second forward wheel actuator, the first rearward wheel actuator, the second rearward wheel actuator, the first drive wheel actuator, and the second drive wheel actuator to change a ground clearance of the wheelchair. In a number of embodiments, the method further includes operating the control system to control whole body vibration.

As described above, the seat may, for example, be immovably attached to the frame and changes in seat orientation relative to gravity are achieved via changing orientation of the frame relative to gravity. In other embodiments, the seat is movably attached to the frame and changes in seat orientation relative to gravity are achieved via at least one of changes in orientation of the seat relative to the frame and changes in orientation of the frame relative to gravity.

In a further aspect, a wheelchair includes a frame, a seat attached to the frame, a first forward wheel on a first side of the frame and a second forward wheel on a second side of the frame, a first rearward wheel on the first side of the frame and a second rearward wheel on the second side of the frame, a first drive wheel on the first side of the frame positioned intermediate between the first forward wheel and the first rearward wheel and a second drive wheel on the second side of the frame positioned intermediate between the second forward wheel and the second rearward wheel, and a first longitudinal drive wheel actuator in operative connection with the first drive wheel to control a longitudinal position of the first drive wheel relative to the frame and a second longitudinal drive wheel actuator in operative connection with the second drive wheel to control the longitudinal position of the second drive wheel relative to the frame independently of the control of the longitudinal position of the first drive wheel relative to the frame via the first longitudinal drive wheel actuator. In a number of embodiments, the first longitudinal drive wheel actuator controls the longitudinal position of the first drive wheel relative to the frame independently of the control of the longitudinal position of the second drive wheel relative to the frame by the second longitudinal drive wheel actuator. In a number of embodiments, the wheelchair further includes a first drive wheel actuator in operative connection with the first drive wheel to control a vertical position of the first drive wheel relative to the frame; and a second drive wheel actuator in operative connection with the second drive wheel to control a vertical position of the second drive wheel relative to the frame.

The present devices, systems, and methods, along with the attributes and attendant advantages thereof, will best be appreciated and understood in view of the following detailed description taken in conjunction with the accompanying drawings.

DETAILED DESCRIPTION

Figure 1A:
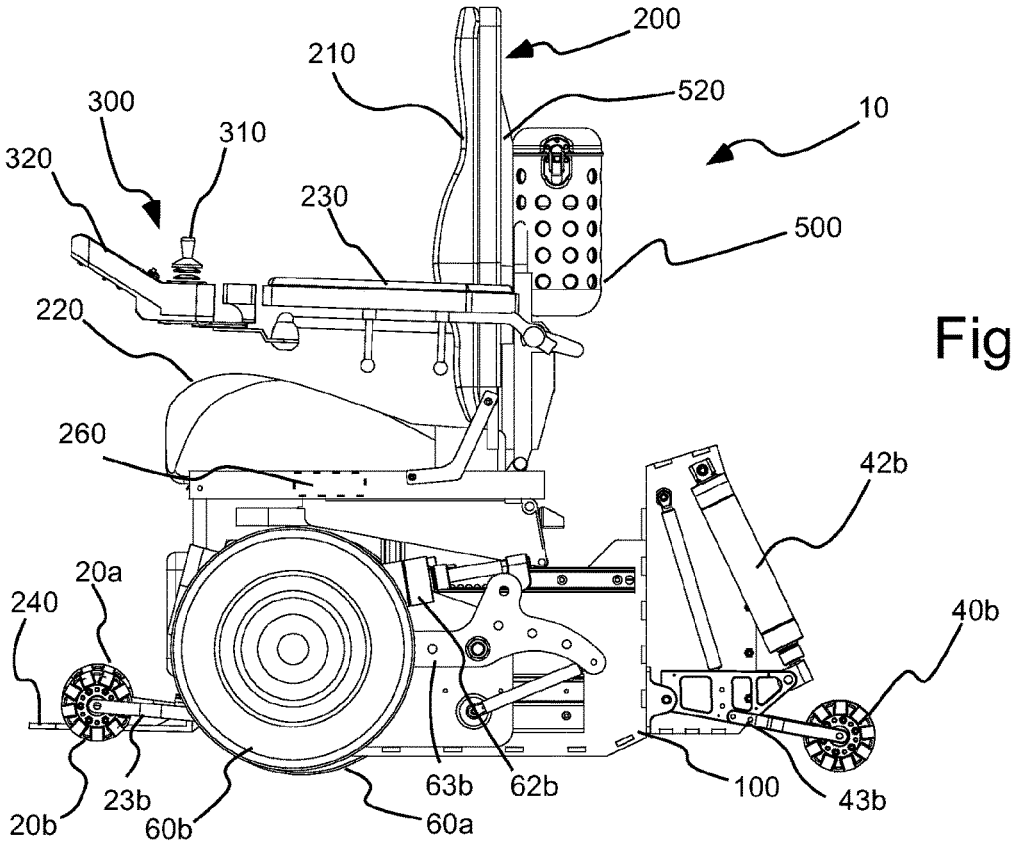
FIG. 1A illustrates a side view of an embodiment of a wheelchair hereof.
Figure 1B:
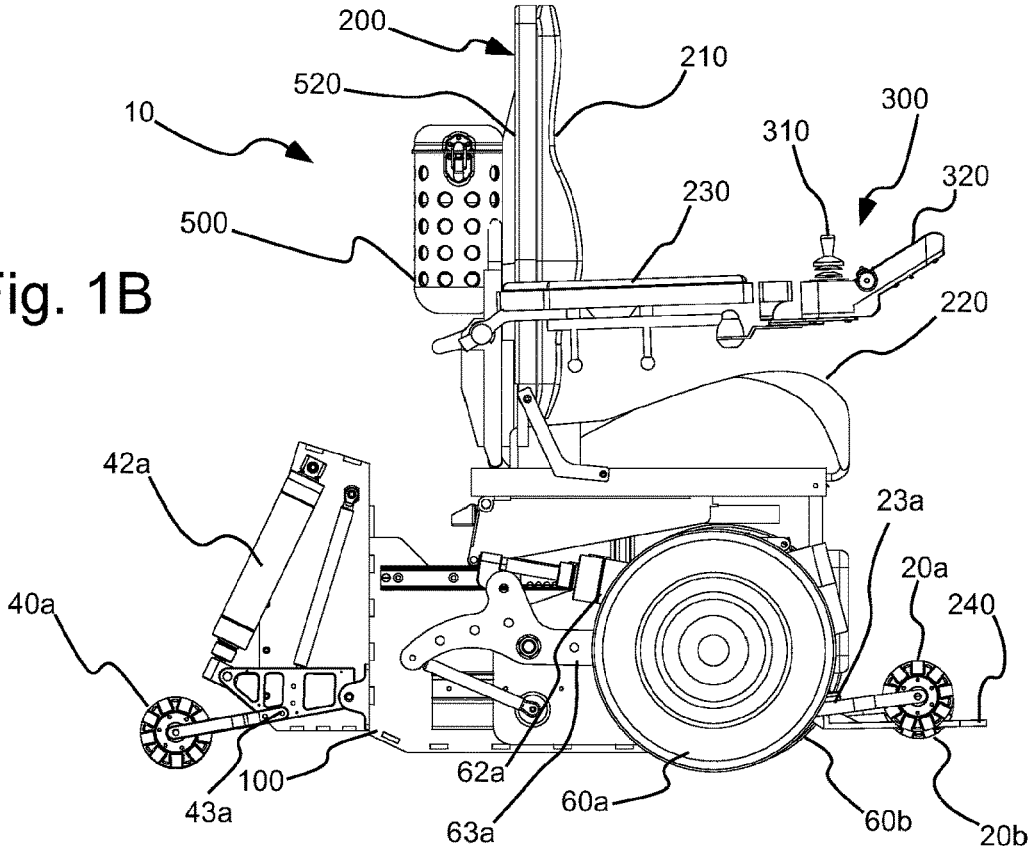
FIG. 1B illustrates another side view of the wheelchair of FIG. 1A, opposite the side view of FIG. 1A.
Figure 1C:
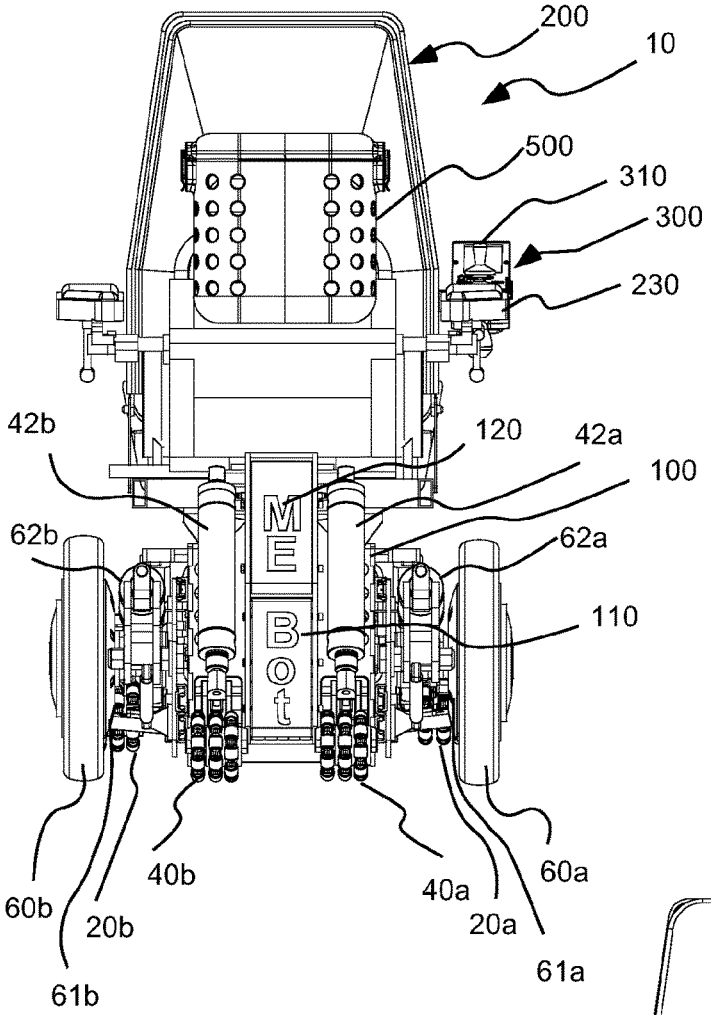
FIG. 1C illustrates a rear view of the wheelchair of FIG. 1A.
Figure 1D:
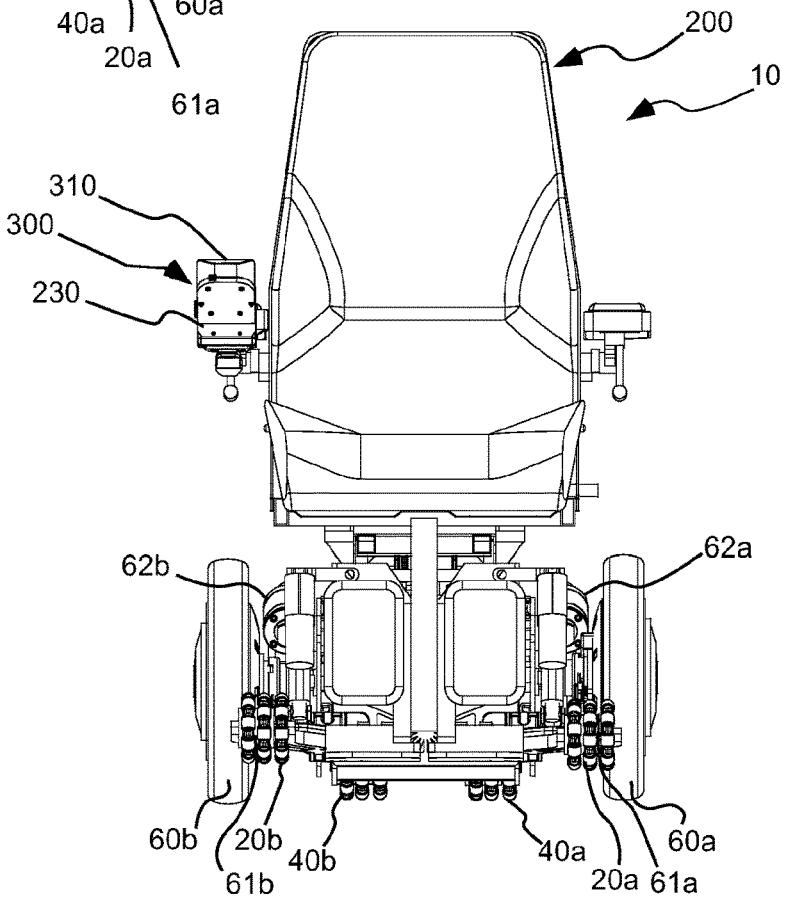
FIG. 1D illustrates a front view of the wheelchair of FIG. 1A.
Figure 1E:
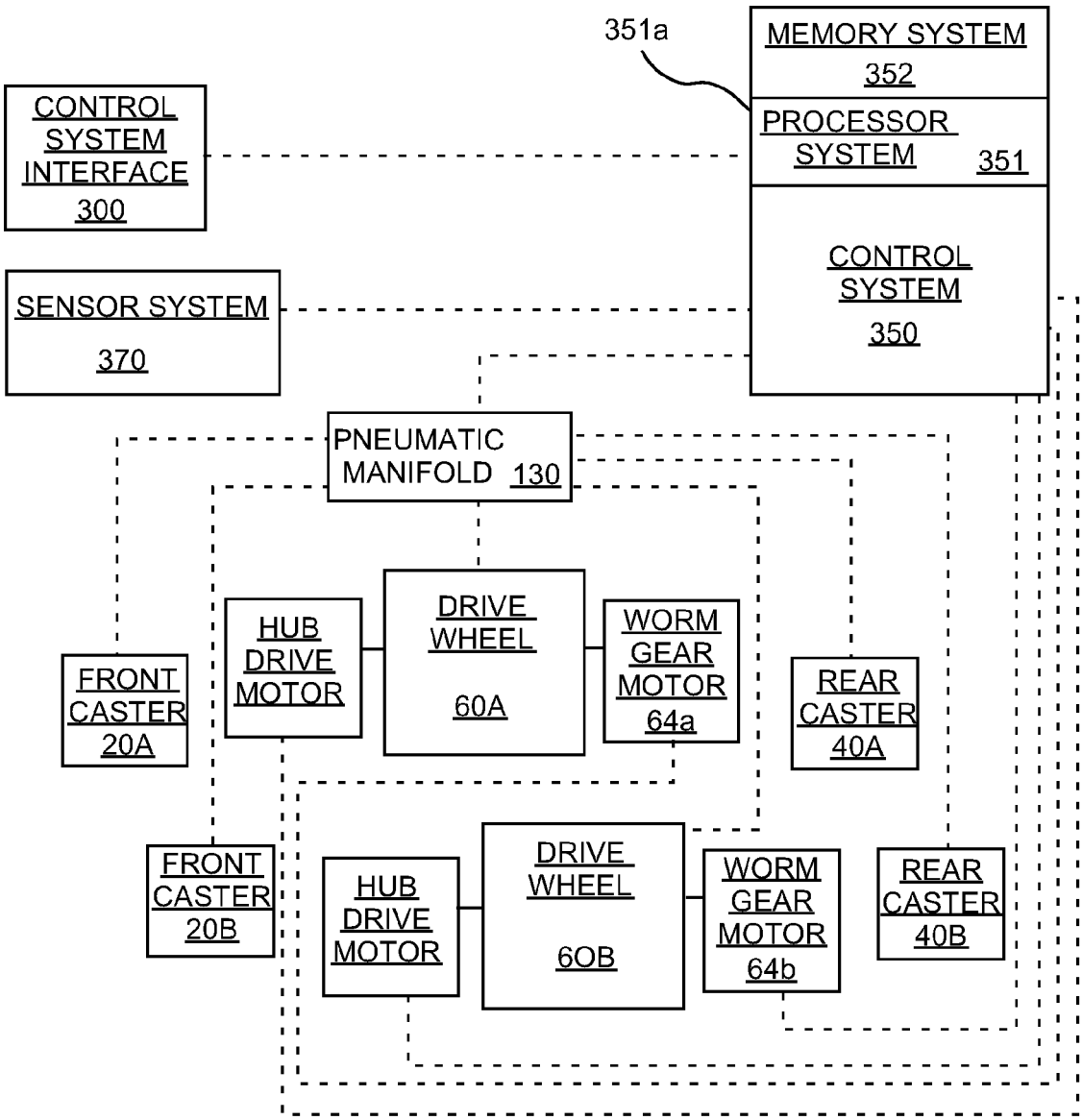
FIG. 1E illustrates schematically an embodiment of a portion of a system of the wheelchair of FIG. 1A including a control system, a sensor system and various actuators thereof.

It will be readily understood that the components of the embodiments, as generally described and illustrated in the figures herein, may be arranged and designed in a wide variety of different configurations in addition to the described representative embodiments. Thus, the following more detailed description of the representative embodiments, as illustrated in the figures, is not intended to limit the scope of the embodiments, as claimed, but is merely illustrative of representative embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "an actuator" includes a plurality of such actuators and equivalents thereof known to those skilled in the art, and so forth, and reference to "the actuator" is a reference to one or more such actuators and equivalents thereof known to those skilled in the art, and so forth. Recitation of ranges of values herein are merely intended to serve as a shorthand method of referring individually to each separate value falling within the range. Unless otherwise indicated herein, and each separate value, as well as intermediate ranges, are incorporated into the specification as if individually recited herein. All methods described herein can be performed in any suitable order unless otherwise indicated herein or otherwise clearly contraindicated by the text.

The terms "electronic circuitry", "circuitry" or "circuit," as used herein include, but are not limited to, hardware, firmware, software or combinations of each to perform a function(s) or an action(s). For example, based on a desired feature or need. a circuit may include a software controlled microprocessor, discrete logic such as an application specific integrated circuit (ASIC), or other programmed logic device. A circuit may also be fully embodied as software. As used herein, "circuit" is considered synonymous with "logic." The term "logic", as used herein includes, but is not limited to, hardware, firmware, software or combinations of each to perform a function(s) or an action(s), or to cause a function or action from another component. For example, based on a desired application or need, logic may include a software controlled microprocessor, discrete logic such as an application specific integrated circuit (ASIC), or other programmed logic device. Logic may also be fully embodied as software.

The term "processor," as used herein includes, but is not limited to, one or more of virtually any number of processor systems or stand-alone processors, such as microprocessors, microcontrollers, central processing units (CPUs), and digital signal processors (DSPs), in any combination. The processor may be associated with various other circuits that support operation of the processor, such as random access memory (RAM), read-only memory (ROM), programmable read-only memory (PROM), erasable programmable read only memory (EPROM), clocks, decoders, memory controllers, or interrupt controllers, etc. These support circuits may be internal or external to the processor or its associated electronic packaging. The support circuits are in operative communication with the processor. The support circuits are not necessarily shown separate from the processor in block diagrams or other drawings.

The term "software," as used herein includes, but is not limited to, one or more computer readable or executable instructions that cause a computer or other electronic device to perform functions, actions, or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, instructions stored in a memory, part of an operating system or other type of executable instructions. It will be appreciated by one of ordinary skill in the art that the form of software is dependent on, for example, requirements of a desired application, the environment it runs on, or the desires of a designer/programmer or the like.

In a number of embodiments, mobility enhanced wheelchairs hereof provide advanced applications or functionalities which increase the user's safety. The applications or functionalities of mobility enhanced wheelchairs hereof may, for example, include self-leveling functionalities to maintain the positioning of the seating system when traveling up or down steep slopes (running slopes) and/or cross slopes, thereby increasing the EPW's stability, traction control to prevent the wheelchair from veering off course when driving on, for example, slippery surfaces, and curb climbing/descending to allow the users to safely ascend or descend curbs or other elevations changes (for example, curbs, steps or elevation changes (including arced or curved elevation changes) of up to 8 inches in height in a representative embodiment). As used herein the "running slope" of a surface or pathway is the slope in the standard direction of travel along the pathway (that is, uphill or downhill). As user herein, "cross slope" is the slope or inclination of a surface or pathway perpendicular to the running slope.

Users of EPWs rely heavily on their mobility devices to transport them to where they need to be as safely and as independently as possible. Unfortunately, there are instances where the users may encounter hazardous terrain such as mud, sand, snow and/or gravel or architectural barriers such as curbs, steep slopes, and cross slopes. Studies conducted by the present inventors indicate that the conditions with the greatest differences in performance between wheelchair types were mud, gravel, and cross slopes. For mud, approximately 70% of middle wheel drive (MWD) wheelchair users and rear wheel drive (RWD) wheelchair users avoided it, while only 33% of front wheel drive (FWD) users did so. It is possible that the design of a FWD wheelchairs when compared to MWD and RWD wheelchairs accounts for the difference among wheelchairs users. In the case of and FWD wheelchair, the large drive wheels are in the front, which reduces or eliminates the possibility of the front casters digging into the mud. The same observation can be made in the case of gravel. However, the difference between avoiding gravel for MWD and RWD users was found to be much greater. In that regard, 54% of RWD wheelchair users avoided it, compared to MWD wheelchair users at 31% and FWD wheelchair users at 17%. The differences between the different types of wheelchairs may, for example, arise because of the difference in weight distribution between the RWD and MWD wheelchairs. The weight of RWD wheelchair is typically more forward, which may cause the casters to dig into the gravel. In the case of MWD wheelchair, however, the weight is more centered. In the case of cross slopes, RWD users were least likely to avoid them (31%) compared to FWD users (50%) and MWD users (62%). This result may arise because MWD users are more challenged when driving outdoors, because MWD wheelchairs are designed primarily for indoor use.

More than 50% of the wheelchairs users participated in one study hereof indicated the following conditions were difficult: uneven terrain, gravel, driving up steep hills, mud, and wet grass. Additionally, driving conditions that 50% of the participants avoided included mud, soft sand, ice, driving with one wheel off of the ground, rain, and cross slopes.

A representative mobility enhancement robotic wheelchair 10 (sometimes referred to as Mobility Enhancement Robotic or MEBot) hereof was designed based on feedback from wheelchair users as, for example, discussed above. Several advanced applications or functionalities, which improve, for example, outdoor mobility performance of an wheelchair 10, include selectable drive wheel location, self-leveling, curb climbing, and traction control. In addition to improving mobility performance, a number of functionalities of wheelchair 10 also increase stability to minimize the likelihood of tipping and/or falling out of the wheelchair resulting in serious injury or death.

Wheelchair 10 includes six wheels in the embodiment illustrated in, for example, FIGS. 1A through 2D. In that regard, wheelchair 10 includes two front caster wheels or castors 20*a* and 20*b*, two rear caster wheels or castors 40*a* and 40*b*, and two drive wheels 60*a* and 60*b*. Drive wheels 60*a*, 60*b* are located between front caster wheels 20*a*, 20*b* and rear caster wheels 40*a*, 40*b*. Each one of front caster wheels 20*a*, 20*b*, rear caster wheels 40*a*, 40*b* and drive wheels 60*a*, 60*b* is independently controllable by an associated actuator system therefor. The actuator systems may, for example, be electric, electro-mechanical, pneumatic, hydraulic, etc., as known in the actuating arts. As used herein, the terms "actuators", "actuator systems" and the like refer to a component or element operable to move and/or control the motion of a mechanism or system. The actuator systems are operable to lift or lower the wheels to, for example, increase or decrease the base height or to level wheelchair 10 in the fore/aft and lateral directions. Further, as the vertical position of each wheel or caster may be controlled independently, the wheels/casters can follow the terrain while controlling a seat orientation/position of wheelchair 10. For example, the seat orientation/position can be maintained fixed or substantially fixed in space while wheelchair 10 traverses uneven terrain. As used herein, the term "vertical position" refers to a position relative to or in the direction of a vertical axis V of the wheelchair 10 as illustrated in FIG. 2C. The term "height", when used in reference to wheelchair 10, refers to a position in the direction of vertical axis V. The horizontal or longitudinal position of powered drive wheels 60*a*, 60*b* may also be controlled independently to, for example, help negotiate obstacles, track terrain, and implement a crawling function (that is, using vertical and horizontal powered wheel position to pull chair along). The terms "horizontal position" or "longitudinal position" refer to a position relative to or in the direction of a longitudinal axis L of wheelchair 10 as illustrated in FIG. 2C. The terms "forward" and "rearward" refer to directions in the direction of longitudinal axis I, wherein forward and like terms refer to a direction toward the front of wheelchair 10 as defined by the orientation of a user seated in wheelchair 10.

In the illustrated embodiment, front caster wheels 20*a*, 20*b*, rear caster wheels 40*a*, 40*b* and drive wheels 60*a*, 60*b* are in operative connection with a base or main frame component, frame or base 100. Front caster wheels will are pivotably attached to main frame component 100 via pivot arms 23*a* and 23*b*, respectively. Rear caster wheels are pivotably attached to main frame component 100 via pivot arms 43*a* and 43*b*, respectively. Drive wheels 60*a* and 60*b* are attached to frame via pivot arms 63*a* and 63*b*, respectively (see, for example, FIGS. 1A and 1B). A seat assembly 200, which includes a backrest 210, a seat 220, armrests 230 and leg rests 240 is attached to a top of main frame component 100. A control system interface 300 including, for example, a joystick 310 and/or various other controls (for example, buttons etc.) is attached to one of arm rests 240. Control system interface 300 is in operative connection with a control system 350 (see, for example, FIG. 1E), which may, for example, include a processor system 351 including one or more computers/processors such as microcontrollers in operative connection with a memory system 352. An attachment or connector system 520 (see, for example, FIG. 1A) for an oxygen system 500 may, for example, be provided on a rearward side of backrest 210 of seat assembly 200.

Figure 1F:
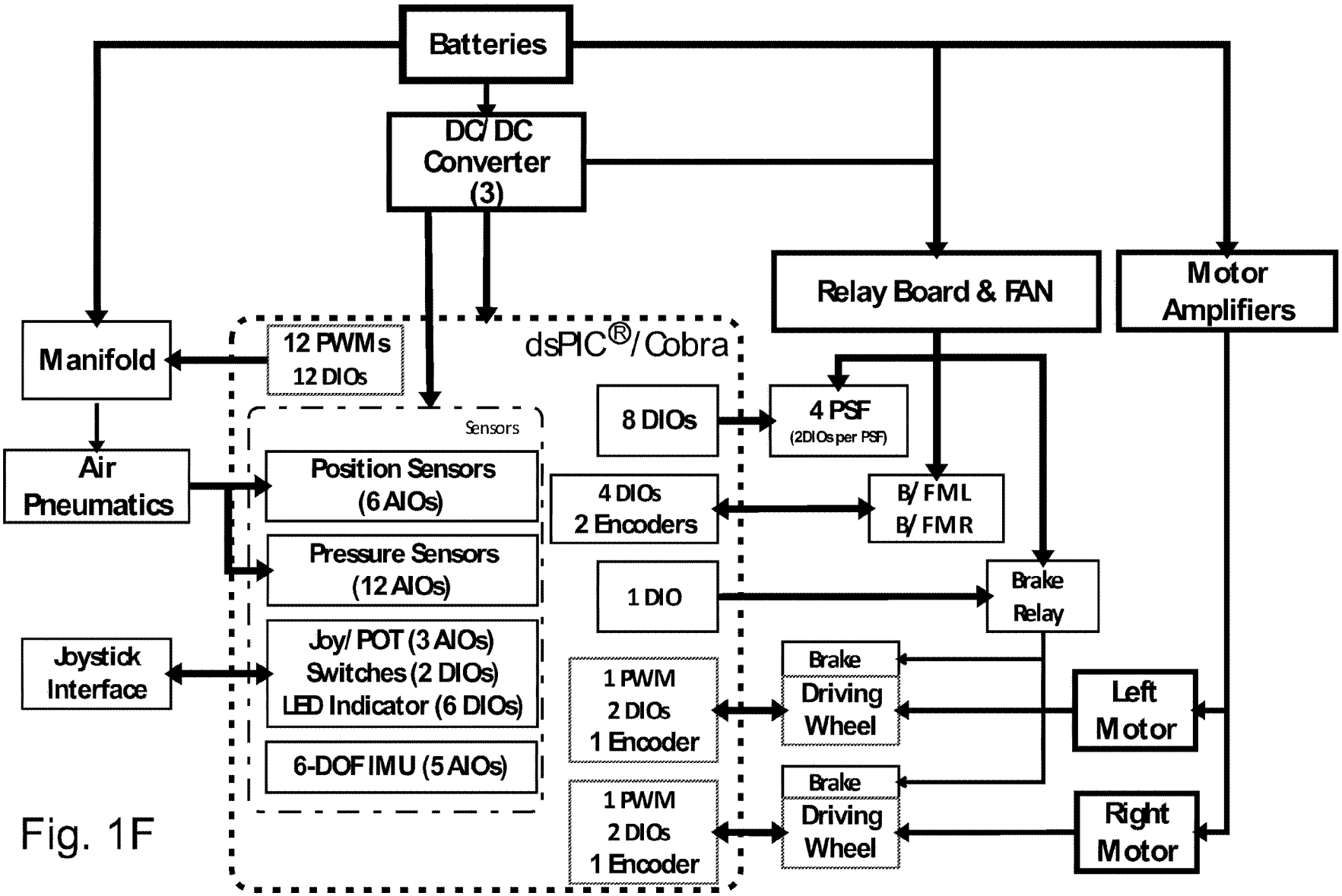
FIG. 1F illustrates schematically an embodiment an electronics system of the wheelchair of FIG. 1A.

FIG. 1F illustrated a schematic diagram of an embodiment of electronics for wheelchair 10. In FIG. 1F, DIO represents digital input/output, AIO represents analog input/output, POT represents potentiometer, 6-DOF IMU represents a six-degree-of-freedom inertial measurement unit, PWM represents pulse width modulation, PSF represents powered seating functions, B/FML represents back/forth middle left wheel, and B/FMR represents back/forth middle right wheel. In FIG. 1F, dsPIC® refers to a digital signal controller available from Microchip Technology Inc. of Chandler, Ariz. EXB/Cobra represents an embedded board computer available from VersaLogic Cooperation of Tualatin, Oreg.

Figure 7:
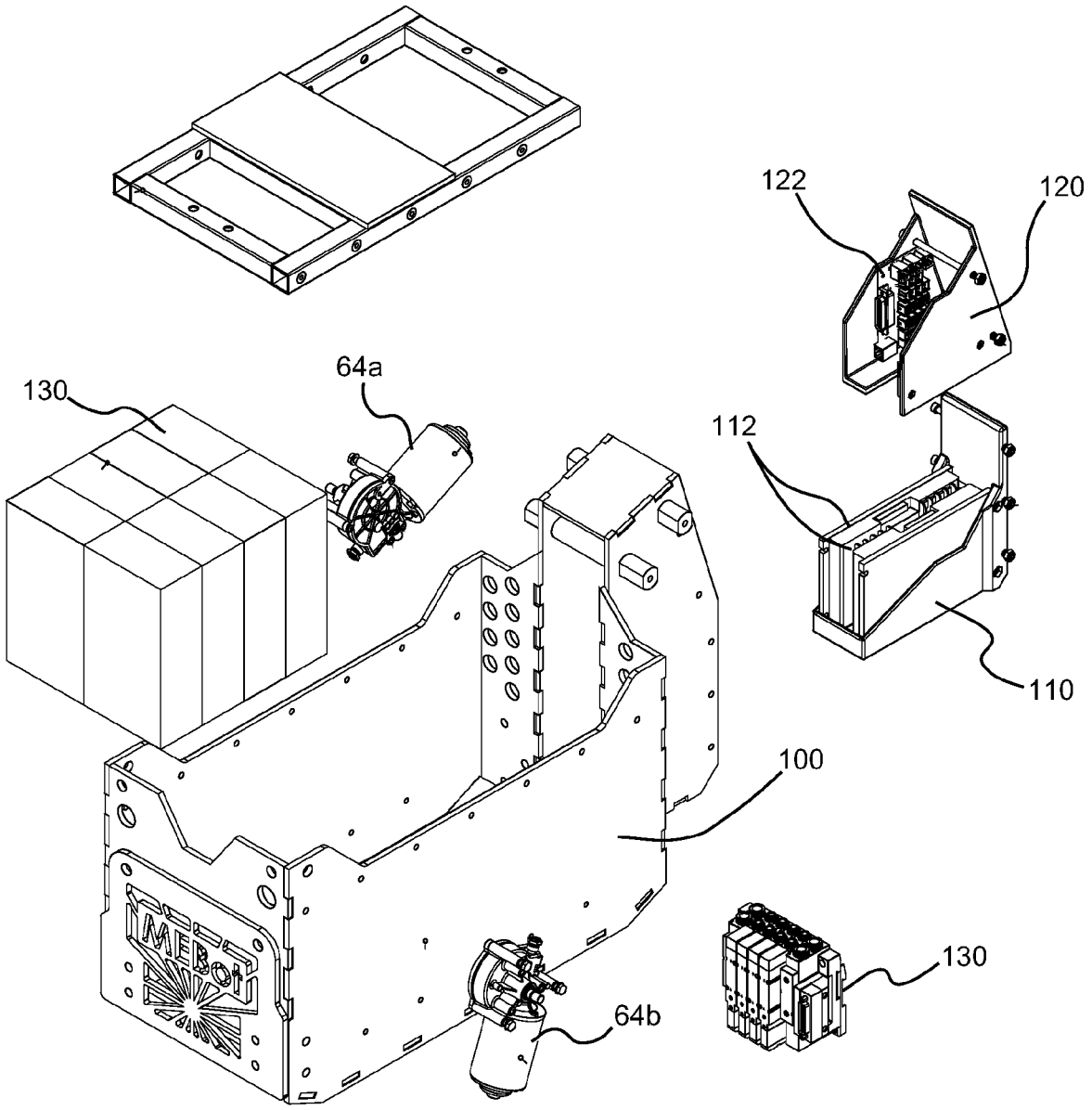
FIG. 7 illustrates an exploded or disassembled view of the main frame component of the wheelchair of FIG. 1A.

FIG. 7 illustrates a number of elements of the control system 350 and compartments therefor. In the illustrated embodiment, a first rear electronics box or compartment 110, which attaches to frame component 100 contains servo drivers 112 (for example, available from A-M-C or Advance Motion Controls of Camarillo, Calif.), which are used to control the voltage provided to hub motors 61*a*, 61*b* (see, for example, FIG. 1D) of drive wheels 60*a* and 60*b* using, for example, a pulse-width-modulation or PWM signal. A standard motor or motors with a right angle drive train can also be used to power drive wheels 60*a* and 60*b*. A second rear electronics box or compartment 120, which attached to frame component 100, includes a power line distribution system and a sensor interface board 122 for communication between processor system 351 of control system 350 and the sensors of sensor system 370. In a number of embodiments, sensors of sensor system 370 included four position sensors and four pressure sensors for the air pneumatics, two position sensors for front casters, four encoders (two to measure each speed of each drive wheels 60*a*, 60*b* and two to measure the horizontal position of each drive wheel 60*a*, 60*b*), three extra Analog signals, and an interface between processor system 351 and servo drivers 112. The power line distribution system supplies power from batteries of battery pack 130 to drivers 112, electronic systems and relay board box. In addition to rear electronics boxes 110 and 120, the electronics system further include a computer box 351*a* (illustrated schematically in FIG. 1E), a relay board box (not shown), a pneumatic manifold 130 and control system interface system 300 including, for example, a joystick interface 310 and a graphical interface 320. In a number of embodiments, computer box 351*a* included a programmable microcontroller (for example, a DsPIC® digital signal controller as described above) that control the rest of the electronics boxes and the applications/functionalities of wheelchair 10. Control system interface/joystick interface 300 provides an input signal to computer box 351*a* to control the speed and acceleration of drive wheels 60*a*, 60*b* using drivers 112, to regulate the vertical motion of the pneumatics associated with rear caster wheels 40*a*, 40*b* and drive wheels 60*a*, 60*b* through pneumatic manifold 130, to control the elevation of front caster wheels 20*a* and 20*b*, to control movement of seating functions (for example, to control the anterior/posterior angle of tilt of seat 220 (with respect to the orientation of the gravitational force), the lateral angle of tilt of seat 220 and/or the angle of recline of backrest 210, and the position of leg rests 240 via one or more actuators of an actuator system 260 illustrated schematically in FIG. 1A), to control wheel brake and to control horizontal motion of drive wheels 60*a* and 60*b* through the relay board box. Additionally, computer box 351*a* receives feedback signal from sensor interface board 122 to, for example, compensate for any signal error. Seating functions and the adjustment thereof for patient wellbeing are, for example, discussed in United States Patent Application Publication No. 2015/0209207, the disclosure of which is incorporated herein by reference.

Graphical user interface 320 may, for example, be used to display and to change modes or functionalities (for example, curb climbing, terrain following, orientation control, traction control, crawling mode, driving mode, seat-functions, stair climbing, etc.). User specific parameter setting such as maximum speeds, maximum accelerations, position ranges, angle ranges, may be set. Application software, which may be stored in memory system 352 and executed by processor system 351, may, for example, include real-time control for: orientation control, curbs, traction control, ground reaction force optimization, weight shifting, obstacle detection/negotiation, stairs, seat-functions, standard driving, etc. In a number of embodiments, coordination software stored in memory system 325 and executable by processor system 351 includes real-time control to de-conflict applications, set priorities, and to manage multiple time-scale control, for example, driving while negotiating obstacles or driving while maintaining orientation. Basic systems status control includes, for example, recording status of sensors, amplifiers, motors, pneumatics, and other fundamental systems. Safety mode control includes, for example, response to degradation in performance or compromise to safety as a result of loss of sensors, actuators or other basic control elements. Interfaces may, for example, be provided for smartphones, tablets, internet connectivity etc. for data recording, updating software, maintaining user settings etc.

Figure 1G:
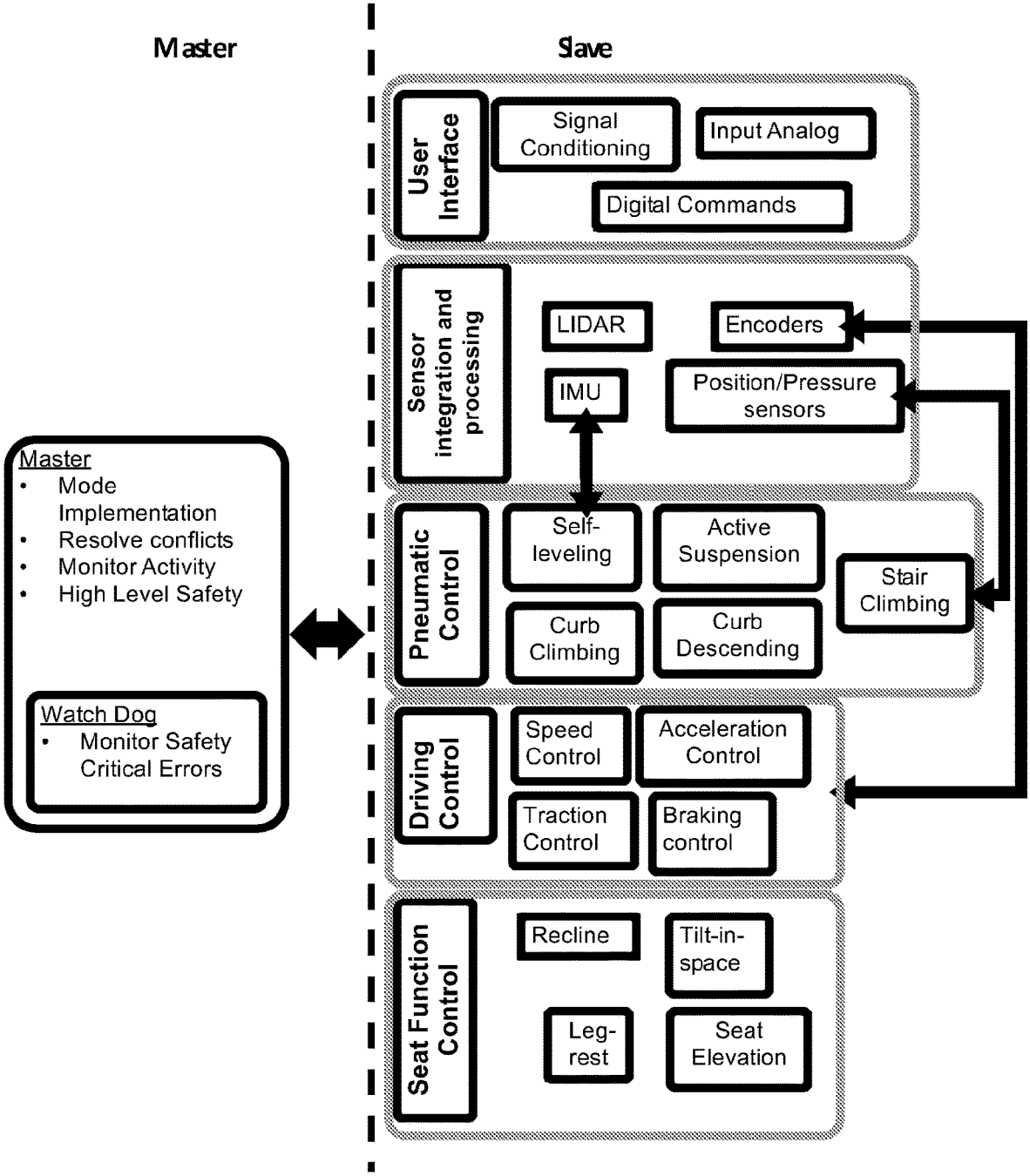
FIG. 1G illustrates a schematic, high-level representation of an embodiment of a control methodology which incorporates a master-slave approach to different threads and applications.

FIG. 1G illustrates a schematic, high-level representation of an embodiment of a control methodology which incorporates a master-slave approach to different threads and applications. In the embodiment of FIG. 1G, the master monitors each application to check for any faults or errors to ensure internal and external safety of wheelchair 100. The control methodology of FIG. 1G may, for example, be implemented by control system interface 300 of FIG. 1E.

Figure 3:
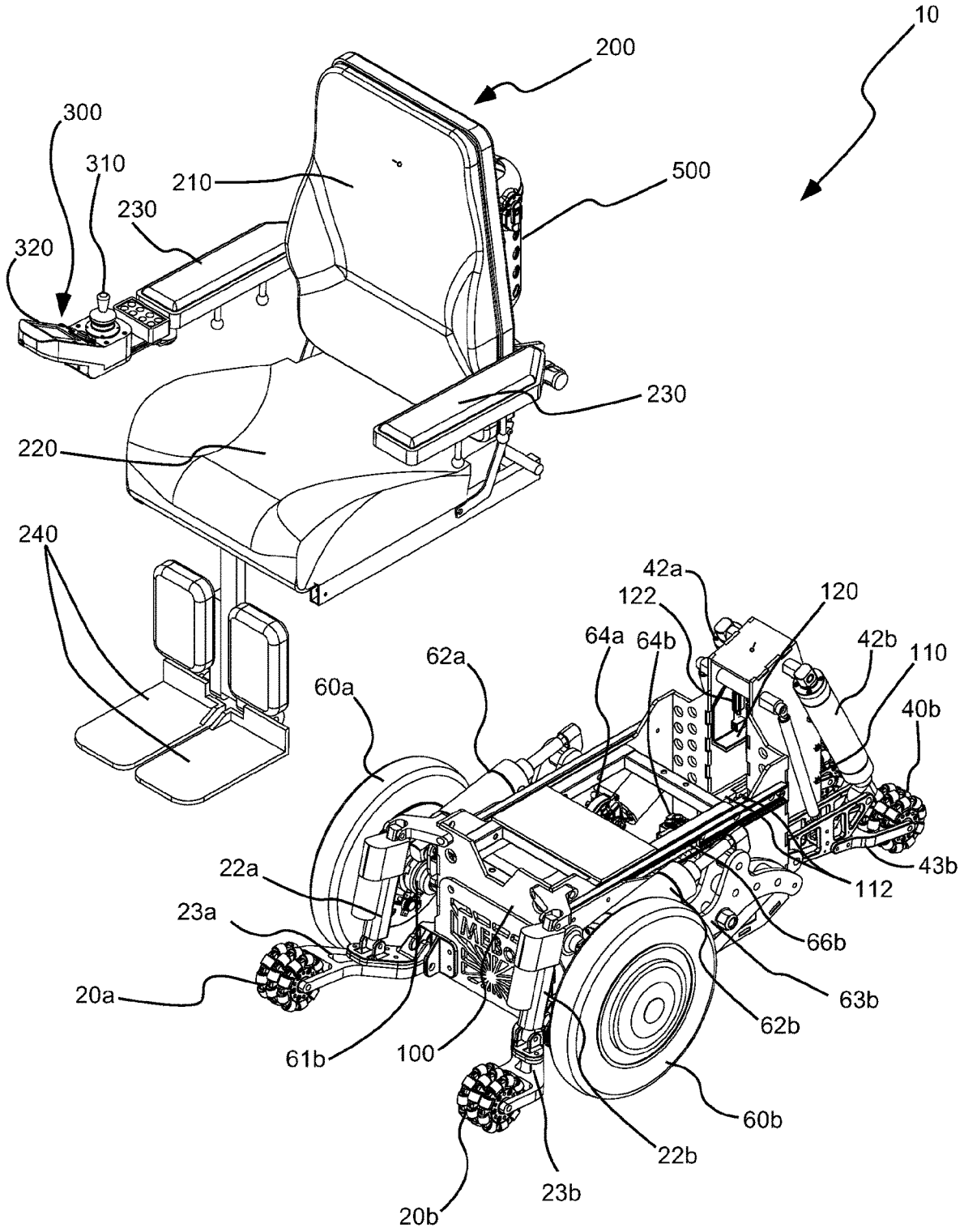
FIG. 3 illustrates an exploded or disassembled perspective view of the wheelchair of FIG. 1A wherein the seat or seat system is disassembled from a frame assembly of the wheelchair.
Figure 4:
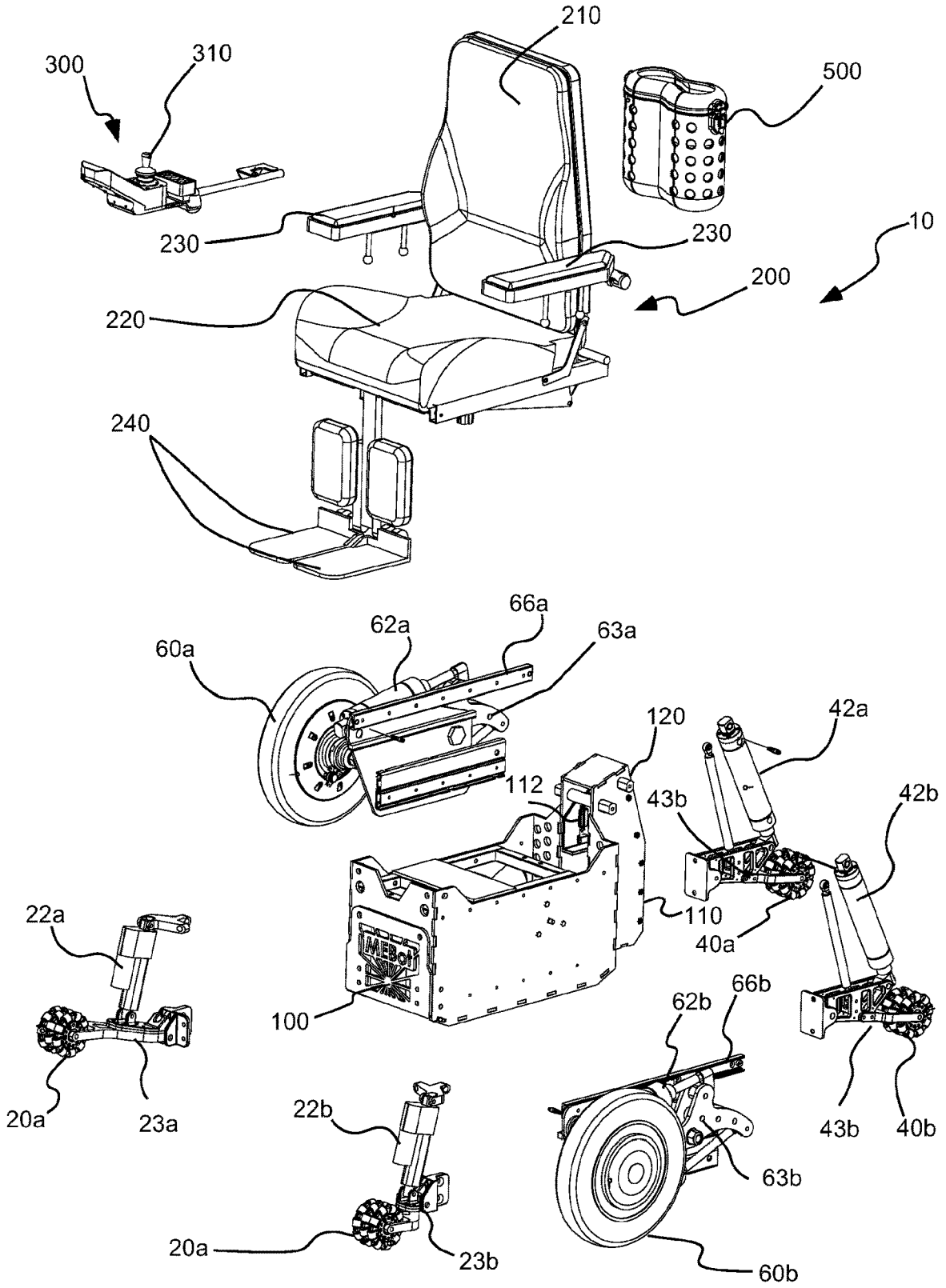
FIG. 4 illustrates another exploded or disassembled perspective view of the wheelchair of FIG. 1A.
Figure 5:
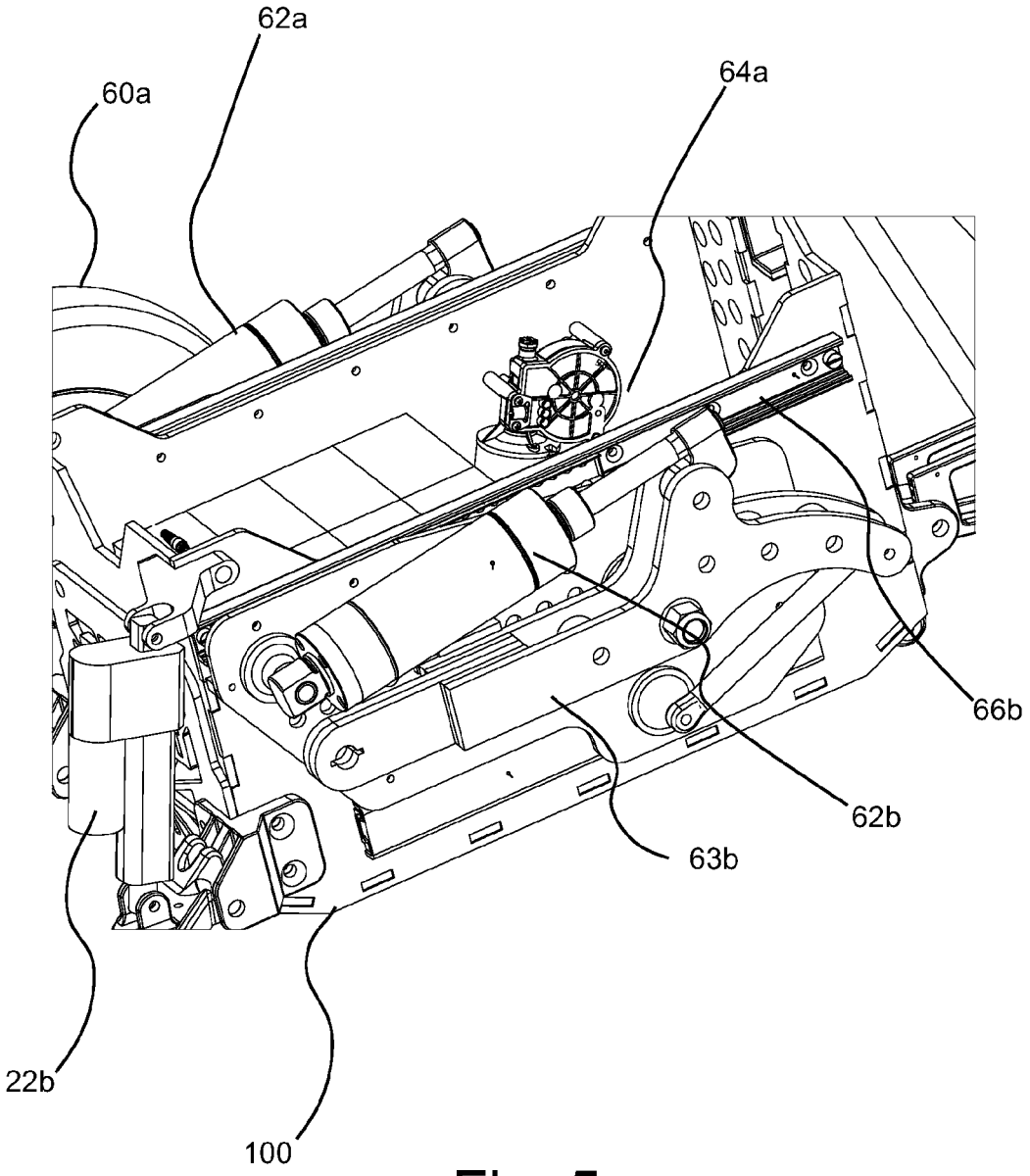
FIG. 5 illustrates an expanded perspective view of a portion of the frame assembly of the wheelchair of FIG. 1A.
Figure 6A:
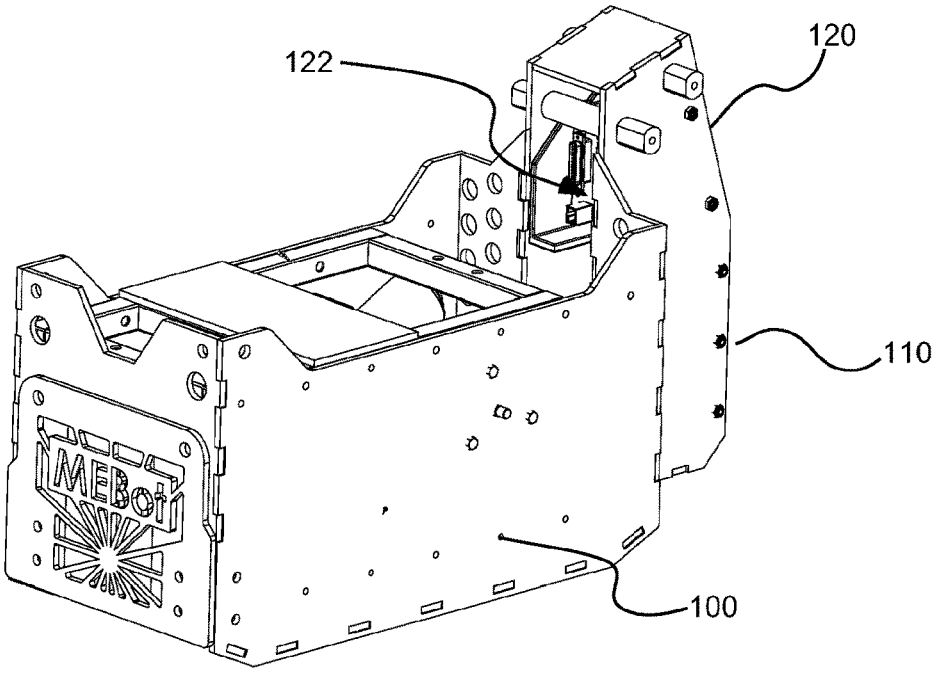
FIG. 6A illustrates a front perspective view of a main frame component of the wheelchair of FIG. 1A.
Figure 6B:
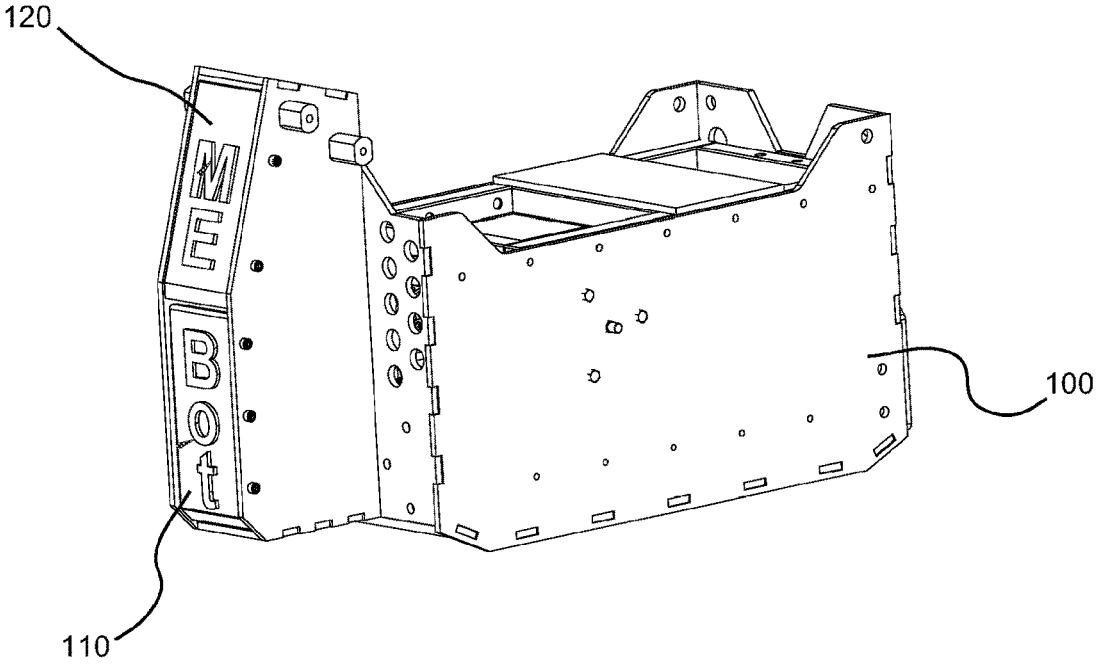
FIG. 6B illustrates a rear perspective view of a main frame component of the wheelchair of FIG. 1A.
Figure 8A:
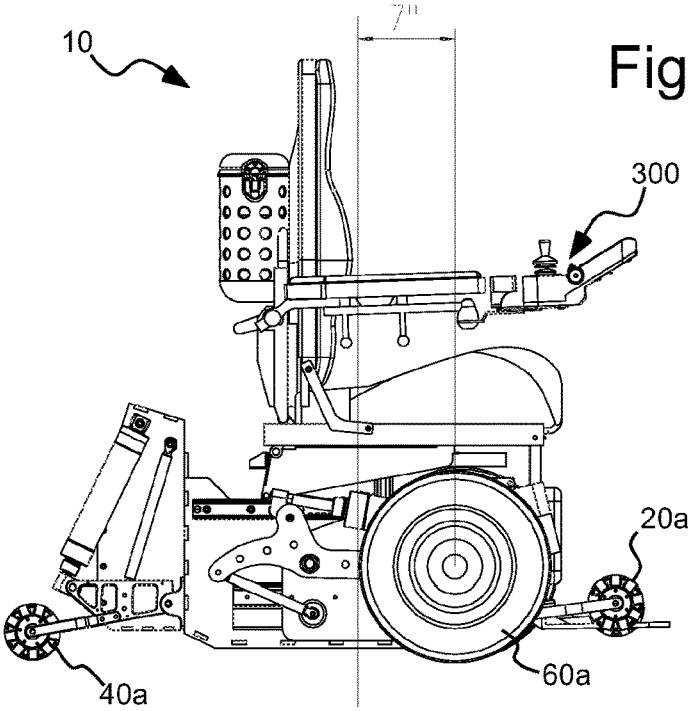
FIG. 8A illustrates a side view of the wheelchair of FIG. 1A with the drive wheels in a first or front wheel drive position.
Figure 8B:
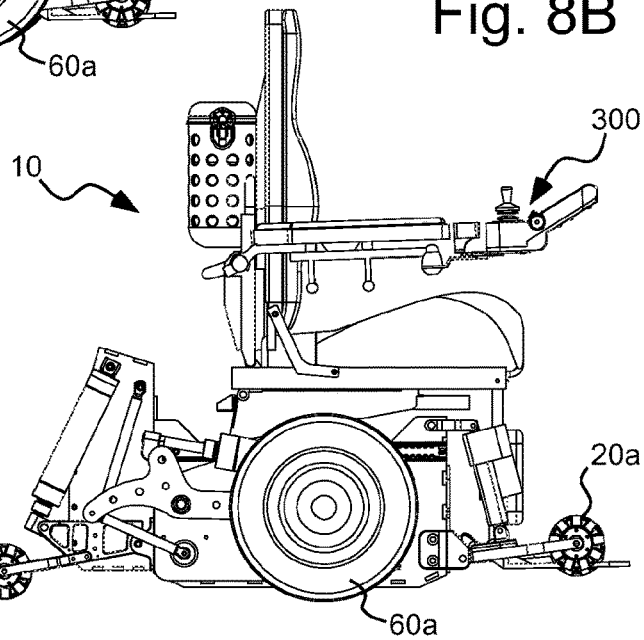
FIG. 8B illustrates a side view of the wheelchair of FIG. 1A with the drive wheels in a second or mid wheel drive position.
Figure 8C:
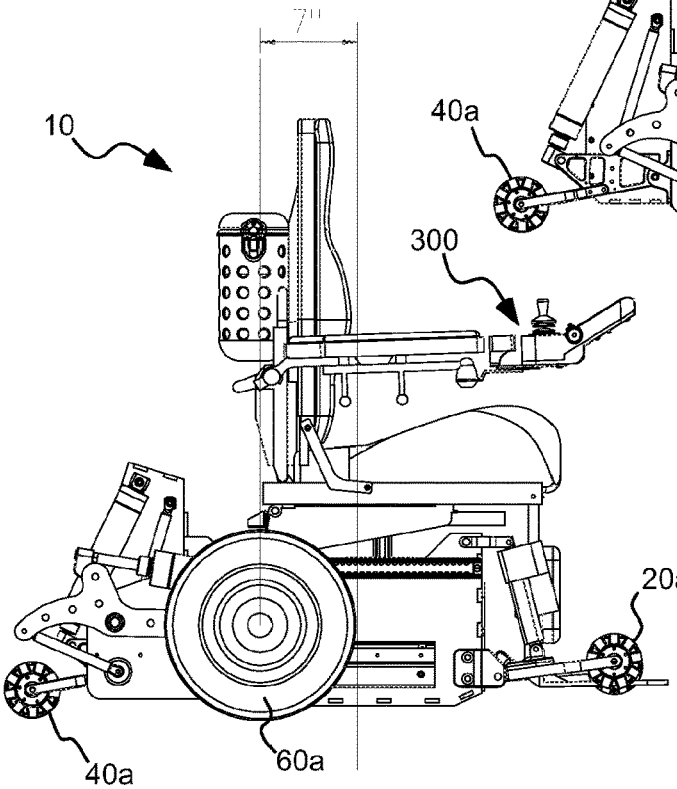
FIG. 8C illustrates a side view of the wheelchair of FIG. 1A with the drive wheels in a third or rear wheel drive position.

In a number of embodiments, the drive wheel position of wheelchair 10 is selectable by the user to configure wheelchair 10 as a FWD, a MWD, or a RWD EPW (see FIGS. 8A, 8B and 8C, respectively). The different configurations affect the maneuverability of wheelchair 10 and driving dynamics. Additionally, the drive wheel positions may also affects the stability of wheelchair 10 and ease of operation with respect to the center of gravity of wheelchair 10. In the illustrated representative embodiment, drive wheels 20*a* and 20*b* may, for example, be positioned 7 inches forward and backward from the mid-wheel position, which is illustrated in FIG. 8B. As clear to one skilled in the art, the range of motion of drive wheels 60*a*, 60*b* can be less than or greater than 7 inches via ready modifications based upon engineering principles. The drive wheel position may be selected by the user via control system interface 300 based on the user's preference and/or the type of terrain/obstacle the user is driving over. In the illustrated representative embodiment, drive wheels 60*a* and 60*b* are thus able to move a total of 14 inches from configured as a front wheel drive EPW to configuration as a rear wheel drive EPW. In the illustrated embodiment, horizontal or longitudinal movement of drive wheels 60*a* and 60*b* is provided with the use of worm gear motors 64*a* and 64*b* that drives a rack and pinion setup. Rack 66*b* is, for example, illustrated in FIGS. 3 and 5. Drive wheels 60*a* and 60*b* are guided along a set of linear bearing rails. Linear bearing rails 68*b* and 69*b* are illustrated in, for example, FIG. 5. The worm gear motor and rack and pinion setups on each side of wheelchair 10 is identical in the illustrated embodiment. In a number of embodiments, each of drive wheel 60*a* and 60*b* can move forward or backward independently.

In general, the MWD position typically has the highest maneuverability as a result of drive wheels 60*a* and 60*b* being placed in the center of wheelchair 10. Such central placement of drive wheels 60*a* and 60*b* allows for turning 360 degrees within the wheelchair's own wheelbase. However, if either of front casters 20*a* or 20*b* or either of rear casters 40*a* or 40*b* experiences a sideways force, wheelchair 10 could veer off course. The second most maneuverable configuration is the FWD configuration. In the FWD configuration, wheelchair 10 may perform better when climbing obstacles or going over rough terrain since the larger diameter drive wheels 60*a* and 60*b* are the first to contact the obstacle. However, drive wheels 60*a* and 60*b* are difficult to maneuver when driving over uneven terrain or at higher speeds since their center of gravity is towards the rear of the chair. The RWD configuration tends to be the most stable at higher speeds and simplest to control, but may lack the maneuverability of the MWD or the FWD configuration.

Each configuration thus may provide improved traction and maneuverability under particular circumstances. Furthermore, if wheelchair 10 loses traction to both of drive wheels 60*a* and 60*b* when driving in sand or gravel, an inchworm (crawling) movement can allow the wheelchair to crawl forward or backward until traction of drive wheels 60*a* and 60*b* can be regained. Such an inchworm or crawling motion can be effected because the position of each of drive wheel 60*a* and 60*b* is independently adjustable in both the vertical and horizontal/longitudinal directions. This operational mode allows wheelchair 10 to lift and longitudinally move drive wheels 60*a* and 60*b* to overcome an obstacle (for example, rock in the path). Crawling provides, for example, maximum traction when wheelchair 10 becomes stuck on a slippery (for example, icy, muddy) or unstable surface (for example, sand) where drive wheels 60*a*, 60*b* spin or lose grip. In a number of embodiments, crawling uses vertical movement of all wheels, and horizontal movement of drive wheels 60*a*, 60*b*.

Figure 2A:
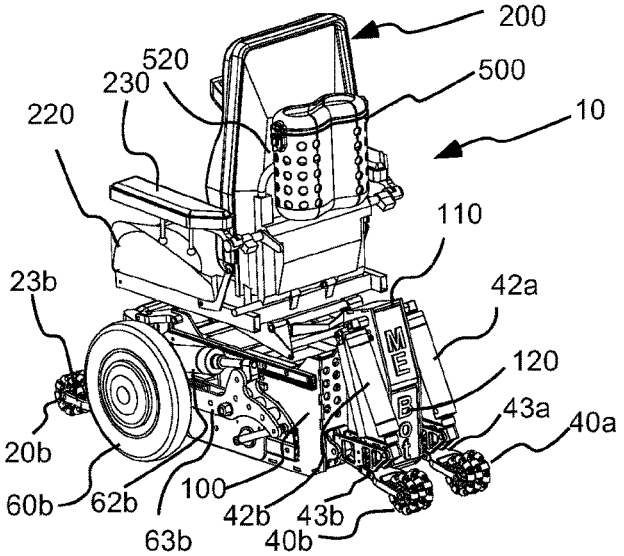
FIG. 2A illustrates a rear perspective view of the wheelchair of FIG. 1A.
Figure 2B:
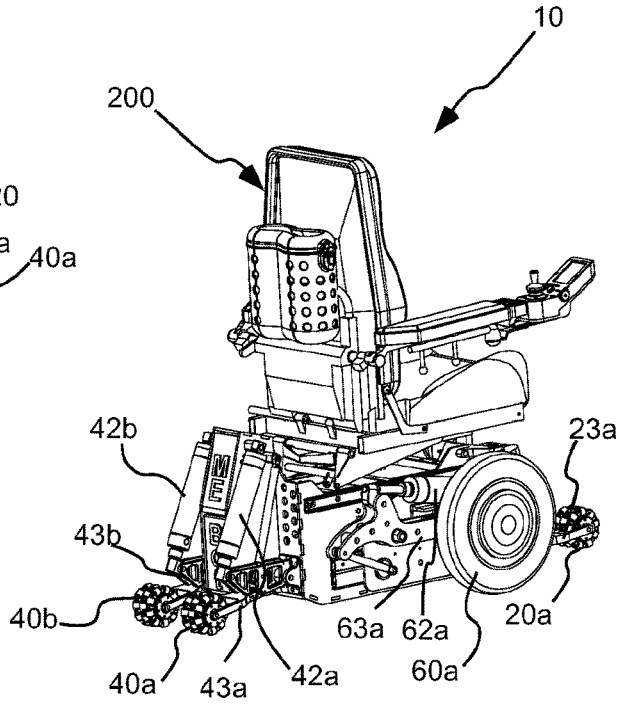
FIG. 2B illustrates another rear perspective view of the wheelchair of FIG. 1A.
Figure 2C:
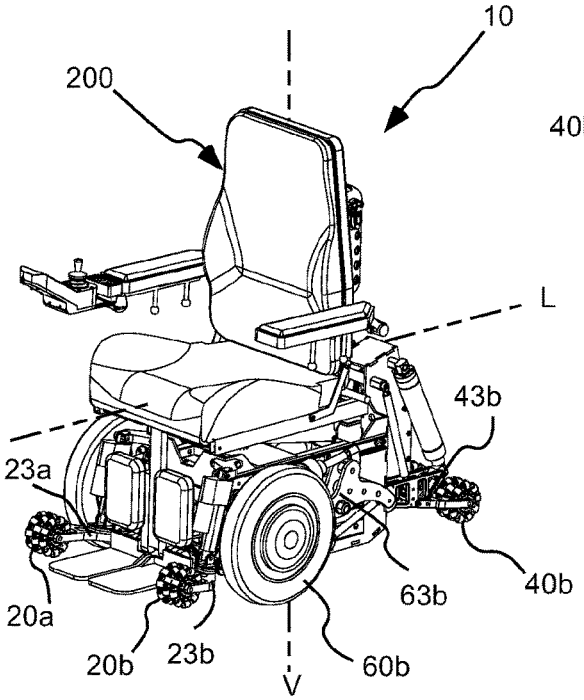
FIG. 2C illustrates a front perspective view of the wheelchair of FIG. 1A.
Figure 2D:
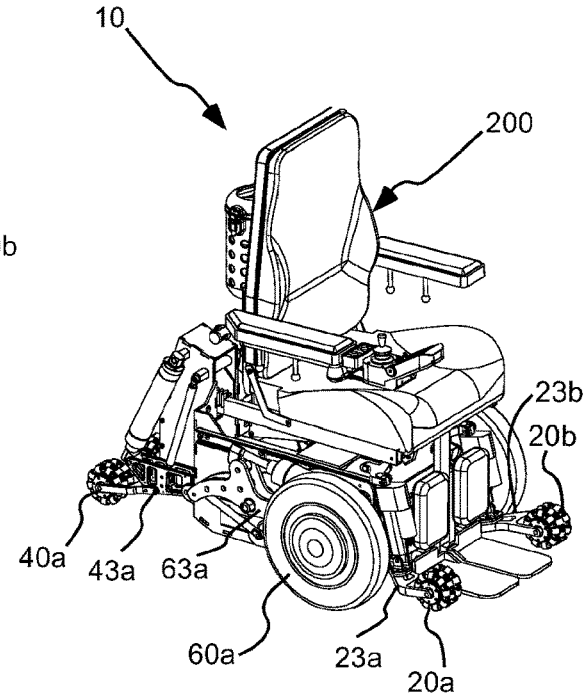
FIG. 2D illustrates another front perspective view of the wheelchair of FIG. 1A.
Figure 2E:
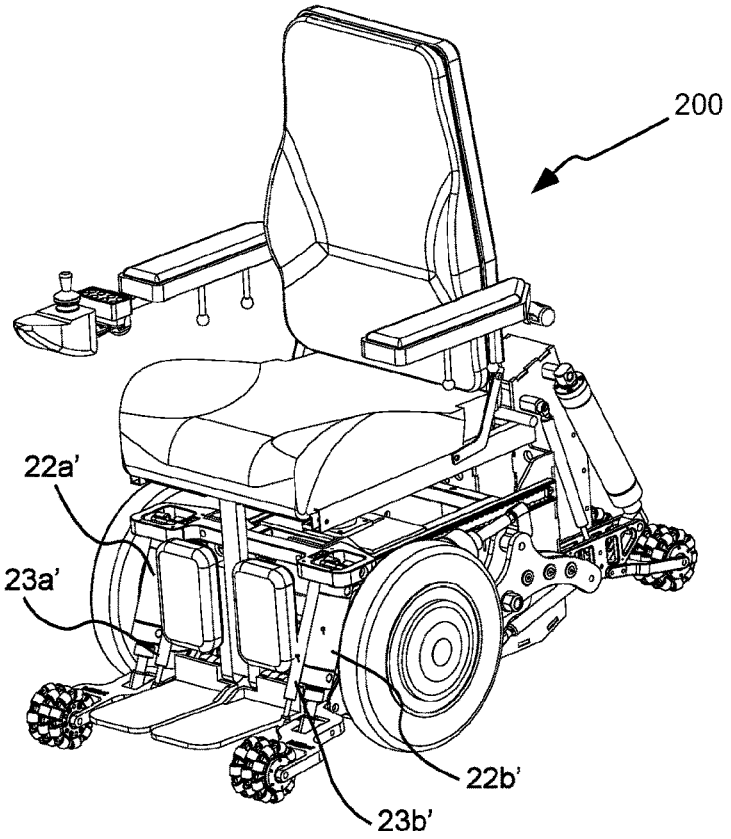
FIG. 2E illustrates another front perspective view of the wheelchair of FIG. 1A wherein the actuators of the front castor wheels include a pneumatic actuator and a spring.
Figure 2F:
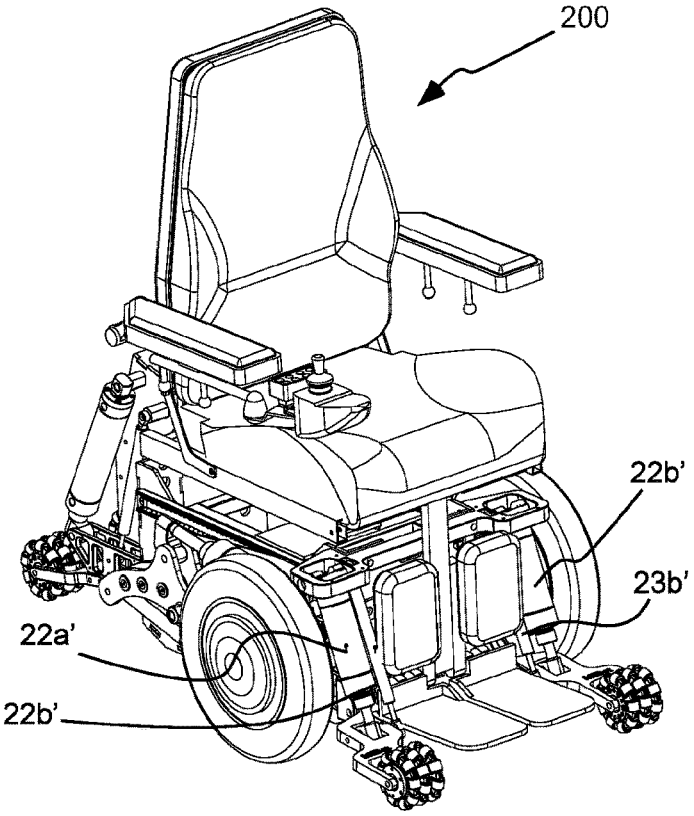
FIG. 2F illustrates another front perspective view of the wheelchair of FIG. 1A wherein the actuators of the front castor wheels include a pneumatic actuator and a spring.
Figure 8D:
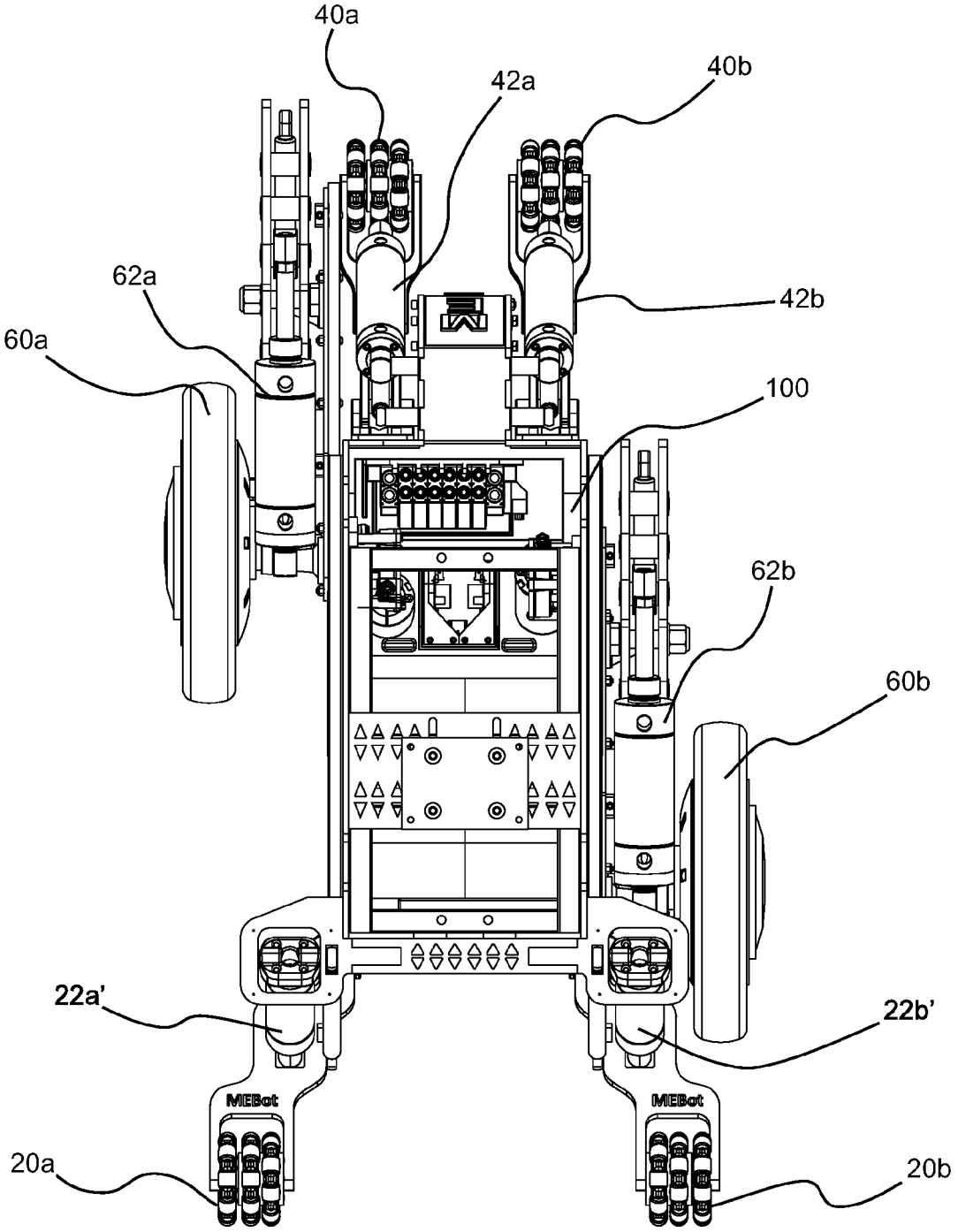
FIG. 8D illustrates a top view of the wheelchair of FIG. 1A with the left drive wheel in the forwardmost position and the right drive wheel in the rearwardmost position.
Figure 8E:
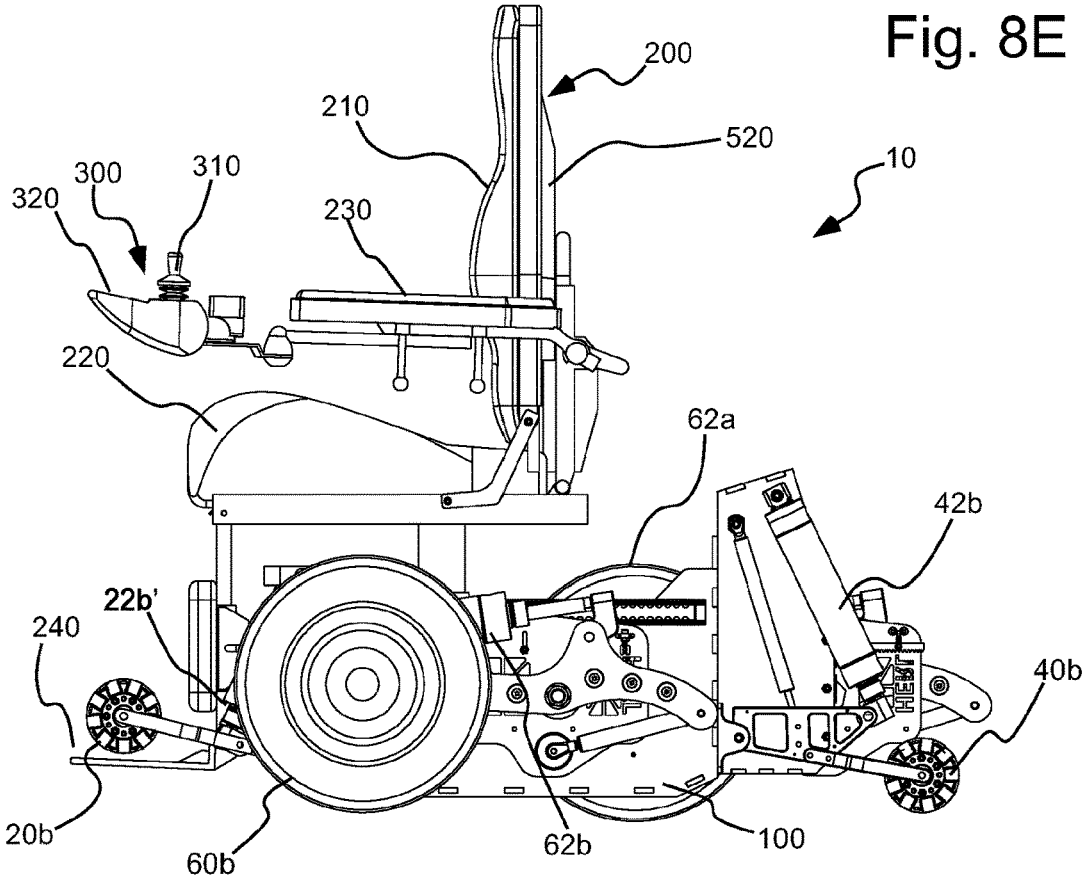
FIG. 8E illustrates a left side view of the wheelchair of FIG. 1A with the left drive wheel in the forwardmost position and the right drive wheel in the rearwardmost position.
Figure 8F:
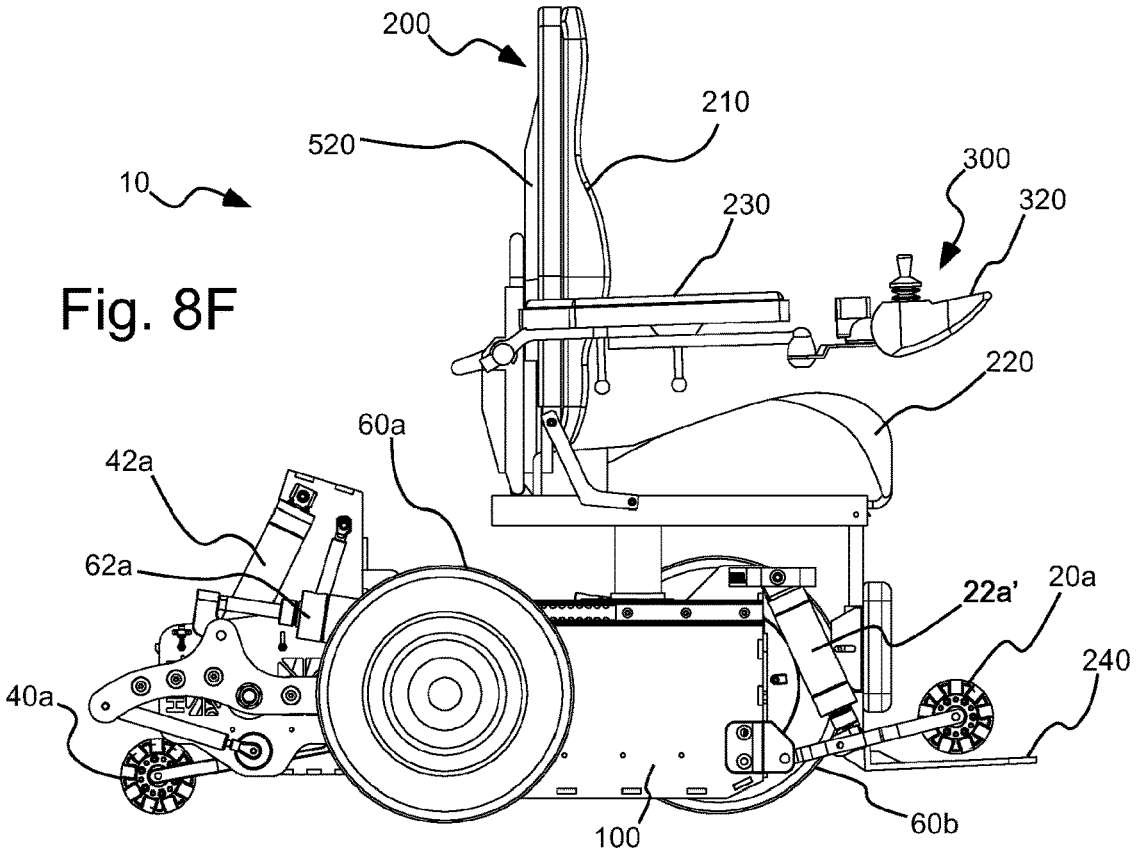
FIG. 8F illustrates a left side view of the wheelchair of FIG. 1A with the left drive wheel in the forwardmost position and the right drive wheel in the rearwardmost position.
Figure 9:
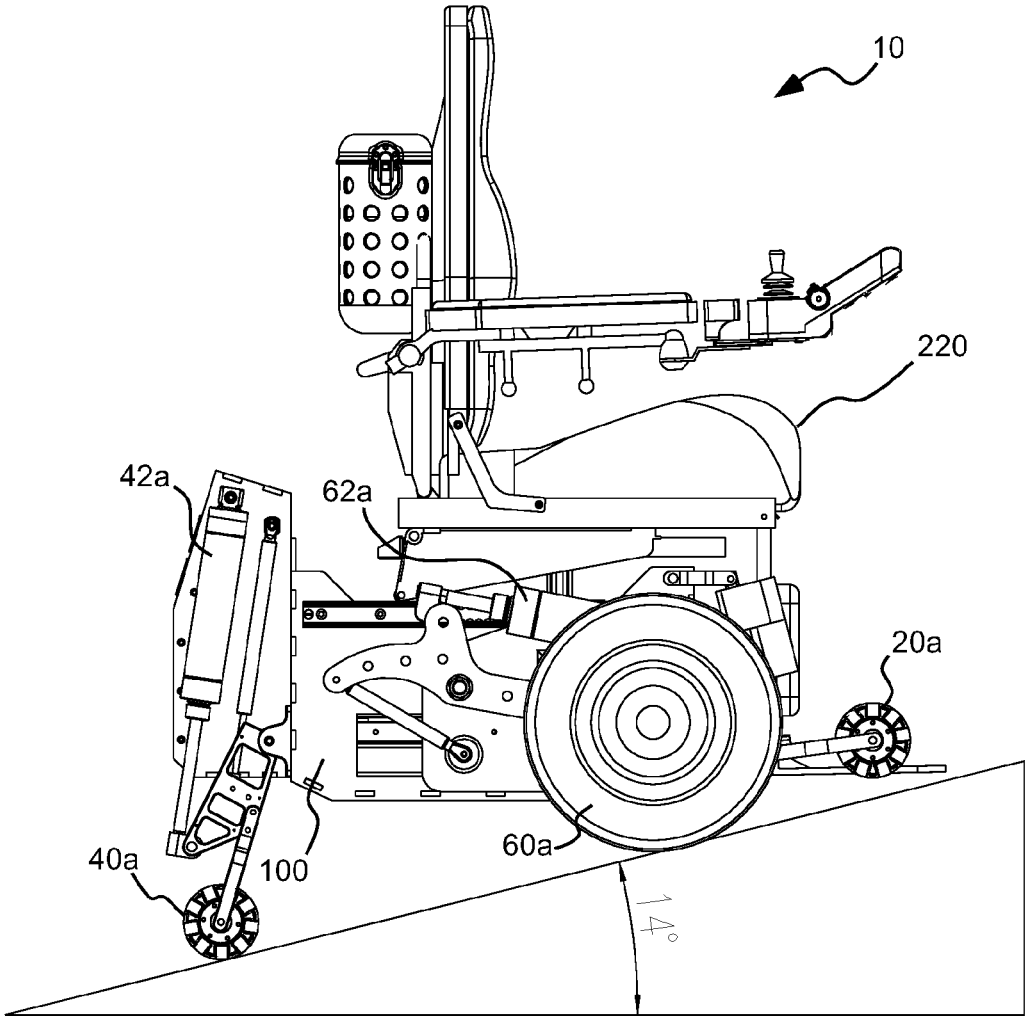
FIG. 9 illustrates the wheelchair of FIG. 1A on an upward inclining running slope and adjustments made to the vertical position of the wheels to maintain the orientation of the seat in a desirable range.
Figure 10:
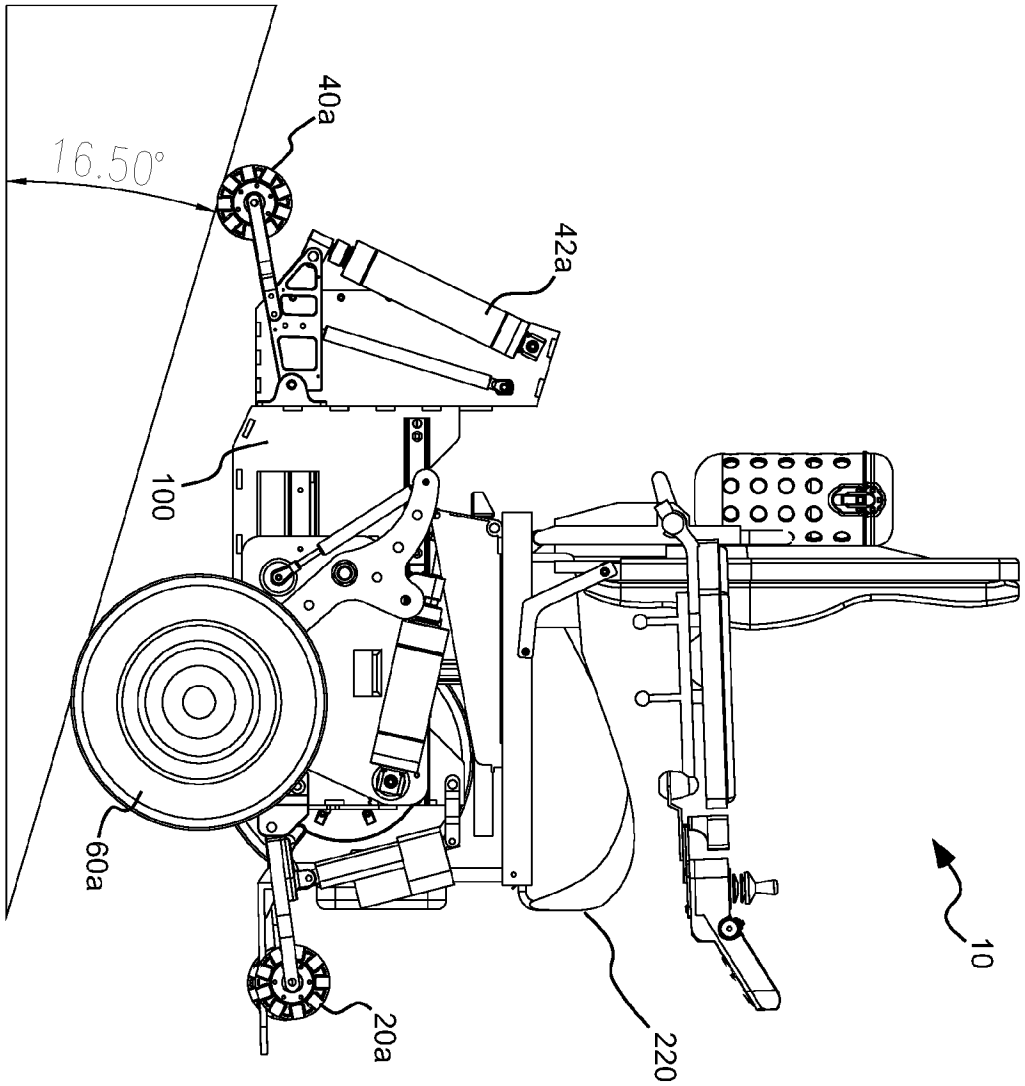
FIG. 10 illustrates the wheelchair of FIG. 1A on a downward inclining running slope and adjustments made to the vertical position of the wheels to maintain the orientation of the seat in a desirable range.
Figure 11:
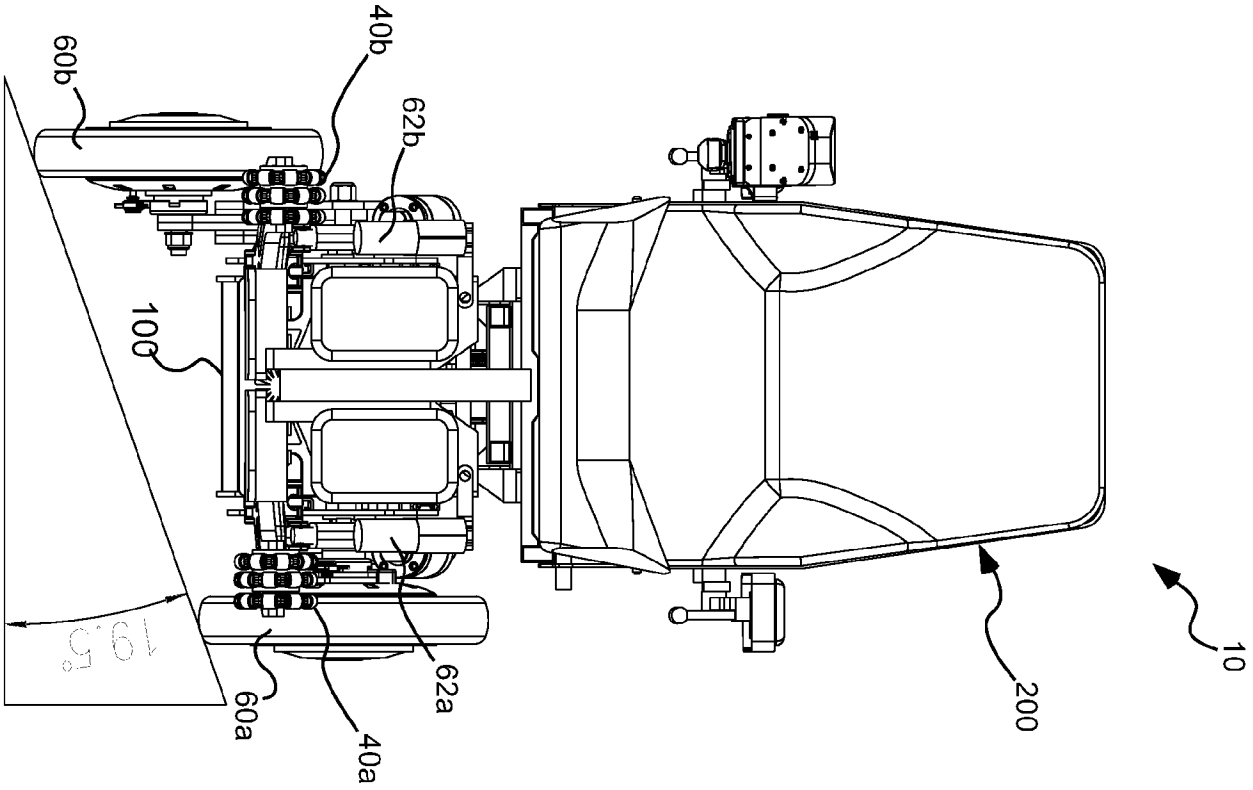
FIG. 11 illustrates the wheelchair of FIG. 1A on a cross slope and adjustments made to the vertical position of the wheels to maintain the orientation of the seat in a desirable range.

As described above, the vertical position of each of front caster wheels 20*a*, 20*b*, rear caster wheels 40*a*, 40*b* and drive wheels 60*a*, 60*b* is independently controllable. As illustrated in FIGS. 8D through 8F, the longitudinal position of drive wheels 60*a* and 60*b* are independently controllable. As illustrated in FIGS. 9 through 11, adjustment of the vertical position of front caster wheels 20*a*, 20*b*, rear caster wheels 40*a*, 40*b* and drive wheels 60*a*, 60*b* may be used to effect self-leveling of wheelchair 10. In a number of embodiments, a self-leveling application hereof (which, for example, may be at least partially embodied in software stored in memory system 352) calibrates to detect the "zero angle position" of frame 100. The zero angle position is defined the position or frame 100 when wheelchair 10 is on flat ground and the wheels are at the same base level, resting on the flat ground. After calibration, sensors of a sensor system 370 (represented schematically in FIG. 1E) detect the pitch and roll angle of frame 100 as wheelchair 10 drives over the surface. Sensor system 370 may, for example, include one or more position sensors, one or more pressure sensors, one or more inertial measurement units etc. (see, for example, FIG. 1F). Pneumatic actuators 62*a* and 62*b* in operative connection with drive wheels 60*a* and 60*b*, respectively, and pneumatic actuators 42*a* and 42*b* on rear casters 40*a* and 40*b*, respectively, retract or extend based on the slope angle of the surface over which wheelchair 10 is driving. For example, if wheelchair 10 were to drive up a hill as illustrated in FIG. 9, rear casters 40*a* and 40*b* are extended via pneumatic actuators 42*a* and 42*b* to, for example, counteract the angle caused by the uphill slope and level frame 100 (and seat 220 connected thereto). FIG. 10 illustrates retraction of rear casters 40*a* and 40*b* via pneumatic actuators 42*a* and 42*b* to, for example, counteract the angle caused by a downhill slope to level frame 100 (and seat 220 connected thereto). In another example, when wheelchair 10 is driving across a slope surface wherein the slope increases from right to left (as illustrated in FIG. 11), right side driving wheel 60*a* and rear caster 40*b* extend and left side drive wheel 60*b* and rear caster 60*b* may retract to counteract the slope. The self-leveling application(s) or functionality(ies) increase the stability of wheelchair 10 as well as the comfort and safety of the user when driving up slopes, down slopes, across slopes, or over uneven terrain. Each of front caster wheels 20*a*, 20*b*, rear caster wheels 40*a*, 40*b* and drive wheels 60*a*, 60*b* of wheelchair 10 has the ability to move up and down via associated pneumatic actuators 42*a*, 42*b* and 62*a*, 62*b* (in the case of drive wheels 60*a*, 60*b* and rear casters 40*a*, 40*b*, respectively) and electric actuators 22*a*, 22*b* (in the case of, front caster wheels 20*a*, 20*b*). In a number of embodiments actuators 22*a* and 22*b* were pneumatic actuators (as, for example, illustrated in FIGS. 20A-20C and FIG. 21). As illustrated in FIGS. 2E and 2F, actuators of frond casters 40*a*, 40*b* may, for example, also include pneumatic actuators 22*a*', 22*b*' and gas springs 23*a*', 23*b*'. The independent control over the vertical position of front caster wheels 20*a*, 20*b*, rear caster wheels 40*a*, 40*b* and drive wheels 60*a*, 60*b* of wheelchair 10 allows wheelchair 10 to change its center of gravity by maintaining the same position/orientation of seating system 200 while wheelchair 10 is driven on slopes or uneven terrain. In a number of representative embodiments, the maximum slopes and cross slopes upon which wheelchair 10 can perform self-leveling are 16.84° and 20.31°, respectively. One skilled in the art will appreciate that the maximum slopes and/or cross slopes can be readily modified using engineering principles. Sensors of sensor system 370 may monitor the position of seating system 200. Each of front caster wheels 20*a*, 20*b*, rear caster wheels 40*a*, 40*b* and drive wheels 60*a*, 60*b* may be moved up or down to counteract the angle of the terrain and maintain the position of seating system 200, which provides increased stability. As described above, wheelchair 10 can maintain the position of seating system 200 (that is, level seating system 200) for cross slopes of up to approximately 20.31° and slopes of up to approximately 16.84, thereby providing automatic and/or manual self-leveling of the surface of seat 220. In a number of representative embodiments, the seat orientation can be maintained within +/−5, +/−2,5 or even +/−1 degree of horizontal (that is, perpendicular to the orientation of the gravitational field) in the lateral and longitudinal directions over a running slope of up to 18 degrees and/or a cross slope of up to 20 degrees (or over the range or vertical motion of the wheels). An example of an algorithm for self-leveling of wheelchair 10 is, for example, described below.

Control of wheelchair suspension can also be used to lessen or ameliorate whole body vibration. In that regard, the stiffness of the actuators may be controlled to minimize the 3D acceleration and 3D angular acceleration of seat system 200. The algorithm to control 3D acceleration and 3D angular acceleration may, for example, be similar to self-leveling (that is, orientation or attitude control) as described above, but the control variables are linear and angular acceleration instead of Cartesian and angular position.

Many EPWs are unable to climb curbs, specifically large curbs of up to, for example, 8 inches in height. In the case of wheelchair 10, a curb (step change) climbing application or functionality (which may, for example, be at least partially embodiment in software stored in memory system 352 and executable by processor system 351) makes use of the vertical mobility of each front caster wheels 20*a*, 20*b*, rear caster wheels 40*a*, 40*b* and drive wheels 60*a*, 60*b* of wheelchair 10 as well as the horizontal or longitudinal motion of drive wheels 60*a*, 60*b*. Once the curb climbing application is activated, wheelchair 10 may, for example, automatically performs a sequence of steps to climb up or down curbs of up to, for example, 8 inches high. The curb climbing application removes the need for a user to search for a curb cut in the event that one is not available in the vicinity of where the user desires to get on or off a curb. Moreover, this alternative driving application or functionality allows the wheelchair to overcome environmental barriers up to 8 inches in height.

Figures 12A, 12B, 12C, 12D, 12E, 12F, 12G, 12H, 12I:
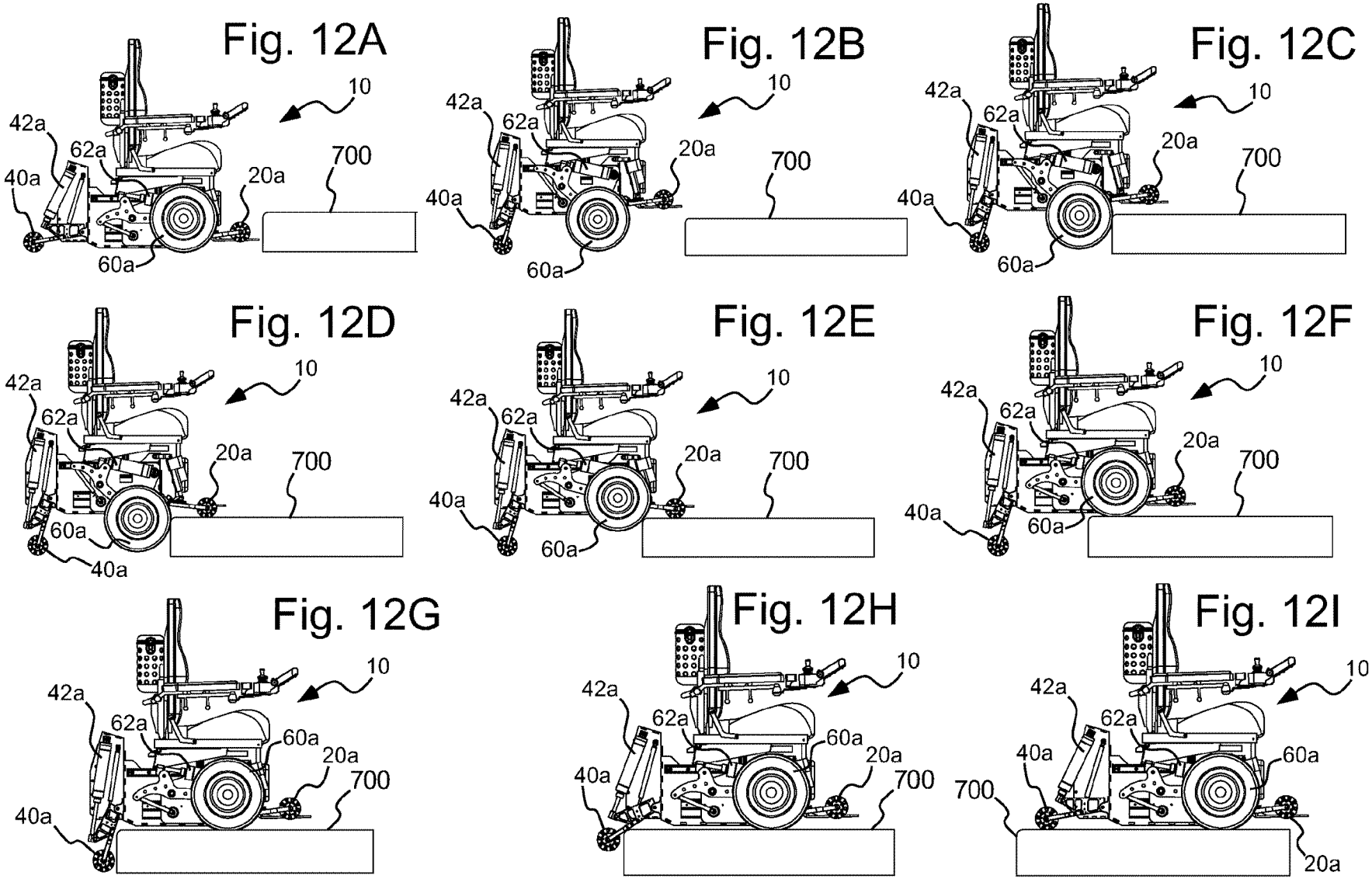
FIG. 12A illustrates a side view of the wheelchair of FIG. 1A approaching a curb to be ascended, at which time the user activates the curb climbing application or functionality.
FIG. 12B illustrates a side view of the wheelchair of FIG. 1A elevated to its highest position via pneumatic actuators on the drive wheels and rear caster wheels.
FIG. 12C illustrates a side view of the wheelchair of FIG. 1A approaching a curb and the drive wheels coming into contact with the curb.
FIG. 12D illustrates a side view of the lowering of the front caster wheels of the wheelchair of FIG. 1A onto the curb via the actuators associated therewith.
FIG. 12E illustrates a side view of the wheelchair of FIG. 1A being driven forward from the position of FIG. 12D while simultaneously lifting the drive wheels via the actuators associated therewith.
FIG. 12F illustrates a side view of the wheelchair of FIG. 1A wherein the drive wheels are further lifted until the drive wheels are on top of the curb.
FIG. 12G illustrates a side view of the wheelchair of FIG. 1A as it is driven forward until the rear caster wheels the contact the curb, as well as the lifting of the front caster wheels from contact with the curb.
FIG. 12H illustrates a side view of wheelchair of FIG. 1A as it is driven forward from the position of FIG. 12G while simultaneously lifting the rear caster wheels via actuators associated therewith until the rear caster wheels are on top of the curb.
FIG. 12I illustrates a side view of wheelchair of FIG. 1A after the curb climbing application or functionality is complete, at which time the user may exit the curb climbing application to resume normal driving.

The curb climbing sequence in the forward direction is illustrated in FIGS. 12A through 12I. Wheelchair 10 may, for example, ascend/descend curbs while driving either forwards or backwards; whichever a user prefers or circumstances demand. For example, a person may drive off of a curb forward to cross the street and notice a car approaching and back-up or reverse back onto the curb. In FIG. 12A through 12I, not all elements of wheelchair 10 are labeled to prevent overcrowding and confusion. For the user of wheelchair 10 to safely cross the street, climb a curb 700, and get out of the pathway of traffic, the entire process may be completed in an estimated 30 seconds. The sequence is described in further detail below with estimates of the time of each action set forth in parentheses. As illustrated in FIG. 12A, the user approaches curb 700 and activates the curb climbing application (0 seconds). As illustrated in FIG. 12B, wheelchair 10 elevates to its highest position (8 inches) via pneumatic actuators in operative connection with drive wheels 60*a*, 60*b* and rear casters 40*a*, 40*b* as described above (1 second). As illustrated in FIG. 12C, wheelchair 10 approaches curb 700 until drive wheels 60*a*, 60*b* come into contact with curb 700 (4 seconds). Wheelchair 10 then lowers front casters 20*a*, 20*b* as illustrated in FIG. 12D onto curb 700 via actuators 22*a*, 22*b* (6 seconds). As illustrated in FIG. 12E, wheelchair 10 drives forward while simultaneously lifting drive wheels 60*a*, 60*b* via pneumatic actuators 62*a*, 62*b* (10 seconds). Wheelchair 10 continues to lift drive wheels 60*a*, 60*b* as illustrated in FIG. 12F until drive wheels 60*a*, 60*b* are on top of curb 700 (12 seconds). Wheelchair 10 drives forward as illustrated in FIG. 12G until rear casters 40*a*, 40*b* contact curb 700 while also lifting front casters 20*a*, 20*b* (15 seconds). As illustrated in FIG. 12H, wheelchair 10 drives forward while simultaneously lifting rear casters 40*a*, 40*b* via pneumatic actuators 42*a*, 42*b* until rear casters 42*a*, 42*b* are on top of curb 700 (18 seconds). As illustrated in FIG. 12I, wheelchair 10 has climbed curb 700, and the user may exit the curb climbing application to resume normal driving (22 seconds).

Figure 13A:
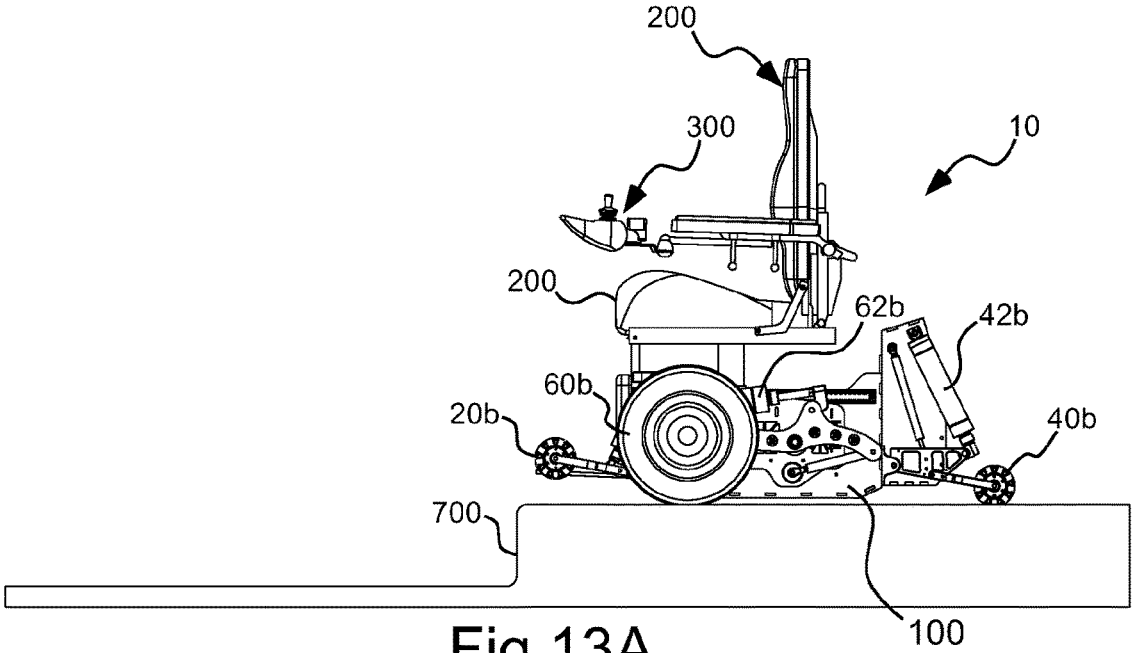
FIG. 13A illustrates a side view of the wheelchair of FIG. 1A approaching a curb to be descended, at which time the user activates the curb climbing application or functionality.
Figure 13B:
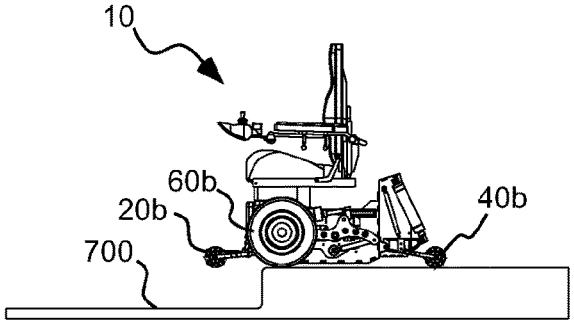
FIG. 13B illustrates a side view of the wheelchair of FIG. 1A elevated to its lowest position via actuators on the drive wheels and rear caster wheels.
Figure 13C:
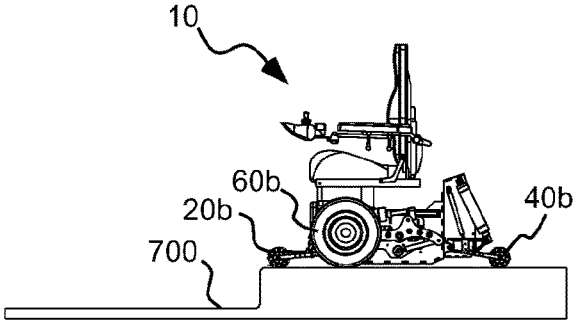
FIG. 13C illustrates a side view of the wheelchair of FIG. 1A approaching a curb and the front caster wheels extending over the curb.
Figure 13D:
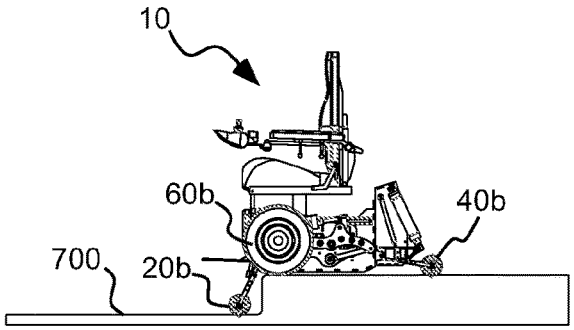
FIG. 13D illustrates a side view of the lowering of the front caster wheels of the wheelchair of FIG. 1A until contact is made with the ground.
Figure 13E:
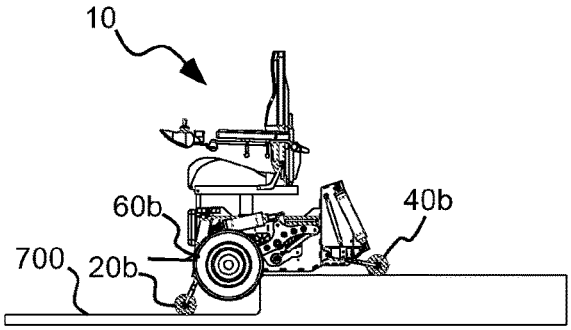
FIG. 13E illustrates a side view of the wheelchair of FIG. 1A being driven forward from the position of FIG. 13D while simultaneously lowering the drive wheels via the actuators associated therewith.
Figure 13F:
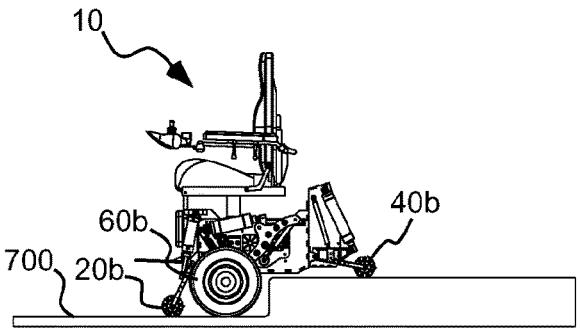
FIG. 13F illustrates a side view of the wheelchair of FIG. 1A wherein the drive wheels are further lowered until the drive wheels are in contact with the ground/lower level.
Figure 13G:
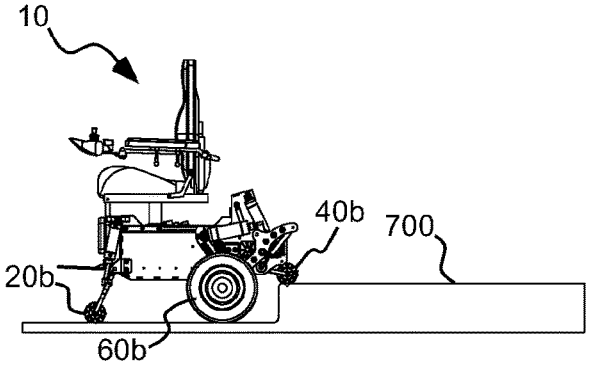
FIG. 13G illustrates a side view of the wheelchair of FIG. 1A as it is driven forward, wherein the drive wheels are moved from their most forward position to their most rearward position (thereby, moving the frame forward and still maintaining contact with the top of the curb via the rear casters.).
Figure 13H:
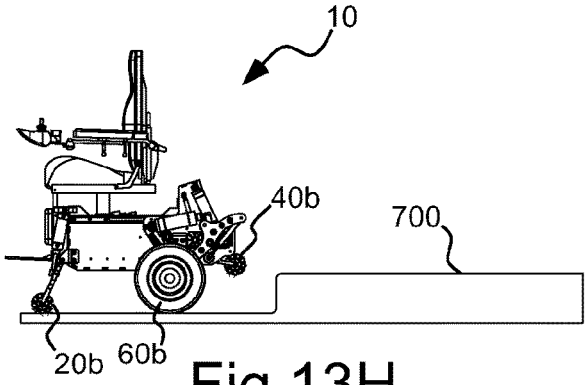
FIG. 13H illustrates a side view of wheelchair of FIG. 1A as it is driven forward from the position of FIG. 13G until the rear caster wheels are no longer in contact the curb.
Figure 13I:
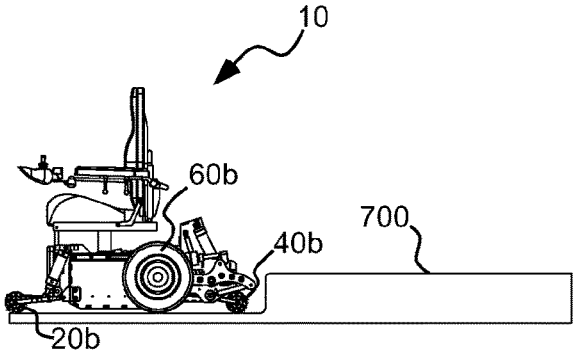
FIG. 13I illustrates a side view of wheelchair of FIG. 1A, wherein the frame is lowered to its lowest ground clearance and all six wheels are in contact with the ground).
Figure 13J:
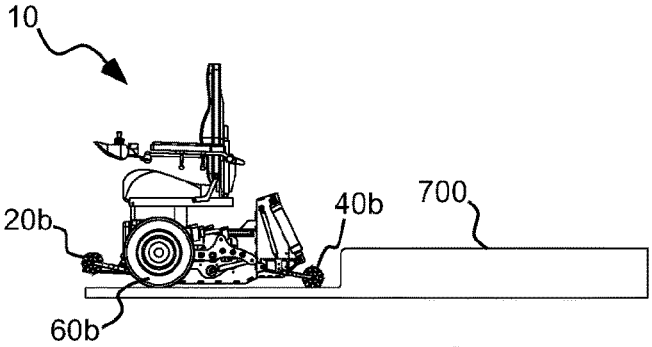
FIG. 13J illustrates a side view of the wheelchair of FIG. 1A, wherein the drive wheels are moved into their most forward position and the front casters are lifted off of the ground, which is the same configuration as illustrated in FIG. 13A.

FIG. 13A through 13J illustrate descending of a step or curb by wheelchair 10. In FIG. 13A, wheelchair 10 approaches a curb to be descended, and the user activates the curb climbing application or functionality. In FIG. 13B wheelchair 10 is elevated to its lowest position via actuators on the drive wheels and rear caster wheels. In FIG. 13C, wheelchair 10 approaches the curb and the front caster wheels extend over the curb. In FIG. 13D, the front caster wheels of wheelchair 10 are lowered until contact is made with the ground. FIG. 13E illustrates a side view of wheelchair 10 being driven forward from the position of FIG. 13D while simultaneously lowering the drive wheels via the actuators associated therewith. In FIG. 13F, the drive wheels are further lowered until the drive wheels are in contact with the ground/lower level. FIG. 13G illustrates a side view of wheelchair 10 as it is driven forward, wherein the drive wheels are moved from their most forward position to their most rearward position. The frame is thereby forward while contact with the top of the curb is maintained via the rear casters. In FIG. 13H, wheelchair 10 is driven forward from the position of FIG. 13G until the rear caster wheels are no longer in contact the curb. In FIG. 13I, the frame is lowered to its lowest ground clearance and all six wheels are in contact with the ground. FIG. 13J illustrates a side view of wheelchair 10 wherein the drive wheels are moved into their most forward position and the front casters are lifted off of the ground, which is the same configuration as illustrated in FIG. 13A.

Figure 14A:
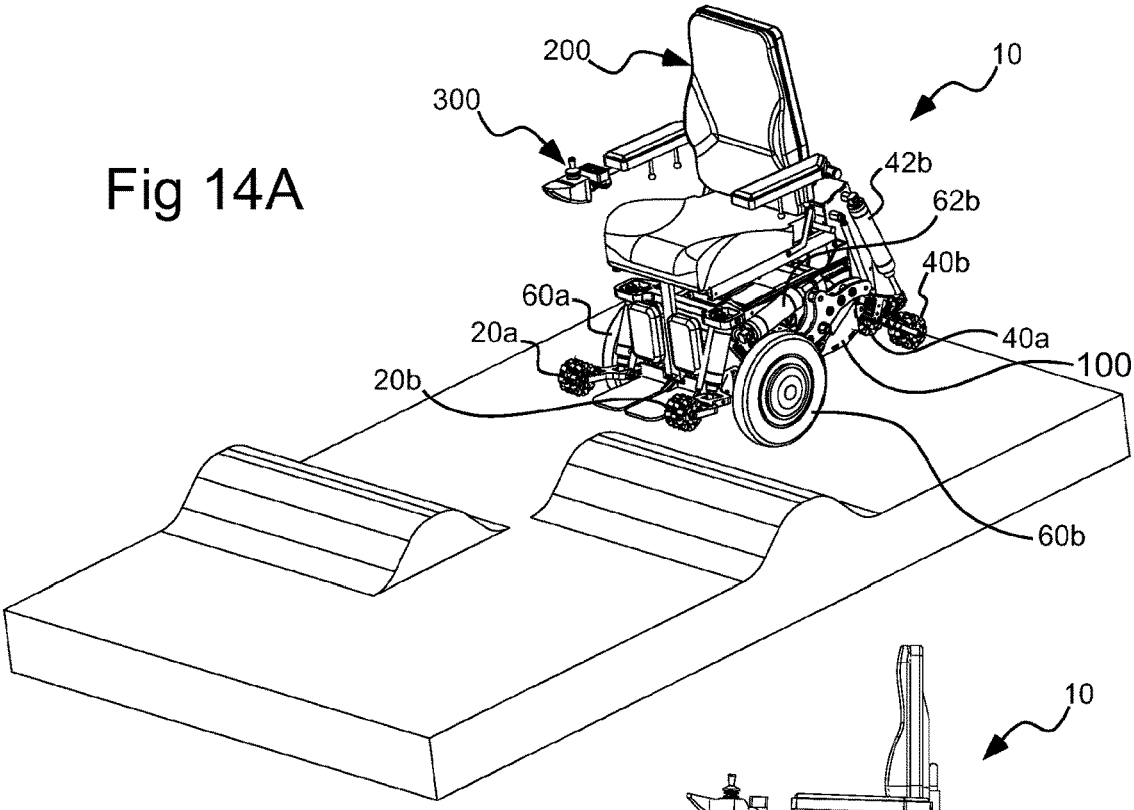
FIG. 14A illustrates a perspective view of the wheelchair of FIG. 1A approaching uneven terrain in an outdoor configuration (in that configuration, wheelchair had a ground clearance of 5 inches.)
Figure 14B:
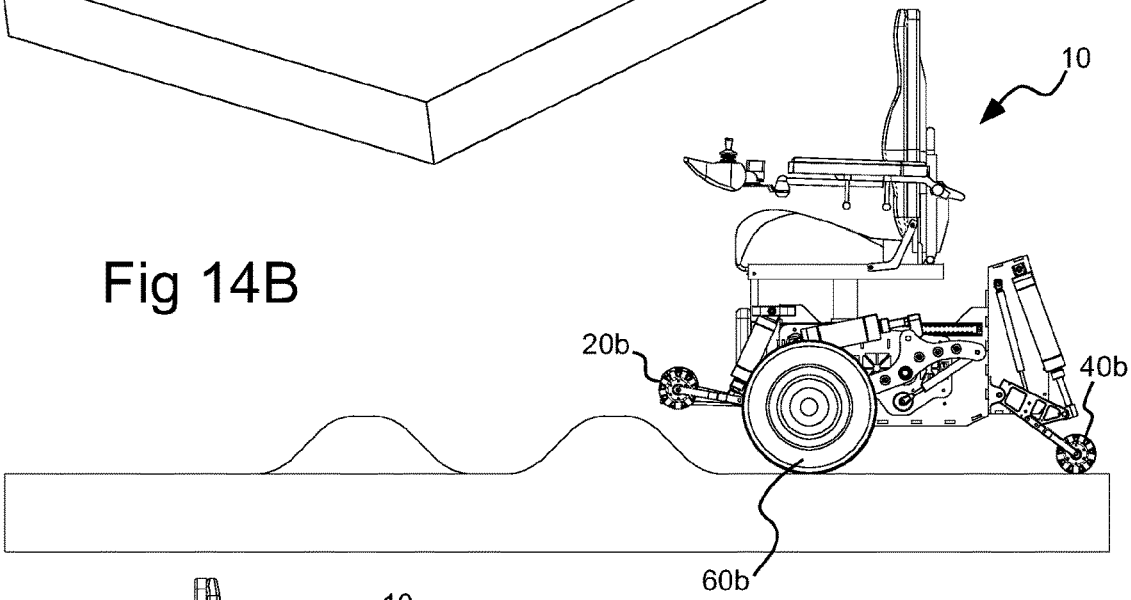
FIG. 14B illustrates a left side view of the wheelchair configuration and of FIG. 14A.
Figure 14C:
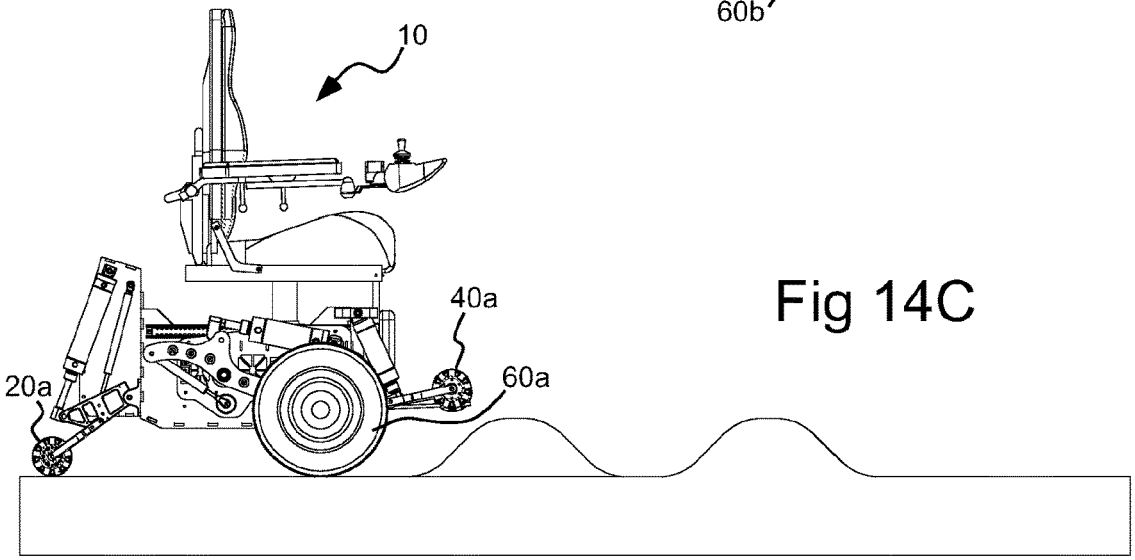
FIG. 14C illustrates a right side view of the wheelchair configuration and of FIG. 14A.
Figure 15A:
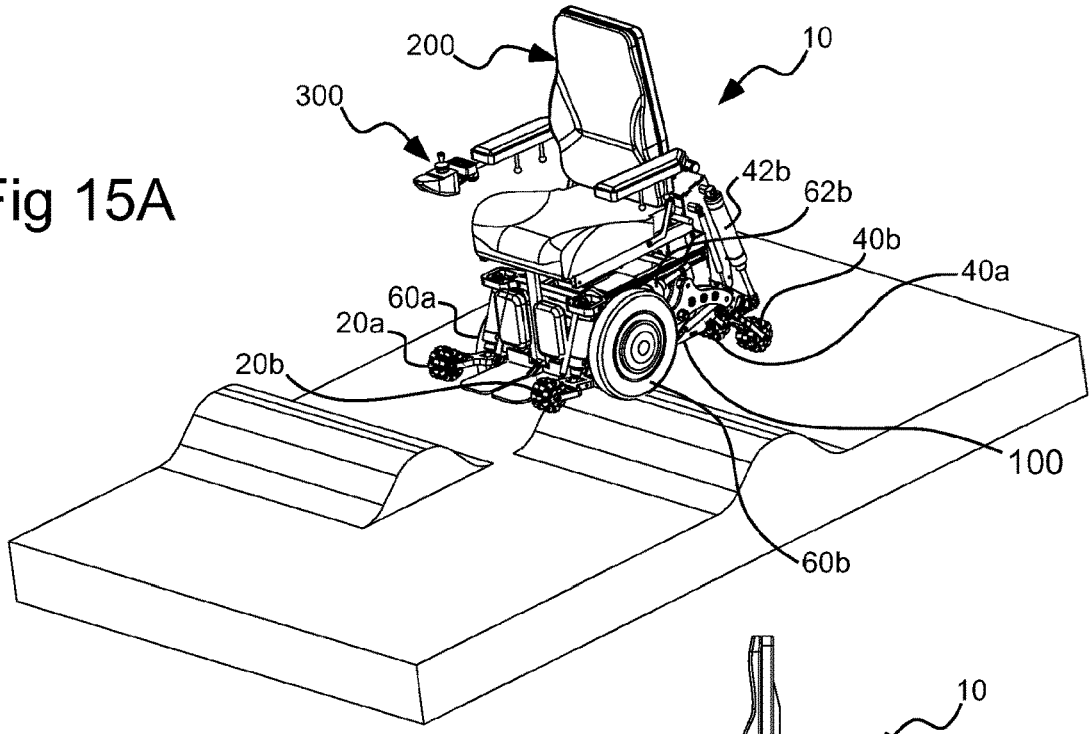
FIG. 15A illustrates a perspective view of the wheelchair of FIG. 1A, wherein the left driving wheel moves upward to counteract or follow the contour of the uneven terrain.
Figure 15B:
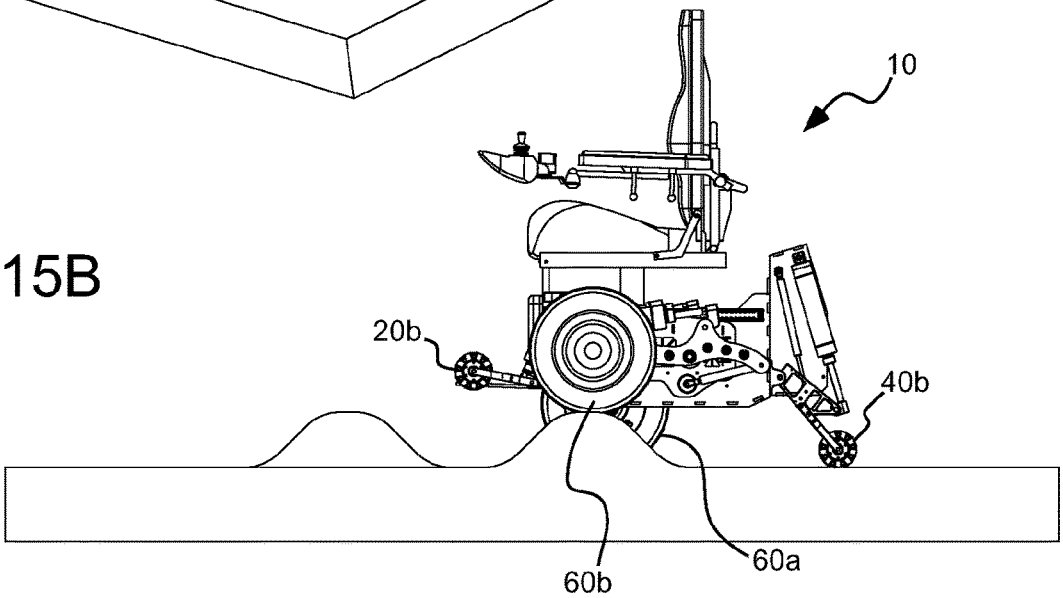
FIG. 15B illustrates a left side view of the wheelchair configuration and of FIG. 15A.
Figure 15C:
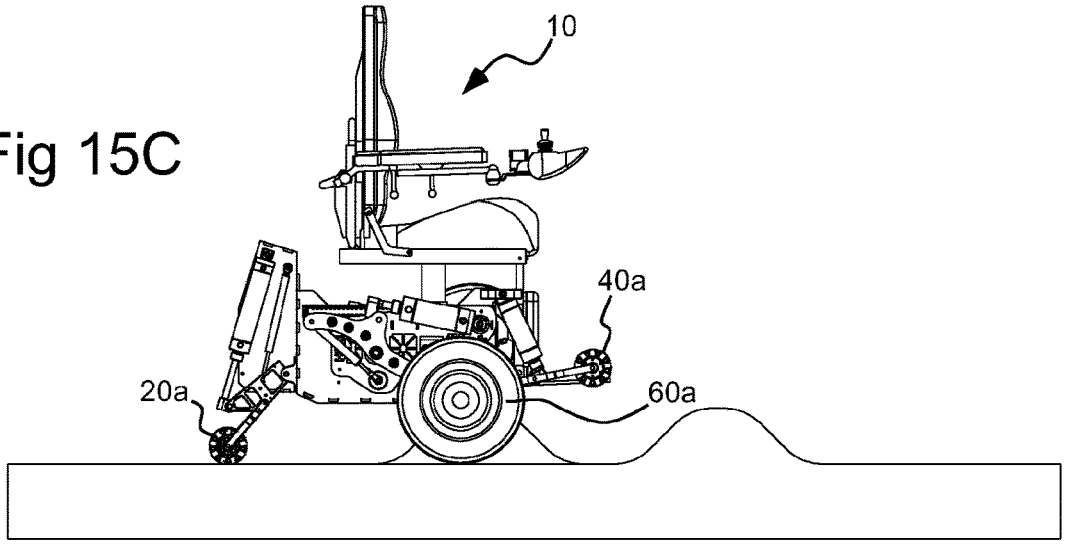
FIG. 15C illustrates a right side view of the wheelchair configuration and of FIG. 15A.
Figure 16A:
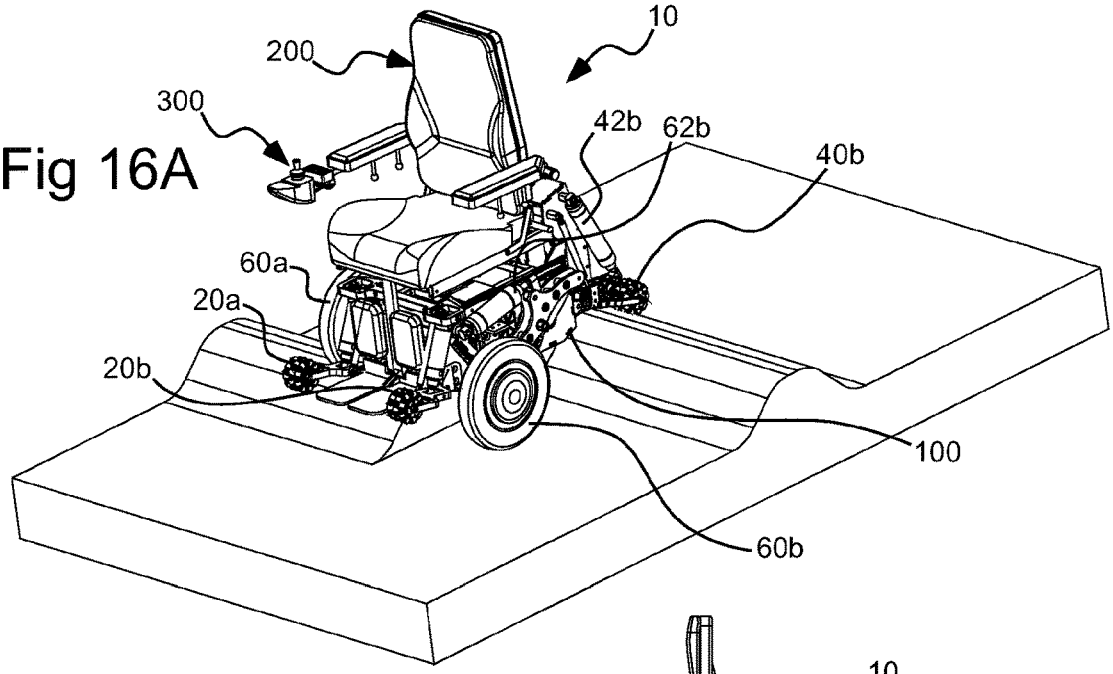
FIG. 16A illustrates a perspective view of the wheelchair of FIG. 1A, wherein the wheelchair continues to move forward and approaches uneven terrain on its right side and wherein the left drive wheel returns to its original position after traveling over the uneven terrain on its left side and right drive wheel and left rear caster move upward to counteract or follow the contour of the uneven terrain.
Figure 16B:
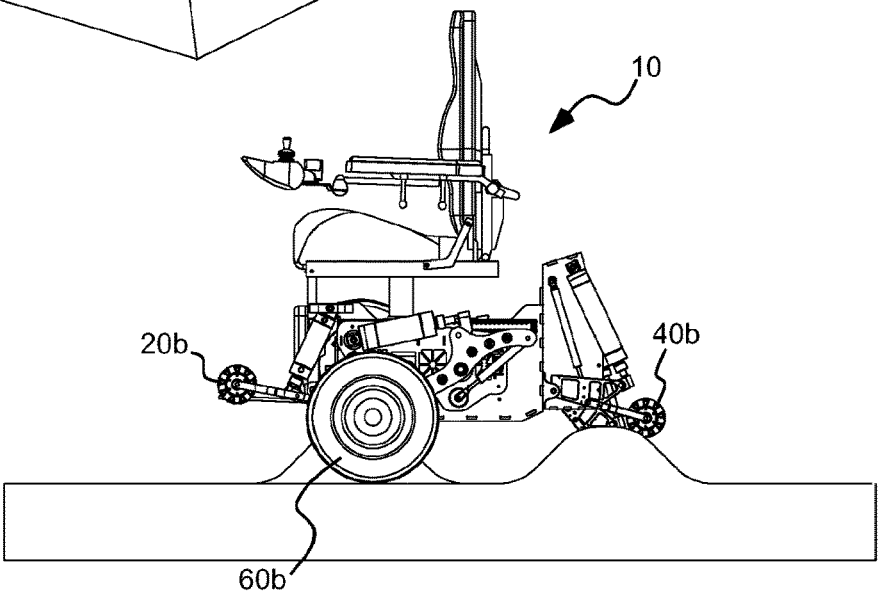
FIG. 16B illustrates a left side view of the wheelchair configuration and of FIG. 16A.
Figure 16C:
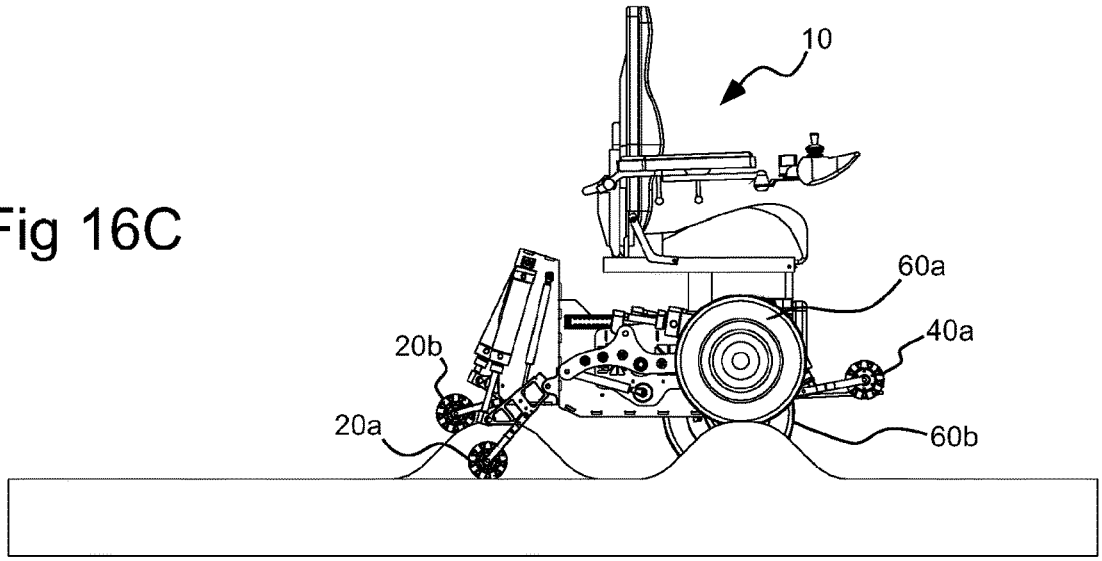
FIG. 16C illustrates a right side view of the wheelchair configuration and of FIG. 16A.
Figure 17A:
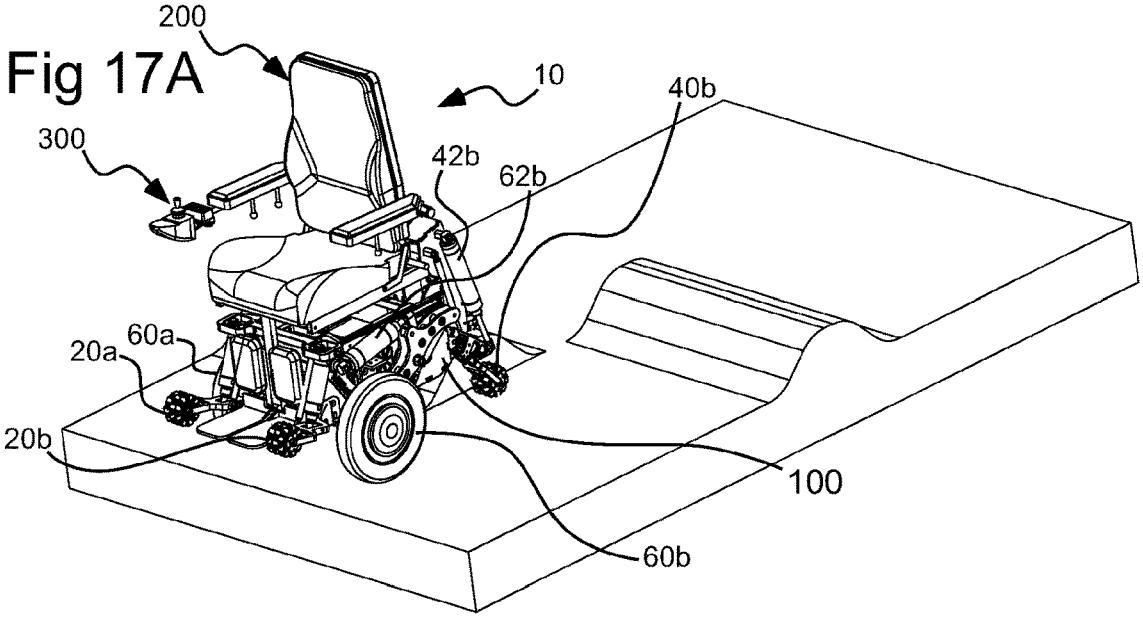
FIG. 17A illustrates a perspective view of the wheelchair of FIG. 1A, wherein the wheelchair continues to move forward as the right rear caster comes into contact with the uneven terrain, and wherein the right rear caster moves upward to counteract the uneven terrain and the right front drive wheel and left rear caster return to their original positions.
Figure 17B:
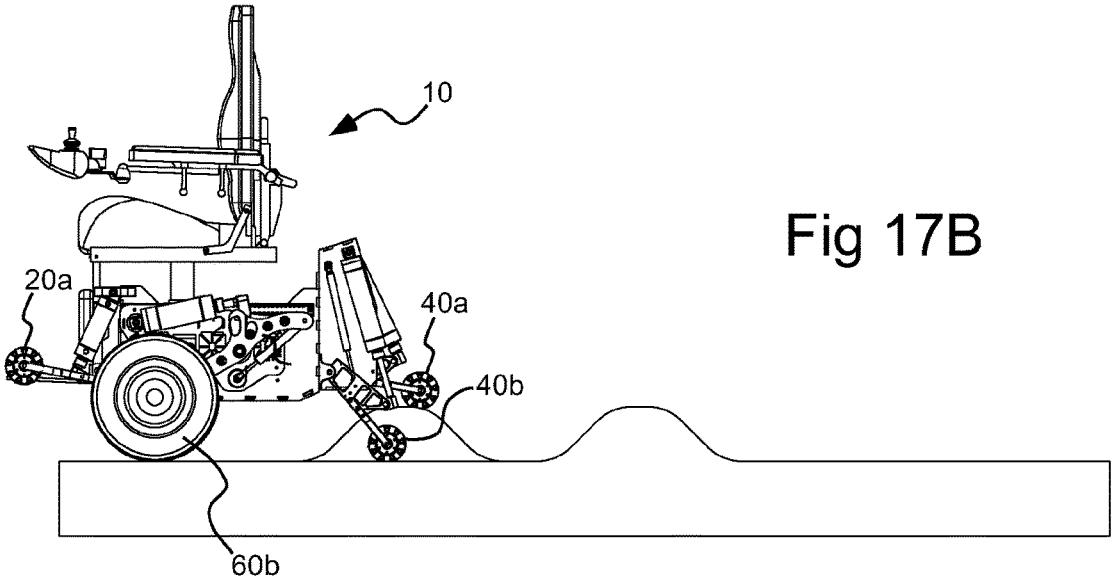
FIG. 17B illustrates a left side view of the wheelchair configuration and of FIG. 17A.
Figure 17C:
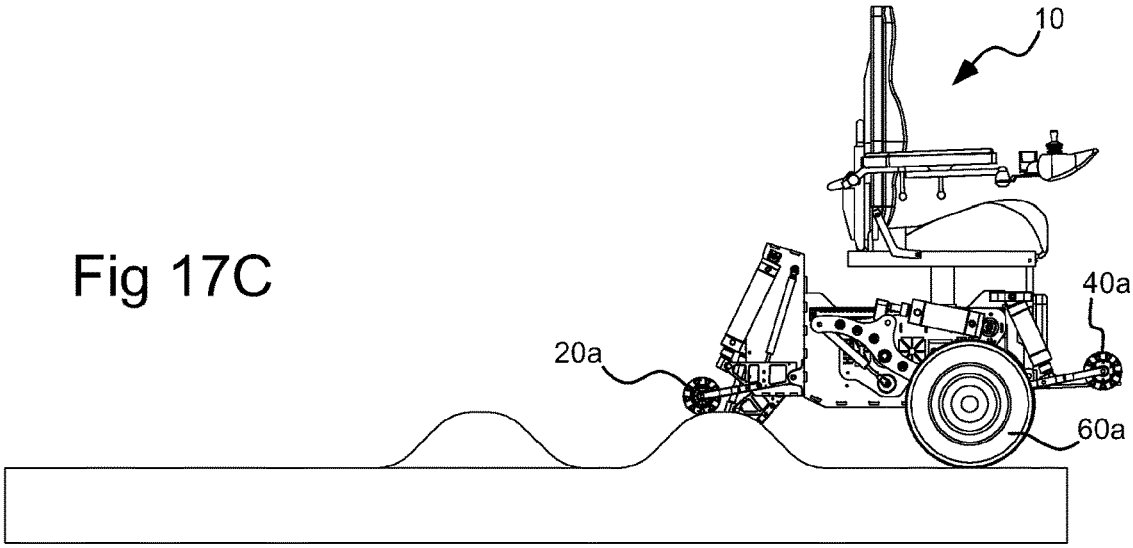
FIG. 17C illustrates a right side view of the wheelchair configuration and of FIG. 17A.

FIG. 14A through 17C illustrates wheelchair 10 traveling over uneven terrain. In FIG. 14A through 14C, wheelchair 10 is approaching uneven terrain in an outdoor configuration thereof in which the frame of wheelchair 10 has a ground clearance of approximately 5 inches. In FIGS. 15A through 15C, the left driving wheel of wheelchair 10 moves upward to counteract or follow the contour of the uneven terrain. In FIGS. 16A through 16C, wheelchair 10 continues to move forward and approaches uneven terrain on its right side. The left drive wheel returns to its original position after traveling over the uneven terrain on its left side, and the right drive wheel and left rear caster move upward to counteract or follow the contour of the uneven terrain. In FIG. 17A through 17C, wheelchair 10 continues to move forward as the right rear caster comes into contact with the uneven terrain. The right rear caster moves upward to counteract or follow the contour of the uneven terrain, and the right front drive wheel and left rear caster return to their original positions.

Figure 18A:
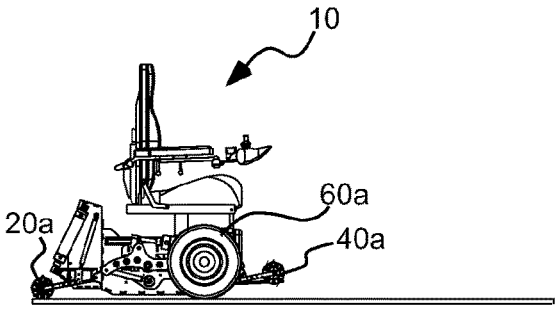
FIG. 18A illustrates a side view of the wheelchair of FIG. 1A wherein the wheelchair is unable to move as a result of the drive wheels slipping in mud, sand, gravel, ice, etc. and wherein the drive wheels are in their most forward position.
Figure 18B:
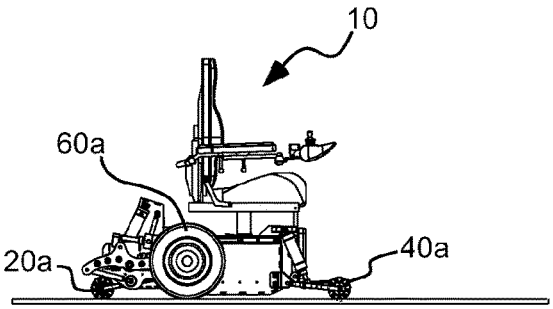
FIG. 18B illustrates a side view of the wheelchair of FIG. 1A, wherein the front casters are extended until they come into contact with the ground and both of the wheelchair drive wheels are moved to their most rearward position, and wherein, as a result, the frame is moved forward.
Figure 18C:
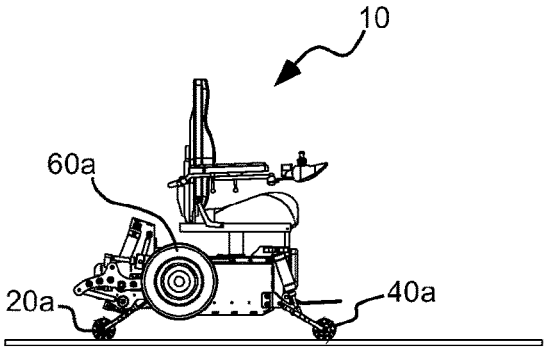
FIG. 18C illustrates a side view of the wheelchair of FIG. 1A, wherein the front and rear casters are extended to lift the frame and drive wheels off of the ground.
Figure 18D:
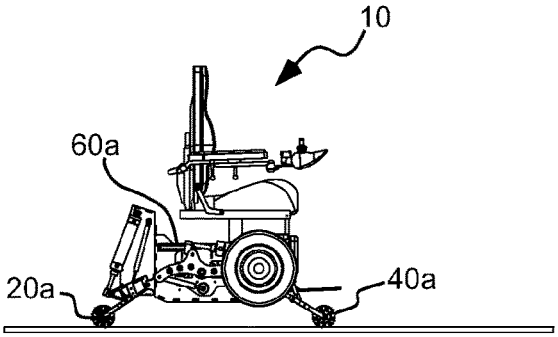
FIG. 18D illustrates a side view of the wheelchair of FIG. 1A, wherein the drive wheels are moved to their most forward position.
Figure 18E:
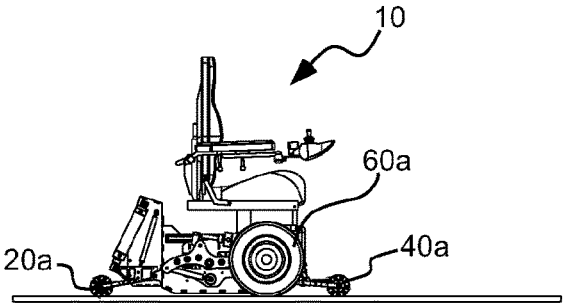
FIG. 18E illustrates a side view of the wheelchair of FIG. 1A, wherein the frame and the drive wheels are lowered until contact is made with the ground and the process may repeated until the wheelchair and its user are unstuck.

FIGS. 18A through 18D illustrates the crawling or inchworm mode of operation of wheelchair 10. FIG. 18A illustrates wheelchair 10 in a position where it is unable to move as a result of the drive wheels slipping in mud, sand, gravel, ice, etc. and wherein the drive wheels are in their most forward position. In FIG. 18B, the front casters are extended until they come into contact with the ground, and both of the drive wheels are moved to their most rearward position. As a result, the frame is moved forward. FIG. 18C illustrates extension of the front and rear casters to lift the frame and drive wheels off of the ground. FIG. 18D illustrates movement of the drive wheels to their most forward position while lifted off the ground. FIG. 18E illustrates lowering of the frame and the drive wheels from the position of FIG. 18D until contact is made with the ground. The actions or process of FIGS. 18A through 18E may repeated until the wheelchair and its user are unstuck.

Figure 19A:
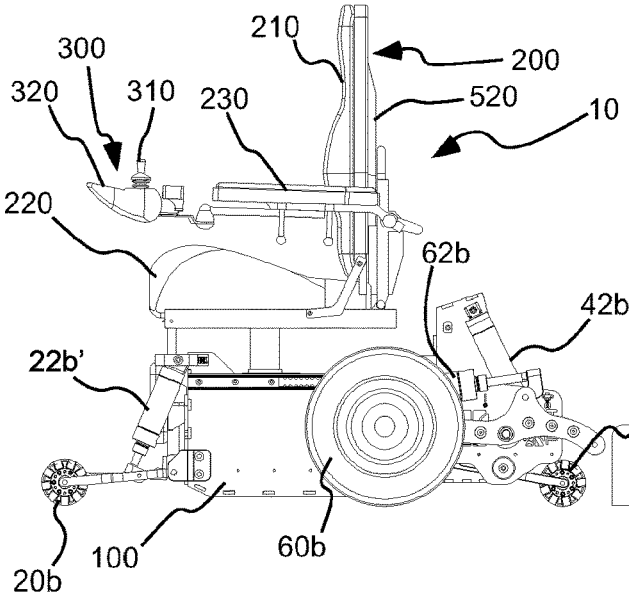
FIGS. 19A through 19O illustrates a side view of the wheelchair of FIG. 1A performing a stair ascending/descending process.
Figure 19B:
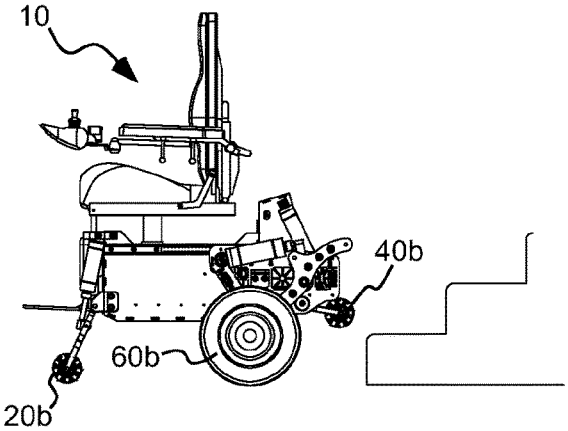
Figure 19C:
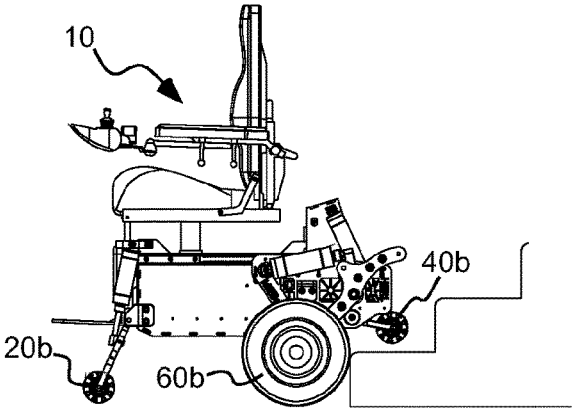
Figure 19D:
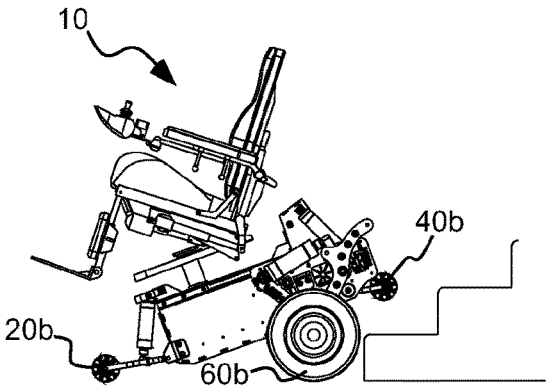
Figure 19E:
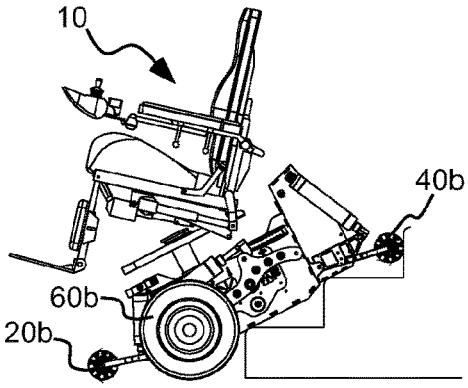
Figure 19F:
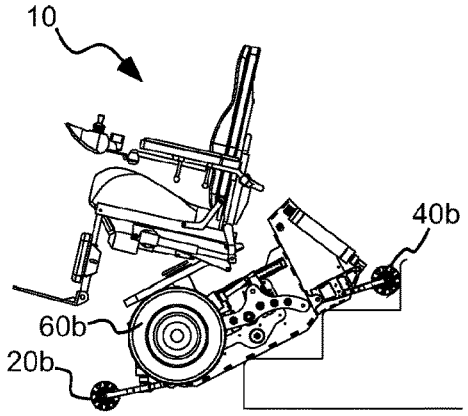
Figure 19G:
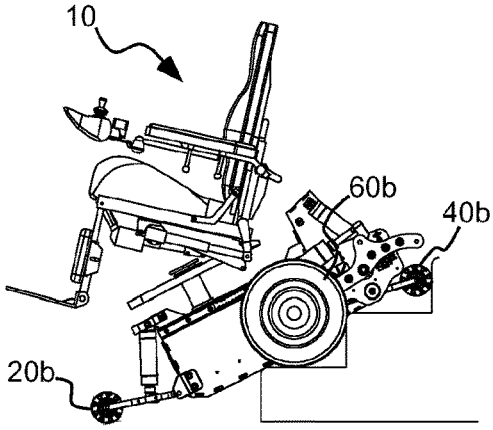
Figure 19H:
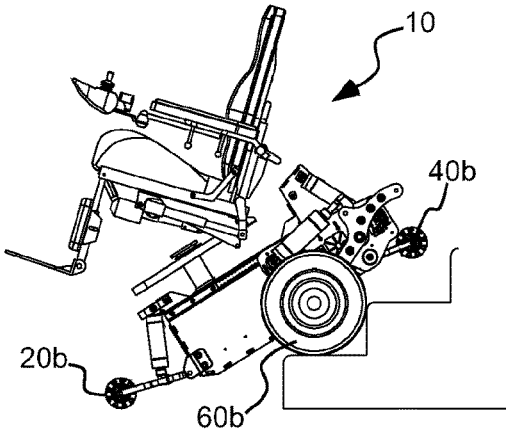
Figure 19I:
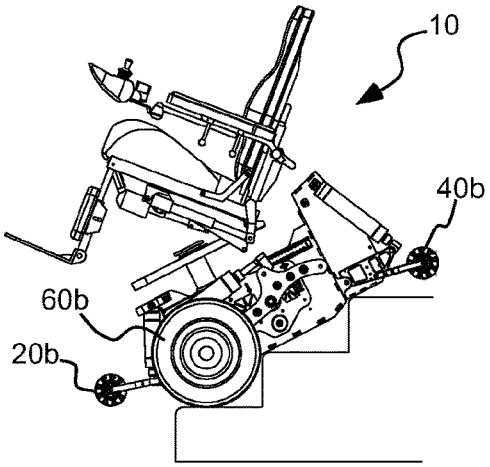
Figure 19J:
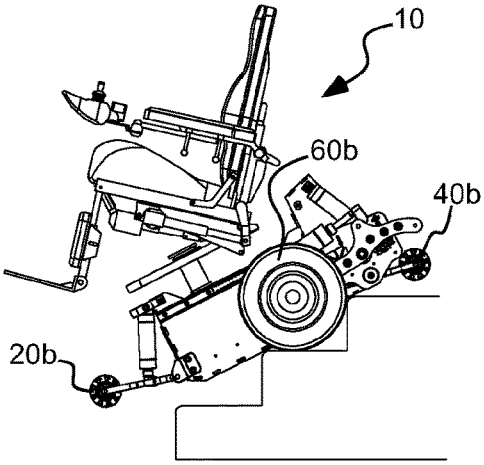
Figure 19K:
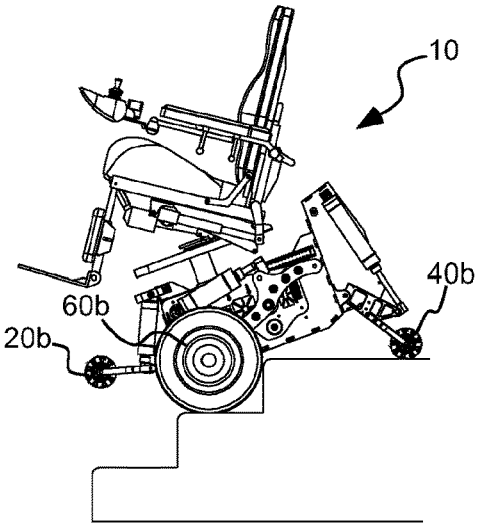
Figure 19L:
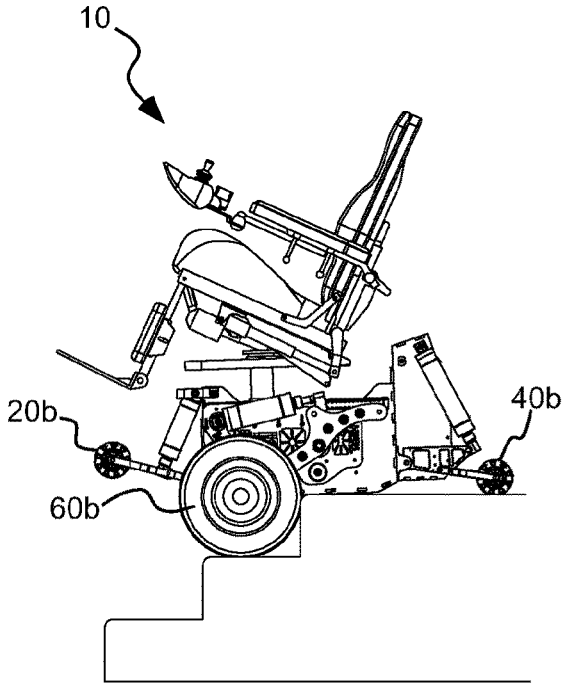
Figure 19M:
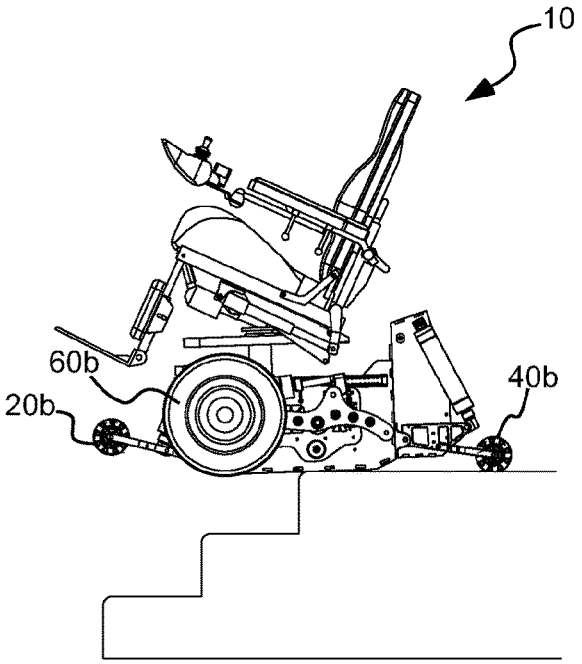
Figure 19N:
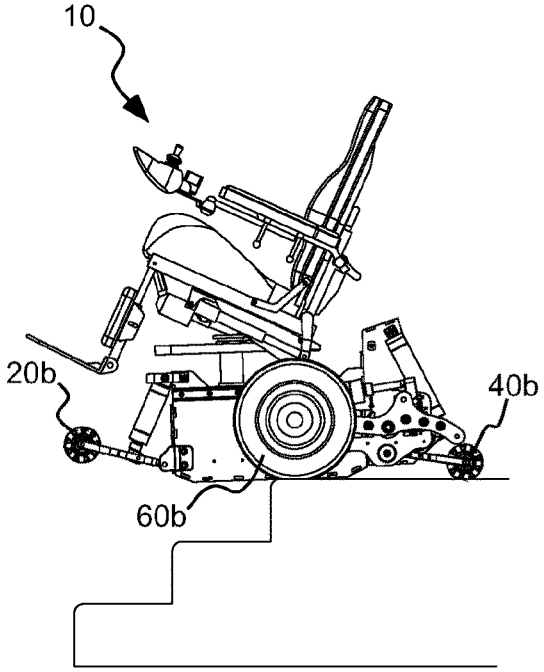
Figure 19O:
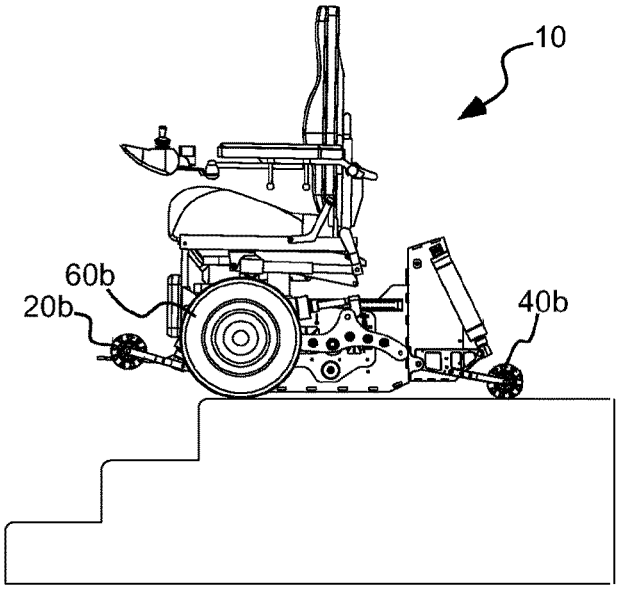

An embodiment of a stair ascending and descending process, algorithm or routine is illustrated in connection with FIGS. 19A through 19O. FIG. 19A illustrates wheelchair 10 approaching stairs in rearwheel drive or reverse position. In FIG. 19B, wheelchair 10 extends front caster wheels 20*a*, 20*b* and drive wheels 60*a*, 60*b* downward to raise the frame 100 to its highest position. In FIG. 19C, wheelchair 10 reverses until drive wheels 60*a*, 60*b* contact the $1^{st}$ step. FIG. 19D illustrates wheelchair 19 raising front caster wheels 20*a*, 20*b* while simultaneously tilting seating system 200 rearward or backward. In FIG. 19E, wheelchair 10 moves driving wheels 60*a*, 60*b* to their forward position and rests the bottom of frame 100 on the $1^{st}$ and $2^{nd}$ step while front caster wheels 20*a*, 20*b* maintain contact with the ground. Wheelchair 10 then lifts drive wheels 60*a*, 60*b* as illustrated in FIG. 19F. Wheelchair 10 subsequently moves drive wheels 60*a*, 60*b* on top of the $1^{st}$ step as illustrated in FIG. 19G. As illustrated in FIG. 19H, wheelchair 10 then extends drive wheels 20*a*, 20*b* to raise frame 100 while front caster wheels 60*a*, 60*b* maintain contact with the ground. Wheelchair 10 then moves drive wheels 60*a*, 60*b* to their forward position and rests the bottom of frame 100 on the $2^{nd}$ and $3^{rd}$ step as illustrated in FIG. 19I. Wheelchair 10 then lifts drive wheels 60*a*, 60*b* and moves drive wheels 60*a*, 60*b* on top of the $2^{nd}$ step as illustrated in FIG. 19J. Wheelchair 10 then extends the drive wheels 60*a*, 60*b* to raise frame 100 while simultaneously extending rear casters wheels until they contact the top of the stairs (FIG. 19K). Wheelchair 10 subsequently lifts drive wheels 60*a*, 60*b* while also lifting rear caster wheels 40*a*, 40*b* to allow frame 100 to contact the top of the stairs (FIG. 19L). As illustrated in FIG. 19M, wheelchair 10 then lifts drive wheels 60*a*, 60*b* to their highest position. From this position, wheelchair 10 moves drive wheels 60*a*, 60*b* to their most rearward position while frame 100 maintains contact with the top of the stairs (FIG. 19N). As illustrated in FIG. 19O, wheelchair 100 then moves drive wheels 60*a*, 60*b* to their most forward position and tilts seating system 200 forward, which completes the stairclimbing process. In a number of embodiments, a descending process may, for example, be the reverse of the ascending process described above.

Figure 20A:
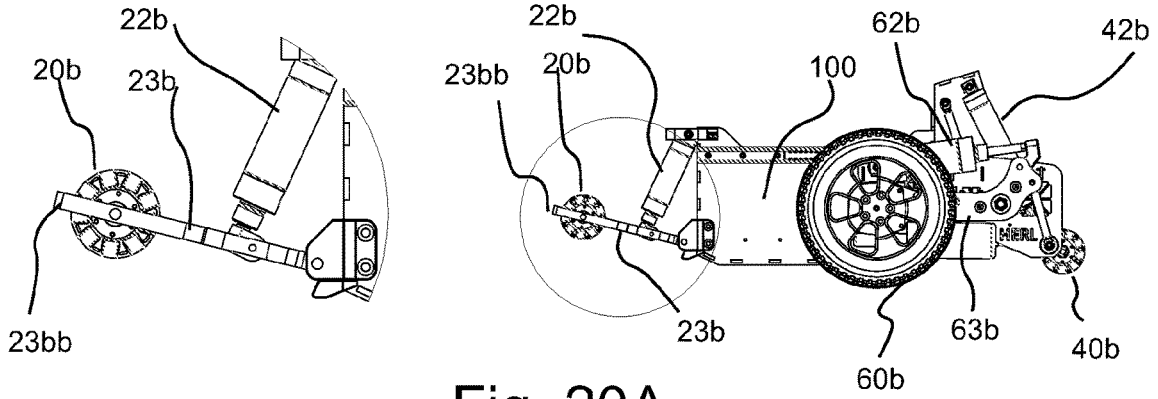
FIG. 20A illustrates an embodiment of a wheelchair hereof wherein the pivot arms of the front wheels/casters includes an extending abutment, stop or foot portion/member, wherein the front caster wheels are in an elevated position.
Figure 20B:
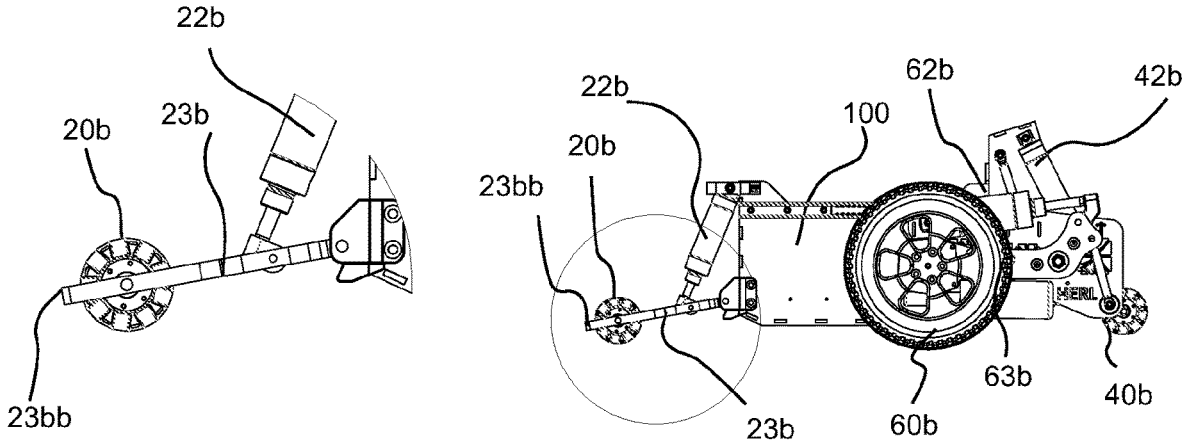
FIG. 20B illustrates the wheelchair of FIG. 20A wherein the front caster wheels are in a rolling position.
Figure 20C:
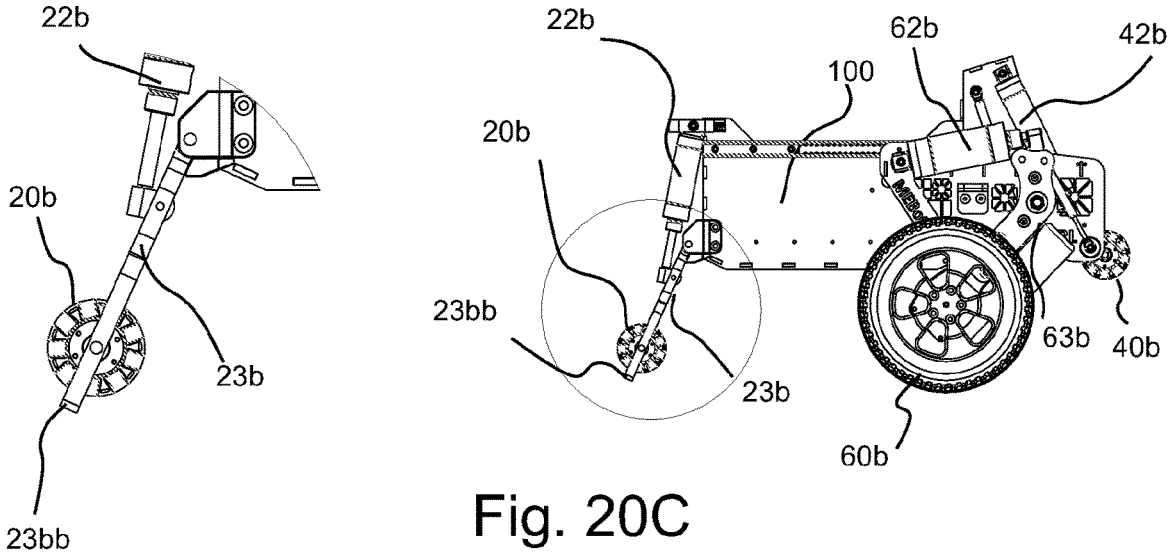
FIG. 20C illustrates the wheelchair of FIG. 20A wherein the front casters are in a downward or stop position so that an extending abutment portion of the pivot arms of the front caster wheels contacts or abuts the terrain/surface upon which the wheelchair is positioned to provide resistance against or to prevent the wheelchair from moving forward/rearward.

FIGS. 20A through 20C illustrate another embodiment of a wheelchair 100' in which an antiroll or stop mechanism is used to facilitate ascending/climbing and/or descending operations. In certain situations it may be desirable to provide resistance to or prevent movement of wheelchair 100 when front casters/wheels 20*a*, 20 are lowered to a certain position (for example, their lowest position) as, for example, illustrated in FIG. 19C-19D to increase safety in an ascending/descending sequence. Front casters or wheels 20*a*, 20*b* may, for example, include an actuatable braking mechanism as known in the braking arts. In the embodiment, of FIG. 20A through 20C, pivot arms, 23*a*, 23*b* (only pivot arm 23*b* is illustrated in the side view of FIGS. 20A through 20C) include an extending abutment, stop or foot portion/member 23*aa*, 23*bb*. Abutment members 23*aa*, 23*bb* extend beyond the radius of front casters 20*a*, 20*b*. While front casters 20*a*, 20*b* are in an elevated position (see, for example, FIG. 20A), abutment member 23*aa*, 23*bb* may operate as anti-tip members when, for example, wheelchair 100 is in a front wheel drive operational mode. Abutment members 23*aa*, 23*bb* may, for example, prevent wheelchair 100 from tipping forward in the event that its center of mass moves too far forward. When front casters 20*a*, 20*b* are in a rolling position (see, for example, FIG. 20B), front casters 20*a*, 20*b* operate as typical front caster wheels and allow wheelchair 100 to move. This configuration may, for example, be used when the wheelchair is in a mid/rear wheel drive operational mode and also during stair and/or curb ascending/descending sequences. When front casters 20*a*, 20*b* are in a down or stop position (FIG. 20C), abutment members 23*aa*, 23*bb* operate as a "stops" or "foots" by contact/abutment with the terrain/surface upon which wheelchair 100 is positioned and provide resistance to or prevent wheelchair 100 from moving forward/rearward. This configuration may, for example, be used during stair and curb ascending/descending sequences.

Surface conditions such as wet, icy, or snowy surfaces can cause an EPW to slip (lose traction) on one of the drive wheels, causing the EPW to veer off course. Such veering of course can cause the user to drive off of the desired path or sidewalk and may lead to tipping or falling out of the wheelchair, resulting in serious injury. To address this issue, the traction control feature or functionality of wheelchair 10 senses any slippage in drive wheels 60*a*, 60*b* and automatically decreases the speed of the slipping wheel to enable the user to maintain their desired path of travel, decreasing the risk of getting stuck and/or tipping. Moreover, weight distribution on front caster wheels 20*a*, 20*b*, rear caster wheels 40*a*, 40*b* and/or drive wheels 60*a*, 60*b* of wheelchair 10 can be adjusted/optimized to maximize traction and driving performance depending on the activity and the terrain. As front caster wheels 20*a*, 20*b*, rear caster wheels 40*a*, 40*b* and drive wheels 60*a*, 60*b* of wheelchair 10 can be moved independently under feedback control, they can be used for terrain following and active suspension to minimize shock, vibration, and displacement transmitted to seat system 200 and thereby to the user.

In a number of embodiments, traction control is achieved by sensing the angular acceleration of driven wheel(s) 60*a* and/or 60*b* (for example using an encoder) and comparing that angular acceleration to the expected angular acceleration from the reference controller or a caster wheel angular acceleration. If the angular acceleration or driven wheel(s) 60*a* and/or 60*b* exceeds a threshold value above the desired angular acceleration (either measured from a caster or the reference controller); the angular speed, acceleration or torque may be reduced. If such a reduction is not sufficient, the ground reaction force on the driven wheel(s) 60*a* and/or 60*b* is increased or maximized by repositioning the center of mass of the user and wheelchair 10. The center of mass of wheelchair 10 may, for example, be adjusted by tilting seat system 200, moving drive wheel 60*a* and/or 60*b* forward or rearward, or by changing the vertical position of one or more of the wheels/castors. Ground force on each of the wheels or castors may be measure to assist in controlling the center of mass of wheelchair 10.

As described above, weight distribution control and optimization for traction etc. may, for example, be based, at least in part, on sensing the ground reaction force and actuator positions on each of the wheels and adjusting the position and orientation of the person/wheelchair system 200 to achieve the desired objective. For example, on a firm but slippery surface (for example, ice), the weight may be maximized across the driven wheels. However on an unstable surface (for example, sand or gravel); the weight may be distributed evenly across all six wheels. In more complex scenarios a combination of ground reaction force and actuator position may be used to shift the weight distribution when a wheel encounters an obstacle (for example, stone or bump), a soft spot or a hole (for example, pot hole). Cameras, laser, or laser detection or ranging (LADAR) or other sensors can be used to predict and respond before getting into an unsafe situation.

With the independently controlled front caster wheels 20*a*, 20*b*, rear caster wheels 40*a*, 40*b* and drive wheels 60*a*, 60*b* of wheelchair 10, the ground clearance of wheelchair 10 may be adjustable. For indoor use, ground clearance can be adjusted so that wheelchair 10 can, for example, drive under a regular office desk at a lower ground clearance. When traveling outdoors, a higher ground clearance can be used for driving over rough terrain and obstacles.

Wheelchair 10 also may provide the capability to perform lateral pressure relief to prevent pressure ulcers and provide increased comfort of the user. In that regard, the left and right side height of wheelchair 10 may be adjustable as described above via adjustment of the vertical position of front caster wheels 20*a*, 20*b*, rear caster wheels 40*a*, 40*b* and drive wheels 60*a*, 60*b* of wheelchair 10. Front caster wheels 20*a*, 20*b*, rear caster wheels 40*a*, 40*b* and drive wheels 60*a*, 60*b* of wheelchair 10 may be adjusted to, for example, periodically change the orientation of seat system 200 to effect lateral pressure.

The advanced applications or functionalities of wheelchair 10 independently and/or collectively allow a user of wheelchair 10 to overcome many obstacles and situations of concern. Slipping on surfaces such as wet grass, snow, ice, or rain is addressed with the application of traction control which can be used to prevent the user from becoming stuck in, for example, mud, soft sand, or gravel. Furthermore, the selectable drive wheel positioning may also be used in the event that the user does become stuck by allowing them to relocate drive wheels 60*a*, 60*b* to regain traction. Moreover, the important concern of losing stability and tipping over is addressed with self-leveling applications or functionalities which automatically adjust seating system 200 and the center of gravity of wheelchair 10 based on the uneven terrain or slope the user drives up, down, or across. A curb climbing application or functionality further addresses the concern of tipping over when going up or down high curbs through a sequence of steps that are performed automatically to maintain the stability of wheelchair 10 and safety of the user. The development of advanced applications and functionalities of wheelchair 10 addresses hazardous driving conditions and concerns EPW users encounter in, for example, an outdoor environment. The use of wheelchair 10 provides users with an increased sense of safety, feeling of independence, and quality of life.

In the case of wheelchairs hereof such as wheelchair 10, control of the static seat orientation with respect to gravity and/or seat elevation can be achieved via adjustment of the orientation and elevation of main frame component 100 via control of the vertical of each of front caster wheels 20*a*, 20*b*, rear caster wheels 40*a*, 40*b* and drive wheels 60*a*, 60*b* of wheelchair 10 as described above. In the wheelchairs hereof, control of static seat orientation via the orientation of main frame component 100 can be in addition to or alternative to control of static seat orientation via seat function actuators 260. Posterior tilt (the angle of the base of the seat) can be controlled by using the relative height of drive wheels 60*a*, 60*b* with respect to front caster wheels 20*a*, 20*b* and rear caster wheels 40*a*, 40*b*. In front wheel drive mode, drive wheels 60*a*, 60*b* are elevated with respect to rear caster wheels 40*a*, 40*b*; whereas in rear wheel drive modem, front casters 20*a*, 20*b* are elevated higher than drive wheels 60*a*, 60*b*. For anterior tilt, the elevations of the wheels are reversed. Moreover, to assist a person with transfer, such as stand and pivot transfers, the base may operate a sequence to elevate and tilt in the anterior direction, using a combination of movements of the forward/rearward casters and the driven wheels of the wheelchairs hereof.

Seat elevation, such as for eye-level conversation, to ease transfers, or to reach higher areas, can be achieved by elevating the driven wheels and casters of the wheelchairs hereof. Lateral tilt of the seat is sometimes use to accommodate postural deformities or to ease pain. Lateral tilt can be achieved by altering the elevation of the left and right side wheel heights with respect to each other.

In a number of embodiments, seat 220 of wheelchair 10 and other wheelchairs hereof may be fixed (that is, immovable with respect to) main frame component 100. The functionality of at least some of the traditional power seating functions may be achieved as described above in conjunction with expanded mobility. In that regard, main frame component 100 may be used for anterior/posterior tilt of seat 220, lateral tilt of seat 220 and adjustment of elevation of seat 220. In such an embodiment, on or more actuators of actuator system 206 may be in operative connection with back rest 210 to control a recline angle thereof and in operative connection with leg rests 240 to control the position thereof. Moving some the power seat function to main frame component 100 may, for example, result in a wheelchair that is less complicated and reduced in weight as compared to some currently available wheelchairs with powered seating functions wherein the seat is movably attached to the main frame component or base via actuators to achieve adjustment of anterior/posterior tilt, adjustment of lateral tilt and adjustment of elevation of the seat. In other embodiments of wheelchairs hereof, seat is movably attached to the main frame component or base via actuators to achieve adjustment of anterior/posterior tilt, adjustment of lateral tilt and adjustment of elevation of the seat and the adjustability provide by adjustment of the orientation and/or elevation of main frame component 100 is in addition thereto. Providing typical powered seating functions in addition to adjustment of the orientation and/or elevation of main frame component 100 via adjustment of front caster wheels 20*a*, 20*b*, rear caster wheels 40*a*, 40*b* and drive wheels 60*a*, 60*b* may be beneficial in certain situation such as in ascending/descending stairs/steps as described above.

Self-Leveling Algorithm

As described above, an embodiment of an algorithm was developed for keeping the seat of wheelchairs hereof level over slopes that the wheelchairs may encounter. The algorithm controls the motion of four (or more) independently movable wheels as described above with, for example, pneumatic actuators and pivoting linkages to maintain the frame within pitch and roll limits. To promote safety and independence for users of wheelchairs hereof the wheelchairs may perform self-leveling functions when, for example, traversing inclines and cross slopes, curb climbing, step climbing and traction control.

Two drive wheels 60*a*, 60*b* and two (2) rear caster wheels 40*a* or 40*b* may, for example, be mounted on pivoting linkages or linkage arms moved by double acting actuators (62*a*, 62*b* and 42*a*, 42*b* respectively) that permit drive wheels 60*a*, 60*b* and rear caster wheels 40*a* or 40*b* to be independently raised and lowered as described above. As also described above, sensor system 370 may include an inertial measurement unit (IMU), incorporating, for example, an accelerometer and gyroscope that measure orientation, and position sensors that measure the stroke extension of each pneumatic cylinder in the case of pneumatic actuators.

To know wheel position from the displacement of the associated actuator, a geometric model of each wheel's mechanical system was created. For driving wheels 60*a*, 60*b* and the rear casters/wheels 40*a*, 40*b*, movement of the associated actuator can be seen to vary the angle of the arm on which each wheel is mounted relative to a reference line on the wheelchair frame.

Figure 21:
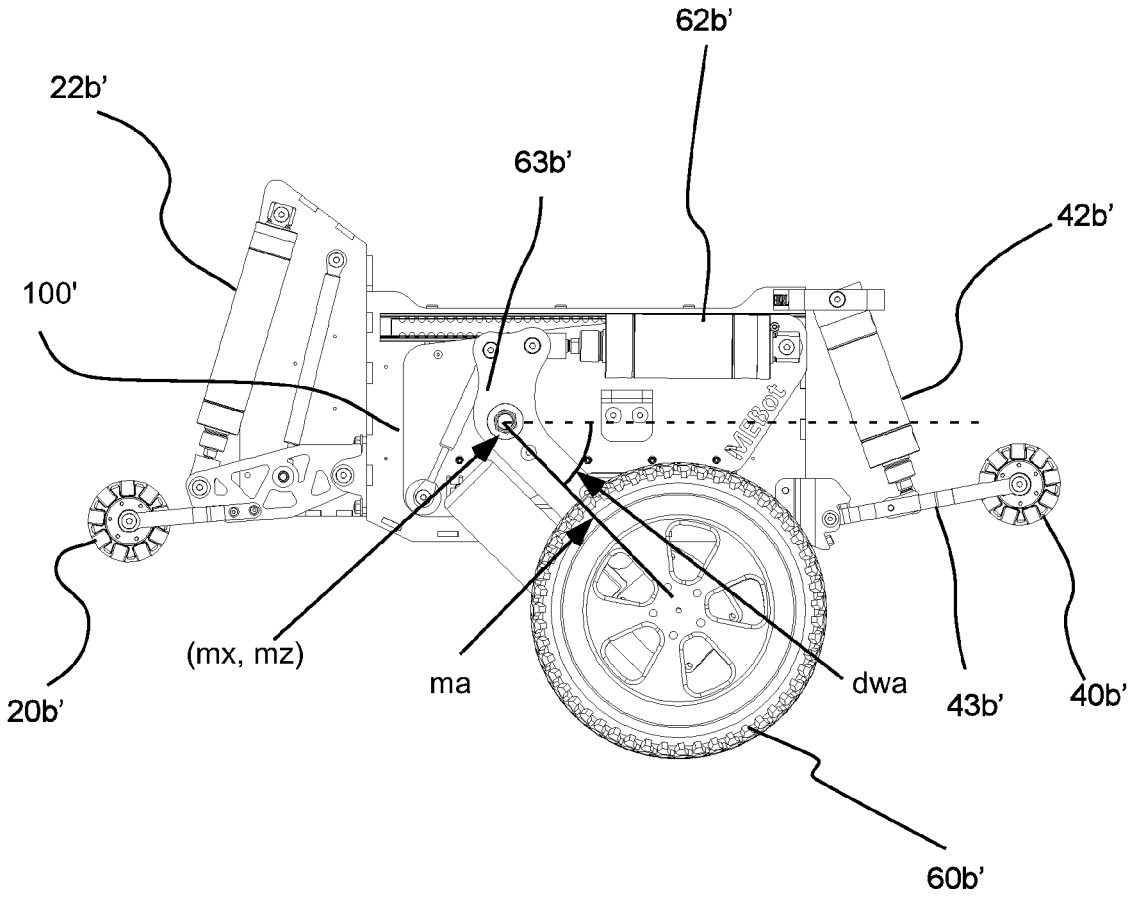
FIG. 21 illustrates an embodiment of a wheelchair hereof including descriptive indicators of parameters used in an embodiment of a self-leveling algorithm hereof.

Referring to FIG. 21, the angle between drive wheel arm 63*b* and a line extending horizontally from the point around which arm 63*b* pivots, dwa, can be calculated from the displacement of actuator 62*b* through a series of trigonometric relations. The position at which drive wheel 60*b* contacts the ground (dwx, dwz), relative to the main pivot point (mx, mz), with ma being the length of drive wheel arm 63*b* (between, the pivot point and the axis of drive wheel 60*b*), is given simply by $$(dwa,dwz)=(mx+ma*\cos dwa,mz-ma*stndwa)$$

The position of each rear caster can be related to the stroke of its actuator in a similar manner.

In a number of embodiments, when self-leveling is initialized, all four actuators—front left, front right, rear left, and rear right—are set to the midpoint of the wheelchair's ground clearance. As the minimum and maximum ground clearances are not the same for drive wheels 60*a*, 60*b* and rear casters 40*a*, 40*b*, the midpoint may be calculated from the greater of the minima and the lesser of the maxima. This ground clearance may defined as 0 on the z-axis for the self-leveling algorithm.

The positions of the wheels in the x-axis can be calculated, and the 0 may be defined as the midpoint between the drive wheels and the rear casters at this middle ground clearance. The positions of the wheels in the y-axis do not change with actuator position, and the zero position along this axis corresponds to the midline of the wheelchair.

A matrix, currentM, gives the coordinates of each wheel in the, above described, coordinate system. For compatibility with the transformation matrix, the currentM matrix is expanded to 4×4, with the last row being occupied by ones as follows:

$$\begin{pmatrix} dlx & rlx & rrx & drx \\ dly & rly & rry & dry \\ 0 & 0 & 0 & 0 \\ 1 & 1 & 1 & 1 \end{pmatrix}$$

A transformation matrix takes inputs for pitch φ (phi), and roll θ (theta), measured from the IMU sensor, to perform a rotation on the current wheel positions. The transformation matrix also performs a translation to refer the new wheel positions to the bottom of the frame—a subtraction of the midpoint ground clearance midz.

$$\begin{pmatrix} \cos(\phi) & 0 & \sin(\phi) & 0 \\ \sin(\theta)\sin(\phi) & \cos(\phi) & -\cos(\theta)\sin(\phi) & 0 \\ -\cos(\theta)\sin(\phi) & \sin(\phi) & \cos(\theta)\cos(\phi) & midz \\ 0 & 0 & 0 & 1 \end{pmatrix}$$

The product of the rotation matrix and currentM gives the desired wheel positions to maintain the frame level. The Z-values, the vertical position of each wheel relative to the bottom of the frame, are then fed into linearized equations to obtain the corresponding displacement of each actuator. These positions are then propagated to the lower level control system to move the pneumatics actuators.

Based on the current position of each actuator, and the geometric model, the actual position of each wheel can be calculated in the X, Y, and Z axes. The pitch and roll angles of the plane determined by any three wheels of the wheelchair can be calculated by taking the cross product of the vectors from any one of those wheels to the other two—for example, the cross product of the vector from the rear left caster to the front right drive wheel with the vector from the rear left caster to the front left drive wheel.

The current positions in the geometric model are also used to update the wheel position matrix, currentM. However, the midpoint ground clearance must be added to each wheels' Z-values to translate them back into the original coordinate system.

When the wheelchair seat reaches the desired position, the IMU sensor will read zero in both the pitch and roll directions. Any deviation from levelness—whether due to error in the linearization of the model, error introduced by the transformation matrix not accounting for the movement of the wheels in the X-direction, or a change in the slope encountered by the wheelchair—will cause the IMU sensor to register a nonzero value. If this value is greater than a predetermined threshold the self-leveling algorithm will iterate until both pitch and roll are below their respective thresholds. Because the wheel position matrix, currentM, includes the changes in the X-position of the wheels resulting from the geometry of the mechanical linkage, these X-direction changes—not otherwise accounted for—will not affect self-leveling performance over slowly changing angles.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A wheelchair, comprising:

a frame;

a seat attached to the frame;

a first forward wheel on a first side of the frame and a second forward wheel on a second side of the frame;

a first rearward wheel on the first side of the frame and a second rearward wheel on the second side of the frame;

a first pivot arm pivotably coupled to the frame via a first pivotal axis, and a second pivot arm pivotably coupled to the frame via a second pivotal axis;

a first drive wheel on the first side of the frame positioned intermediate between the first forward wheel and the first rearward wheel and coupled to the frame via the first pivot arm, wherein the first drive wheel is positioned forwardly of the first pivotal axis, and a second drive wheel on the second side of the frame positioned intermediate between the second forward wheel and the second rearward wheel and coupled to the frame via the second pivot arm, wherein the second drive wheel is positioned forwardly of the second pivotal axis;

a first forward wheel actuator in operative connection with the first forward wheel to control a vertical position of the first forward wheel relative to the frame;

a second forward wheel actuator in operative connection with the second forward wheel to control a vertical position of the second forward wheel relative to the frame;

a first rearward wheel actuator in operative connection with the first rearward wheel to control a vertical position of the first rearward wheel relative to the frame;

a second rearward wheel actuator in operative connection with the second rearward wheel to control a vertical position of the second rearward wheel relative to the frame;

a first drive wheel actuator in operative connection with the first drive wheel to control a vertical position of the first drive wheel relative to the frame; and a second drive wheel actuator in operative connection with the second drive wheel to control a vertical position of the second drive wheel relative to the frame;

wherein each of the first forward wheel actuator, the second forward wheel actuator, the first rearward wheel actuator, the second rearward wheel actuator, the first drive wheel actuator and the second drive wheel actuator is operable to independently control the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame.

2. The wheelchair of claim 1 further comprising a first longitudinal drive wheel actuator in operative connection with the first drive wheel to independently control a longitudinal position of the first drive wheel relative to the frame, a second longitudinal drive wheel actuator in operative connection with the second drive wheel to independently control the longitudinal position of the second drive wheel relative to the frame and a control system in operative connection with the first forward wheel actuator, the second forward wheel actuator, the first rearward wheel actuator, the second rearward wheel actuator, the first drive wheel actuator, the second drive wheel actuator, the first longitudinal drive wheel actuator and the second longitudinal drive wheel actuator.

3. The wheelchair of claim 2 further comprising a sensor system in operative connection with the control system.

4. The wheelchair of claim 3 wherein the sensor system comprises a sensor to measure an orientation of the seat relative to gravity, and the control system is operable to control at least one of the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame independently to maintain the orientation of the seat relative to gravity in a desired range.

5. The wheelchair of claim 4 wherein the control system is operable to control a plurality of the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame independently to maintain the orientation of the seat relative to gravity in a desired range.

6. The wheelchair of claim 5 wherein the control system is operable to maintain the orientation of the seat relative to gravity in the desired range when the wheelchair is traveling on at least one of a downslope, an upslope, a cross-slope, or on uneven terrain, or ascending or descending a curb, a step change or a change in elevation of up to 8 inches in height.

7. The wheelchair of claim 6 wherein the control system is operable to maintain the orientation of the seat relative to gravity in the desired range when the wheelchair is ascending or descending a curb.

8. The wheelchair of claim 7, wherein the desired range is within +/−5 degrees of horizontal.

9. The wheelchair of claim 7, wherein the control system is operable to execute a curb climbing sequence, wherein the curb climbing sequence comprises actuating the first and second drive wheel actuators to elevate the frame relative to the first and second drive wheels in order to position the first and second forward wheels above a curb.

10. The wheelchair of claim 2 wherein the control system is operable to effect a crawling motion of the wheelchair wherein the vertical position of the first drive wheel and the longitudinal position of the first drive wheel are changed and the vertical position of the second drive wheel and the longitudinal position of the first drive wheel are changed in a manner to pull the wheelchair along a path.

11. The wheelchair of claim 2 wherein the first forward wheel includes a first mechanism in operative connection therewith to provide resistance to longitudinal movement of the wheelchair when the first forward wheel is in a predetermined downward position and the second forward wheel includes in operative connection therewith a second mechanism to provide resistance to longitudinal movement of the wheelchair when the second forward wheel is in a predetermined downward position.

12. The wheelchair of claim 11 wherein the seat is immovably attached to the frame and changes in seat orientation relative to gravity are achieved via changing orientation of the frame relative to gravity or the seat is movably attached to the frame and changes in seat orientation relative to gravity are achieved via at least one of changes in orientation of the seat relative to the frame and changes in orientation of the frame relative to gravity.

13. The wheelchair of claim 1, further comprising:

a third pivot arm that is pivotably coupled to the frame, wherein the third pivot arm has a distal end; and a fourth pivot arm that is pivotably coupled to the frame, wherein the fourth pivot arm has a distal end, wherein the first forward wheel is coupled to the distal end of the third pivot arm, and wherein the second forward wheel is coupled to the distal end of the fourth pivot arm.

14. A method, comprising:

using a wheelchair comprising a frame;

a seat attached to the frame;

a first forward wheel on a first side of the frame and a second forward wheel on a second side of the frame; a first rearward wheel on the first side of the frame and a second rearward wheel on the second side of the frame;

a first pivot arm pivotably coupled to the frame via a first pivotal axis, and a second pivot arm pivotably coupled to the frame via a second pivotal axis;

a first drive wheel on the first side of the frame positioned intermediate between the first forward wheel and the first rearward wheel and coupled to the frame via the first pivot arm, wherein the first drive wheel is positioned forwardly of the first pivotal axis, and a second drive wheel on the second side of the frame positioned intermediate between the second forward wheel and the second rearward wheel and coupled to the frame via the second pivot arm, wherein the second drive wheel is positioned forwardly of the second pivotal axis;

a first forward wheel actuator in operative connection with the first forward wheel to control a vertical position of the first forward wheel relative to the frame;

a second forward wheel actuator in operative connection with the second forward wheel to control a vertical position of the second forward wheel relative to the frame;

a first rearward wheel actuator in operative connection with the first rearward wheel to control a vertical position of the first rearward wheel relative to the frame;

a second rearward wheel actuator in operative connection with the second rearward wheel to control a vertical position of the second rearward wheel relative to the frame;

a first drive wheel actuator in operative connection with the first drive wheel to control a vertical position of the first drive wheel relative to the frame; and a second drive wheel actuator in operative connection with the second drive wheel to control a vertical position of the second drive wheel relative to the frame; and operating each of the first forward wheel actuator, the second forward wheel actuator, the first rearward wheel actuator, the second rearward wheel actuator, the first drive wheel actuator and the second drive wheel actuator independently to independently control the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive relative to the frame and the vertical position of the second drive wheel relative to the frame.

15. The method of claim 14 further comprising operating a first longitudinal drive wheel actuator in operative connection with the first drive wheel to independently control a longitudinal position of the first drive wheel relative to the frame, operating a second longitudinal drive wheel actuator in operative connection with the second drive wheel to independently control the longitudinal position of the second drive wheel relative to the frame and providing a control system in operative connection with the first forward wheel actuator, the second forward wheel actuator, the first rearward wheel actuator, the second rearward wheel actuator, the first drive wheel actuator, the second drive wheel actuator, the first longitudinal drive wheel actuator and the second longitudinal drive wheel actuator.

16. The method of claim 15 further comprising measuring an orientation of the seat via the sensor system and controlling at least one of the vertical position of the first forward wheel relative to the frame, the vertical position of the second forward wheel relative to the frame, the vertical position of the first rearward wheel relative to the frame, the vertical position of the second rearward wheel relative to the frame, the vertical position of the first drive wheel relative to the frame and the vertical position of the second drive wheel relative to the frame independently to maintain the orientation of the seat relative to gravity in a desired range.

17. The method of claim 15 further comprising maintaining the orientation of the seat relative to gravity in the desired range when the wheelchair is traveling on at least one of a downslope, an upslope, a cross-slope or uneven terrain, or ascending or descending a curb, a step change or an elevation change of up to 8 inches in height.

18. The method of claim 15 further comprising controlling the wheelchair to effect a crawling motion of the wheelchair wherein the vertical position of the first drive wheel and the longitudinal position of the first drive wheel are changed and the vertical position of the second drive wheel and the longitudinal position of the first drive wheel are changed in a manner to pull the wheelchair along a path.

19. The method of claim 15 further comprising controlling the wheelchair to actuate one or more of the first forward wheel actuator, the second forward wheel actuator, the first rearward wheel actuator, the second rearward wheel actuator, the first drive wheel actuator, and the second drive wheel actuator to change an orientation of the seat relative to gravity to perform lateral pressure relief.

* * * * *